US010549873B2

(12) United States Patent
Hashimoto et al.

(10) Patent No.: US 10,549,873 B2
(45) Date of Patent: Feb. 4, 2020

(54) BEND-OPEN PACKAGE AND METHOD FOR MANUFACTURING BEND-OPEN PACKAGE

(71) Applicant: FUTURE LABO CO., LTD., Shiga (JP)

(72) Inventors: Tadashi Hashimoto, Shiga (JP); Hisashi Hashimoto, Shiga (JP)

(73) Assignee: FUTURE LABO CO, LTD., Shiga (JP)

( * ) Notice: Subject to any disclaimer, the term of this patent is extended or adjusted under 35 U.S.C. 154(b) by 80 days.

(21) Appl. No.: 15/933,908

(22) Filed: Mar. 23, 2018

(65) Prior Publication Data

US 2018/0208344 A1 Jul. 26, 2018

Related U.S. Application Data

(63) Continuation of application No. PCT/JP2017/028085, filed on Aug. 2, 2017.

(30) Foreign Application Priority Data

Aug. 3, 2016 (JP) ..... 2016-153068
Oct. 20, 2016 (JP) ..... 2016-205845
Mar. 31, 2017 (JP) ..... 2017-071887

(51) Int. Cl.
*B65B 47/04* (2006.01)
*B65B 61/18* (2006.01)
(Continued)

(52) U.S. Cl.
CPC ..... *B65B 47/04* (2013.01); *B65B 9/04* (2013.01); *B65B 61/18* (2013.01); *B65D 83/00* (2013.01)

(58) Field of Classification Search
CPC ..... B65B 47/04; B65B 9/04; B65B 61/18; B65B 61/02; B65D 83/00; B65D 75/585; B65D 75/28; B65D 75/366; B05C 17/005
(Continued)

(56) References Cited

U.S. PATENT DOCUMENTS 3,315,801 A * 4/1967 Lowry ..... B65D 75/48 206/469
3,986,640 A * 10/1976 Redmond ..... B65D 75/30 222/92
(Continued)

FOREIGN PATENT DOCUMENTS

CN 1399606 A 2/2003
JP S59-103866 A 6/1984
(Continued)

OTHER PUBLICATIONS

First Notification of Office Action issued in Chinese Patent Application No. 201780003232.4 dated Nov. 21, 2018 (11 pages).
(Continued)

*Primary Examiner* — Chun Hoi Cheung
(74) *Attorney, Agent, or Firm* — Nakanishi IP Associates, LLC

(57) ABSTRACT

A bend-open package includes a sealant without unsealing an opening until the package is bent to a predetermined bend angle or less to prevent leakage of the content in a package body. A method for manufacturing the bend-open package includes preparing a sheet member for a bend-open package, including in sequence, (a) forming cuts in the surface of a sheet base, and (b) press-bonding sealants press-cut from a sealant base to the surface of the sheet base to cover the cuts. The steps include embedding a periphery of the sealant in the surface of the sheet member by a predetermined depth, and forming a protrusion having a height smaller than a thickness of the sealant protruding outwardly from the
(Continued)

surface of the sheet member along the entire periphery of the sealant.

29 Claims, 41 Drawing Sheets

(51) Int. Cl.
*B65D 83/00* (2006.01)
*B65B 9/04* (2006.01)

(58) Field of Classification Search
USPC ..... 206/532, 469, 229, 484; 222/541.4
See application file for complete search history.

(56) References Cited

U.S. PATENT DOCUMENTS 4,236,652 A * 12/1980 Beguhn ..... B65D 75/26 222/92
4,430,013 A * 2/1984 Kaufman ..... A45D 34/04 401/132
4,493,574 A * 1/1985 Redmond ..... B65D 75/368 206/469
4,611,715 A * 9/1986 Redmond ..... B65D 75/368 206/484
4,724,982 A * 2/1988 Redmond ..... B65D 75/367 222/94
5,395,031 A 3/1995 Redmond
7,121,409 B1 * 10/2006 Hamilton ..... B65B 9/042 206/484.2
7,506,762 B2 * 3/2009 Nelson ..... B65B 61/02 206/229
7,552,823 B2 * 6/2009 Schuehrer ..... A45D 34/04 206/469
8,113,730 B2 * 2/2012 Maloney ..... A47L 13/17 206/229
8,225,932 B2 * 7/2012 Burattini ..... B65D 75/28 206/469
8,709,099 B2 * 4/2014 Littig ..... B65D 75/366 8/137
9,724,724 B2 * 8/2017 Goad ..... B05C 17/005
10,131,479 B2 * 11/2018 Burattini ..... B65D 75/30
10,159,823 B2 * 12/2018 Tidwell ..... B65D 75/585
2003/0089625 A1 * 5/2003 Moodie ..... B65D 75/585 206/204
2005/0178086 A1 * 8/2005 Bakken ..... B65B 61/02 53/412
2010/0059402 A1 * 3/2010 Burattini ..... B65D 75/585 206/469
2010/0155284 A1 6/2010 Gerstle et al.

FOREIGN PATENT DOCUMENTS

JP S64-37370 A 2/1989
JP H05-77866 A 3/1993
JP 2010-504888 A 2/2010
JP 2013-184716 A 9/2013
JP 2014-198601 A 10/2014
JP 2015-20803 A 2/2015
JP 2015-101370 A 6/2015
JP 5802769 B2 11/2015
JP 5858413 B1 2/2016
WO 2007-145535 A2 12/2007
WO 2014/141728 A1 9/2014

OTHER PUBLICATIONS

Office Action issued in Korean Patent Application No. 10-2018-7008019 dated May 27, 2019, with English Translation (5 pages).
Office Action issued in Canadian Patent Application No. 3,000,015 dated Mar. 11, 2019 (5 pages).
Extended European Search Report issued in European Patent Application No. 17837019, dated May 9, 2019 (7 pages).
International Search Report issued in PCT/JP2017/028085 dated Sep. 5, 2017 with English Translation (6 pages).
Office Action, issued in JP2016-153068, dated Sep. 13, 2016, with English Translation (9 pages).
Office Action, issued in JP2016-205845, dated Dec. 20, 2016, with English Translation (13 pages).
Office Action issued in Indian Patent Application No. 201847009805 dated Nov. 11, 2019, with English Translation (7 pages.)

* cited by examiner

BEND-OPEN PACKAGE AND METHOD FOR MANUFACTURING BEND-OPEN PACKAGE

CROSS-REFERENCE TO RELATED APPLICATIONS

This application is a continuation application of International Patent Application No. PCT/JP2017/028085 filed on Aug. 2, 2017, which claims priority to Japanese Patent Application Nos. 2016-153068 filed on Aug. 3, 2016, 2016-205845 filed on Oct. 20, 2016, and 2017-071887 filed on Mar. 31, 2017, the entire contents of which are incorporated by reference.

BACKGROUND OF INVENTION

Field of the Invention

The present invention relates to a bend-open package for individually containing liquid, paste, powder, a granule, or a tablet in fields such as food, pharmaceuticals, and cosmetics, and a method for manufacturing the bend-open package.

Various packages have been developed for containing an adequate amount of content in the forms listed above and dispensing the content as appropriate. One such package is described in Patent Literature 1.

The package described in Patent Literature 1 has a storage recess containing content with its opening sealed with a lid, and a half-cut in the top of the lid that is covered by a protective tape adhered in a peelable manner. In addition, a convex rib that is substantially rhombic as viewed from above crosses the half-cut in the middle of the top (surface) of the lid.

The protective tape adhered to the lid surface protrudes upward from the lid by the thickness of the tape base. When, for example, many packages are conveyed or transported together, adjacent packages may touch each other or rub against each other, and one package may touch or rub against the edge of the protective tape adhered to the lid of another package.

The protective tape can peel or curl before an end of the protective tape is pinched and peeled from the top of the lid. Retaining the protective tape to cover the half-cut is difficult. The half-cut in the lid is easily exposed outside, and a rupture in a part of the half-cut can leak the content stored in the storage recess outside.

CITATION LIST

Patent Literature

Patent Literature 1: Japanese Unexamined Patent Application Publication No. 64-37370

SUMMARY OF INVENTION

One or more aspects of the present invention are directed to a bend-open package that has an opening sealed with a sealant until bent to a predetermined bend angle or less, and a method for manufacturing the bend-open package.

One aspect of the present invention provides a bend-open package including a package body that stores content and is at least partially a flat member including a bend portion that is bendable for being folded into two, a sealant press-bonded to a surface of the flat member to cover an opening in the bend portion, where the sealant ruptures and opens in accordance with bending of the bend portion, and has a periphery embedded in and press-bonded to the surface of the flat member, and a protrusion located on the surface of the flat member along an edge included in the periphery, where the protrusion protrudes outwardly from the surface of the flat member and has a height smaller than a thickness of the sealant and smaller than a height of the sealant.

Another aspect of the present invention provides a method for manufacturing a bend-open package including a package body that stores content and is at least partially a flat member including a bend portion that is bendable for being folded into two, and a sealant press-bonded to a surface of the flat member to cover an opening in the bend portion, where the sealant ruptures and opens in accordance with bending of the bend portion. The method includes in sequence, forming a plurality of openings in a surface of a flat member strip at predetermined intervals in a longitudinal direction of the strip, press-cutting, with a sealant press-cutting unit, a sealant member strip into sealants each sized and shaped to cover one of the openings, and press-bonding the sealant that has been press-cut from the sealant member strip to the surface of the flat member to cover the opening, and press-bonding a periphery of the sealant embedded in the surface of the flat member with the sealant press-cutting unit, and forming a protrusion on the surface of the flat member along an edge of the sealant, where the protrusion protrudes outwardly from the surface of the flat member, and has a height smaller than a thickness of the sealant and smaller than a height of the sealant.

The method according to the above aspect enables the opening to remain sealed reliably until the bend-open package is bent to a predetermined bend angle or less.

More specifically, the edges of the sealant press-bonded to the surface of the flat member in the bend-open package are embedded in the surface of the flat member. When, for example, many packages are conveyed and transported together, one package obliquely touching or rubbing against the surface of the flat member in an adjacent other package is prevented from touching or rubbing against an edge of the sealant embedded in the surface of the flat member in the other package. This prevents the sealant covering the opening from peeling or curling.

Thus, the sealant is prevented from unsealing the opening until the bend-open package is bent to a predetermined bend angle or less. This more reliably prevents leakage of the content stored in the package body.

Moreover, a fingertip touching the bond between the flat member and the press-bonded sealant can receive smooth feel without being caught on the edge of the sealant.

Additionally, the sealant with its periphery embedded in the flat member provides an embedded press-bonded area larger than the embedded area achieved by flat press-bonding of the sealant to the flat member. Thus, the sealant can be firmly press-bonded to the surface of the flat member.

At least an edge of the sealant periphery includes, for example, the entire periphery of the sealant and a pair of facing edges of the sealant in the longitudinal direction or the transverse direction.

The flat member may be a simple sheet or a composite laminate of sheets of, for example, amorphous polyethylene terephthalate (A-PET), polypropylene (PP), biaxially oriented polyester (OPET), biodegradable plastic (PLA), polycarbonate (PC), polyethylene (PE), polystyrene (PS), polyethylene terephthalate glycol-modified (PETG), cardboard, or metal.

In some embodiments, the flat member may be a film member formed from a simple material or a composite material including OPET, biaxially oriented polypropylene (OPP), PE, cellulose propionate (CP), or metal (aluminum).

The flat member may be formed from other materials or may have other thicknesses depending on, for example, the type of the content or the internal shape of the package body.

The opening may be a cut or a slit, or a structure described in Japanese Patent Nos. 5802769 and 5858413, Japanese Unexamined Patent Application Publication (Translation of PCT Application) No. 2010-504888, and Japanese Unexamined Patent Application Publication No. 59-103866.

The sealant may be formed from thin foil such as aluminum foil, stainless steel foil, copper foil, iron foil, or a resin film. A sealant formed from, for example, foil that is 5- to 35-μm-thick aluminum foil allows the fabrication of a bend-open package having good moisture permeability, gas permeability, and bending openability. The gas permeability refers to the gas barrier properties for inhibiting the permeation of oxygen, moisture, corrosive gas, and other gases.

Other materials having good moisture permeability and gas permeability may replace aluminum foil depending on the characteristics and the physical properties of the content. Examples of such materials include a polyvinylidene chloride film, a composite containing other synthetic resin, and an aluminum-evaporated film having good gas permeability. Materials with low tear strength are appropriate.

The protrusion is located on the surface of the flat member along an edge of the sealant. The protrusion protrudes outwardly from the surface of the flat member, and has a height smaller than the thickness of the sealant and smaller than the height of the sealant. This structure allows the opening to remain sealed until the bend-open package is bent to a predetermined bend angle or less.

More specifically, for example, one package obliquely touching or rubbing against the surface of the flat member in an adjacent other package comes in contact with the protrusion protruding from the surface of the flat member in the other package before moving onto the sealant covering the opening and press-bonded to the surface of the flat member. This prevents direct contact with the edges of the sealant.

One package climbs over the protrusion protruding from the surface of the flat member in the other package and moves onto the sealant. This prevents contact with or rubbing against the edges of the sealant covering the opening and press-bonded to the surface of the flat member.

In this manner, when packages touch each other or nib against each other, the sealant covering the opening is prevented from peeling or curling.

Thus, the sealant is prevented from unsealing the opening until the bend-open package is bent to a predetermined bend angle or less. This prevents leakage of the content stored in the package body.

Moreover, for example, a fingertip or a fingernail is less likely to be caught on the edges of the sealant covering the opening and press-bonded to the surface of the flat member in a package, and climbs over the protrusion protruding from the surface of the flat member and smoothly moves onto the sealant. Thus, the sealant covering the opening is prevented from peeling or curling and provides smooth feel.

The edges of the sealant are embedded in and press-bonded to the surface of the flat member in the thickness direction and the protrusion protruding outwardly from the surface of the flat member is formed along the edges of the sealant. This more reliably prevents a catch on the edges of the sealant covering the opening.

In another aspect of the invention, the protrusion protruding outwardly from the surface of the flat member and having the height smaller than the thickness of the sealant may be formed along the entire periphery of the sealant embedded in and press-bonded to the surface of the flat member.

This aspect of the invention enables the opening to remain sealed reliably until the bend-open package is bent to a predetermined bend angle or less.

More specifically, for example, one package touching the protrusion protruding from the surface of the flat member in an adjacent other package in any direction can reliably avoid direct contact with the edges of the sealant covering the opening and press-bonded to the surface of the flat member in the other package.

In this manner, when packages touch each other or nib against each other, the sealant covering the opening is reliably prevented from peeling or curling. Thus, the sealant is prevented from unsealing the opening until the bend-open package is bent to a predetermined bend angle or less. This reliably prevent leakage of the content stored in the package body.

Moreover, for example, a fingertip or a fingernail is less likely to be caught on the edges of the sealant covering the opening and press-bonded to the surface of the flat member in a package in any direction. The fingertip or fingernail climbs over the protrusion protruding from the surface of the flat member and smoothly moves onto the sealant, thus receiving smoother feel.

In another aspect of the invention, the protrusion may have a height that is gradually greater from a periphery of the flat member toward the periphery of the sealant. This aspect of the invention enables the opening to remain sealed more reliably until the bend-open package is bent to a predetermined bend angle or less.

More specifically, for example, one package touching the protrusion formed on the flat member in an adjacent other package moves upward along the outer surface of the protrusion. The package thus has small resistance from the protrusion, and can climb over the protrusion and smoothly move onto the sealant.

In this manner, when packages touch each other or rub against each other, the sealant covering the opening is prevented from peeling or curling more reliably.

Thus, the sealant is prevented from unsealing the opening until the bend-open package is bent to a predetermined bend angle or less. This more reliably prevents leakage of the content stored in the package body.

Moreover, for example, a fingertip or a fingernail may also easily move onto the protrusion protruding from the surface of the flat member, and climb over the protrusion to smoothly move onto the sealant, thus receiving smooth feel.

In another aspect of the invention, the protrusion protruding outwardly from the surface of the flat member may have a height of at least substantially 50% of the thickness of the sealant.

This aspect of the invention enables the opening to remain sealed more reliably until the bend-open package is bent to a predetermined bend angle or less.

More specifically, the protrusion may have a height of, for example, about 30% or less of the thickness of the sealant. In this case, when packages are conveyed or transported, one package obliquely touching or rubbing against the surface of the flat member in an adjacent other package easily touches or nibs against the edges of the sealant press-bonded to the flat member in the other package. Also, the edges of the sealant may easily catch a fingertip or a fingernail, and may cause the sealant covering the opening to peel or curl.

In contrast, with the protrusion having a height of, for example, at least about (substantially) 50% of the thickness of the sealant, one package obliquely touching or rubbing against the surface of the flat member in an adjacent other package climbs over the protrusion protruding from the flat member in the other package and moves onto the sealant. This prevents contact with or rubbing against the edges of the sealant covering the opening and press-bonded to the surface of the flat member.

In this manner, when packages touch each other or rub against each other, the sealant covering the opening is prevented from peeling or curling more reliably.

Thus, the sealant is prevented from unsealing the opening until the bend-open package is bent to a predetermined bend angle or less. This more reliably prevents leakage of the content stored in the package body.

Moreover, for example, a fingertip or a fingernail is less likely to be caught on the edges of the sealant covering the opening and press-bonded to the surface of the flat member in a package, and climbs over the protrusion protruding from the surface of the flat member and smoothly moves onto the sealant. Thus, the sealant covering the opening is prevented from peeling or curling.

The protrusion may also have a height of at least about 30% of the thickness of the sealant when contact with the edges of the sealant press-bonded to the surface of the flat member can be prevented, and also a package, a fingertip, or a fingernail is less likely to be caught on the edges of the sealant and receives smooth feel.

In an aspect of the invention, the surface of the sealant may include a large number of microscopic depressions and projections.

The depressions and the projections may be formed from many bumps having substantially quadrangular pyramidal, conical, hemispherical, or other cross-sections.

This aspect of the invention enables the opening to remain sealed reliably until the bend-open package is bent to a predetermined bend angle or less.

More specifically, the sealant having microscopic depressions and projections can be thinner than a sealant having no depressions and projections.

The thinner sealant can rupture to open with small rupture resistance. The thin part of the sealant ruptures when the bend-open package is bent, and thus the sealant covering the opening can be more easily rupture to open.

In an aspect of the invention, the periphery of the sealant may include at least a pair of facing edges embedded in and press-bonded to the surface of the flat member in a thickness direction.

This aspect of the invention enables the opening to remain sealed more reliably until the bend-open package is bent to a predetermined bend angle or less.

More specifically, for example, one package touching or rubbing against an adjacent other package can more reliably avoid direct contact with the edges of the sealant covering the opening and press-bonded to the surface of the flat member in the other package.

In this manner, when packages touch each other or rub against each other, the sealant covering the opening is prevented from peeling or curling more reliably.

Thus, the sealant is prevented from unsealing the opening until the bend-open package is bent to a predetermined bend angle or less. This more reliably prevents leakage of the content stored in the package body.

In an aspect of the invention, the sealant may have an entire periphery embedded in and press-bonded to the surface of the flat member in a thickness direction.

This aspect of the invention enables the opening to remain sealed more reliably until the bend-open package is bent to a predetermined bend angle or less.

More specifically, for example, one package touching or rubbing against an adjacent other package in any direction can more reliably avoid direct contact with the edges of the sealant covering the opening and press-bonded to the surface of the flat member in the other package.

In this manner, packages touching or rubbing against each other can more reliably prevent the sealant covering the opening from peeling or curling.

Thus, the sealant is prevented from unsealing the opening until the bend-open package is bent to a predetermined bend angle or less. This more reliably prevents leakage of the content stored in the package body.

In an aspect of the invention, an edge included in the periphery of the sealant or an entire periphery of the sealant is embedded in and press-bonded to the surface of the flat member to have an embedded portion having a depth gradually increasing from a middle of the sealant toward an outer periphery of the sealant.

This aspect of the invention enables the opening to remain sealed more reliably until the bend-open package is bent to a predetermined bend angle or less.

More specifically, for example, one package touching or rubbing against the surface of the flat member in an adjacent other package more reliably avoids direct contact with the edges of the sealant covering the opening and press-bonded to the surface of the flat member in the other package.

In this manner, packages touching or rubbing against each other can more reliably prevent the sealant covering the opening from peeling or curling.

Thus, the sealant is prevented from unsealing the opening until the bend-open package is bent to a predetermined bend angle or less. This more reliably prevents leakage of the content stored in the package body.

In another aspect of the invention, the sealant press-cutting unit may include a sealant pressing part that presses the sealant toward the surface of the flat member in a thickness direction with the sealant overlaid on the flat member to cover the opening.

The sealant pressing part may be a flat pressing part with a substantially flat cross-section, a trapezoidal pressing part with a substantially trapezoidal cross-section, or a hemispherical pressing part with a substantially hemispherical cross-section.

In this aspect of the invention, the sealant is prevented from unsealing the opening until the bend-open package is bent to a predetermined bend angle or less. This reliably prevents leakage of the content stored in the package body.

More specifically, the sealant overlaid on the flat member to cover the opening is pressed in the thickness direction on the surface of the flat member with the sealant pressing part of the sealant press-cutting unit.

The pressed sealant can be thinner than the sealant not pressed by the sealant pressing part.

The thinner sealant can rupture to open with small rupture resistance. The sealant covering the opening on the flat member can easily and reliably rupture to open when the bend-open package is bent.

The sealant pressing part reliably press-bonds the sealant to the surface of the flat member to cover the opening, instead of adhering the sealant to the flat member using an agent such as glue or adhesive.

In an aspect of the invention, the sealant pressing part may include a roughening section configured to form a large number of microscopic depressions and projections on the surface of the sealant.

This aspect of the invention enables the opening to remain sealed more reliably until the bend-open package is bent to a predetermined bend angle or less.

More specifically, the sealant overlaid on the flat member to cover the opening is pressed in the thickness direction on the surface of the flat member with the roughening section of the sealant pressing part. The pressing forms a large number of microscopic depressions and projections on the surface of the sealant.

The sealant having depressions and projections can be thinner than a sealant having no depressions and projections.

The thinner sealant can rupture to open with smaller rupture resistance. The thin part of the sealant ruptures when the bend-open package is bent, and thus the sealant covering the opening can be more easily rupture to open.

Moreover, the press-bonding of the sealant deformed to have depressions and projections to the flat member provides a larger press-bonded area between the sealant and the flat member than the area achieved by press-bonding a sealant to the surface of the flat member in a flat manner. Thus, the sealant can be more firmly press-bonded to the surface of the flat member.

Additionally, the depressions and the projections substantially uniformly formed on the surface of the sealant provide substantially uniform sealant press-bonding. The reliable press-bonding of the entire sealant to the surface of the flat member can be visually observed.

In an aspect of the invention, the roughening section may be included in an area of the sealant pressing part corresponding to the opening in the flat member.

This aspect of the invention enables the sealant part corresponding to the opening in the flat member to rupture to open.

More specifically, when the sealant overlaid on the flat member to cover the opening is pressed in the thickness direction on the surface of the flat member with the roughening section of the sealant pressing part, a large number of depressions and projections are formed in the sealant part corresponding to the opening in the flat member.

This structure further reduces the thickness of the sealant part corresponding to the opening in the flat member.

This structure reliably allows the sealant part corresponding to the opening in the flat member to rupture to open and reliably prevents the other sealant part from rupturing to open.

In an aspect of the invention, the sealant pressing part may include, on a pressing end periphery thereof, a press-cutting section that press-cuts the sealant member into sealants each sized and shaped to cover the opening, and the press-cutting section may be configured to embed at least a pair of facing edges included in the periphery of the sealant into the surface of the flat member in the thickness direction.

At least a pair of facing edges included in the periphery of the sealant includes, for example, the entire pressing end periphery of the sealant pressing part, and a pair of facing edges of the sealant pressing part in the longitudinal direction or the transverse direction.

This aspect of the invention enables the edges of the sealant to be reliably embedded in the surface of the flat member.

More specifically, when the sealant member overlaid on the flat member to cover openings is press-cut, with the press-cutting section of the sealant pressing part, into sealants each sized and shaped to cover an opening in the flat member, at least a pair of facing edges included in the periphery of the sealant that is press-cut from the sealant member are embedded by the press-cutting section in the surface of the flat member in the thickness direction. The press-cutting section also deforms the flat member along at least the pair of facing edges included in the periphery of the sealant to protrude outwardly from the surface of the flat member.

In this manner, a protrusion protruding outwardly from the surface of the flat member and having a height smaller than the thickness of the sealant is formed along the edges of the sealant that is embedded in and press-bonded to the surface of the flat member.

For example, one package obliquely touching or rubbing against the surface of the flat member in an adjacent other package comes in contact with the protrusion protruding from the surface of the flat member in the other package before moving onto the sealant covering the opening and press-bonded to the surface of the flat member in the other package, and thus can avoid direct contact with the edges of the sealant.

One package climbs over the protrusion protruding from the surface of the flat member in the other package and moves onto the sealant. This reliably prevents contact with or rubbing against the edges of the sealant covering the opening and press-bonded to the surface of the flat member, and also reliably prevents the sealant covering the opening from peeling or curling.

Thus, the sealant is prevented from unsealing the opening until the bend-open package is bent to a predetermined bend angle or less. This prevents leakage of the content stored in the package body.

In an aspect of the invention, the press-cutting section may have a cutting edge protruding in a direction in which the edges of the sealant are embedded in the surface of the flat member, and the cutting edge may have a predetermined embedding angle causing an embedding depth of the edges of the sealant to gradually increase from a middle of the sealant toward an outer periphery of the sealant.

This aspect of the invention enables the edges of the sealant to be more reliably embedded in the surface of the flat member.

More specifically, an edge or the periphery of the sealant is embedded in and press-bonded to the surface of the flat member to have the embedding depth increasing from the middle toward the outer periphery of the sealant and to be buried under the surface of the flat member.

This more reliably prevents one package touching or rubbing against an adjacent other package from coming in contact with the edges or the periphery of the sealant covering the opening and press-bonded to the surface of the flat member in the other package, and also more reliably prevents the sealant from peeling or curling.

Thus, the sealant is prevented from unsealing the opening until the bend-open package is bent to a predetermined bend angle or less. This more reliably prevents leakage of the content stored in the package body.

Another aspect of the present invention provides a bend-open package including a package body that stores content and is at least partially a flat member including a bend portion that is bendable for being folded into two, a sealant press-bonded to a surface of the flat member to cover an opening in the bend portion, where the sealant ruptures and opens in accordance with bending of the bend portion, and has a periphery with at least a pair of facing edges embedded in and press-bonded to the surface of the flat member in a thickness direction of the flat member, a protrusion located on the surface of the flat member along the edges of the sealant, where the protrusion protrudes outwardly from the edges of the sealant embedded in the flat member.

Another aspect of the present invention provides a method for manufacturing a bend-open package including a package body that stores content and is at least partially a flat member including a bend portion that is bendable for being folded into two, and a sealant press-bonded to a surface of the flat member to cover an opening in the bend portion, where the sealant ruptures and opens in accordance with bending of the bend portion. The method includes in sequence, forming a plurality of openings in a surface of a flat member strip at predetermined intervals in a longitudinal direction of the strip, press-cutting, with a sealant press-cutting unit, a sealant member strip into sealants each sized and shaped to cover one of the openings, and press-bonding the sealant that has been press-cut from the sealant member strip to the surface of the flat member to cover the opening, and press-bonding a periphery of the sealant embedded in the surface of the flat member in a thickness direction, and forming a protrusion on the surface of the flat member along an edge of the sealant embedded in the flat member, where the protrusion protrudes outwardly from the edge of the sealant.

This aspect of the invention enables the sealant to seal the opening until the bend-open package is bent to a predetermined bend angle or less.

When, for example, many bend-open packages (or simply packages) are conveyed or transported together, one package obliquely touching or rubbing against the surface of the flat member in an adjacent other package has its protrusion protruding from the surface of the flat member serves as a protective wall, and can avoid direct contact with the edges of the sealant in the other package.

This prevents the sealant covering the opening from peeling or curling at its edge, and also enables the sealant to seal the opening until the sealant ruptures and opens when the bend-open package is bent.

Thus, the sealant is prevented from unsealing the opening until the bend-open package is bent to a predetermined bend angle or less. This prevents leakage of the content stored in the package body.

Moreover, the part corresponding to the protrusion on the flat member has high rigidity, and thus has strength high enough to withstand pressure applied from above to the flat member. The sealant is thus prevented from unsealing the opening.

At least an edge of the sealant periphery includes, for example, the entire periphery of the sealant and a pair of facing edges of the sealant in the longitudinal direction or the transverse direction.

The flat member may be a simple sheet or a composite sheet of films, for example, A-PET, styrene (S), PC, PP, OPET, PLA, PE, PS, PETG, cardboard, or metal. The flat member may be a thermoplastic material with a thickness of about 0.1 to 5 mm.

In some embodiments, the flat member may be a film formed from a simple material or a composite material including OPET, OPP, PE, CP, or metal (aluminum).

The flat member may be formed from other materials or may have other thicknesses depending on, for example, the type of the content or the internal shape of the package body.

The opening may be, for example, a straight, wavy, arc, double-peak, trapezoidal, M-shaped, V-shaped, or U-shaped cut. In some embodiments, the opening may be a structure described in Japanese Patent Nos. 5802769 and 5858413, Japanese Unexamined Patent Application Publication (Translation of PCT Application) No. 2010-504888, and Japanese Unexamined Patent Application Publication No. 59-103866.

The opening may have any size and shape depending on the type of the content and the size of the package.

The sealant may be formed from thin foil such as aluminum foil, stainless steel foil, copper foil, iron foil, or a resin film, and may have a thickness of about 5 to 50 μm. A sealant formed from, for example, aluminum foil allows the fabrication of a bend-open package having good moisture permeability, gas permeability, and bending openability. The gas permeability refers to the gas barrier properties for inhibiting the permeation of oxygen, moisture, corrosive gas, and other gases.

Other materials having good moisture permeability and gas permeability may replace aluminum foil depending on the characteristics and the physical properties of the content. Examples of such materials include a polyvinylidene chloride film, a composite containing other synthetic resin, and an aluminum-evaporated film having good gas permeability. Materials with low tear strength are appropriate.

In an aspect of the invention, the protrusion on the flat member may have a height that is 0.5 or more times a thickness of the sealant.

Being 0.5 or more times above includes being once or more times.

This aspect of the invention reliably prevents the opening from being unsealed before the bend-open package is bent to a predetermined bend angle or less.

More specifically, for example, one package obliquely touching or rubbing against the surface of the flat member in an adjacent other package comes in contact with the protrusion on the flat member in the other package.

The protrusion on the flat member serves as a protective wall, which reliably prevents the package from coming into direct contact with the edges of the sealant.

Thus, the sealant is prevented from unsealing the opening until the bend-open package is bent to a predetermined bend angle or less, and the sealant reliably seals the opening.

In an aspect of the invention, the protrusion on the flat member has a width that is once or more times the thickness of the sealant.

This aspect of the invention more reliably prevents the opening from being unsealed before the bend-open package is bent to a predetermined bend angle or less.

More specifically, if one package touches the protrusion on the flat member in an adjacent other package, the protrusion is less likely to chip or deform, and will stably function as a protective wall. Thus, the package can avoid direct contact with the edges of the sealant in the other package.

Thus, the sealant is prevented from unsealing the opening until the bend-open package is bent to a predetermined bend angle or less, and the sealant more reliably seals the opening.

Moreover, the part corresponding to the protrusion on the flat member has higher rigidity, and thus has strength high enough to withstand pressure applied from above to the flat member. The sealant is more reliably prevented from unsealing the opening.

In an aspect of the invention, the protrusion on the flat member may be raised from a surface of the sealant press-bonded to the flat member.

This aspect of the invention more reliably prevents the opening from being unsealed before the bend-open package is bent to a predetermined bend angle or less.

More specifically, for example, one package obliquely touching or rubbing against the surface of the flat member in an adjacent other package comes in contact with the protrusion on the flat member raised from the surface of the sealant in the other package.

The protrusion on the flat member serves as a protective wall, which more reliably prevents one package from coming into direct contact with the edges of the sealant in the other package, or the sealant covering the opening from having a scratch on its surface and peeling or curling at its edge.

Thus, the sealant is prevented from unsealing the opening until the bend-open package is bent to a predetermined bend angle or less, and the sealant more reliably seals the opening.

In an aspect of the invention, the sealant may have a protrusion protruding outwardly from the surface of the sealant, and the protrusion on the sealant may be located inside the edges of the sealant embedded in the flat member and extends along the protrusion on the flat member.

This aspect of the invention more reliably prevents the opening from being unsealed before the bend-open package is bent to a predetermined bend angle or less.

More specifically, for example, although one package touching or rubbing against an adjacent other package avoids contact with either the protrusion on the flat member or the protrusion on the sealant in the other package, the package comes in contact with the other protrusion, and thus can avoid direct contact with the edges of the sealant in the other package.

In this manner, the two protrusions serve as protective walls, which more reliably prevent one package from coming into direct contact with the edges of the sealant, or the sealant covering the opening from peeling or curling at its edge.

Thus, the sealant is prevented from unsealing the opening until the sealant ruptures and opens when the bend-open package is bent, and the sealant more reliably seals the opening.

Moreover, the part corresponding to the two protrusions on the flat member has higher rigidity, and thus has strength high enough to withstand pressure applied from above to the flat member. The sealant is thus more reliably prevented from unsealing the opening.

In an aspect of the invention, the protrusion on the sealant may be higher than the protrusion on the flat member.

This aspect of the invention more reliably prevents the opening from being unsealed before the bend-open package is bent to a predetermined bend angle or less.

More specifically, for example, one package touching or rubbing against an adjacent other package may avoid contact with the protrusion on the flat member in the other package. The package comes in contact with the protrusion on the sealant, which is higher than the protrusion on the flat member, and thus avoids direct contact with the edges of the sealant in the other package.

In this manner, the protrusion on the flat member serves as a protective wall, which more reliably prevents one package from coming into direct contact with the edges of the sealant, or the sealant covering the opening from having a scratch on its surface and peeling or curling at its edge.

Thus, the sealant is prevented from unsealing the opening until the sealant ruptures and opens when the bend-open package is bent, and the sealant more reliably seals the opening.

In an aspect of the invention, the edges of the sealant embedded in the flat member in the thickness direction may have an embedding depth that is 0.5 or more times the thickness of the sealant.

This aspect of the invention more reliably prevents the opening from being unsealed before the bend-open package is bent to a predetermined bend angle or less.

More specifically, the edges of the sealant are embedded in the surface of the flat member in the thickness direction. This then causes the flat member along the edges of the sealant to protrude outwardly from the part of the sealant embedded in the flat member.

As a result, the protrusion can be formed on the surface of the flat member along the edges of the sealant to prevent the sealant covering the opening from having a scratch on its surface and the sealant from peeling or curling at its edge.

In an aspect of the invention, the protrusion on the flat member may cover the edges of the sealant embedded in the flat member.

This aspect of the invention more reliably prevents the opening from being unsealed before the bend-open package is bent to a predetermined bend angle or less.

More specifically, the edges of the sealant embedded in the flat member are covered by the protrusion on the flat member. Thus, for example, one package touching or rubbing against an adjacent other package avoids direct contact with the edges of the sealant embedded in the flat member in the thickness direction in the other package.

This more reliably prevents the sealant covering the opening from peeling or curling at its edge.

Thus, the sealant is prevented from unsealing the opening until the sealant ruptures and opens when the bend-open package is bent, and the sealant more reliably seals the opening.

In an aspect of the invention, the sealant press-cutting unit may include a press-cutting roll rotatable in a direction allowing the flat member and the sealant member to be fed in a feeding direction.

This aspect of the invention enables the continuous manufacture of many bend-open packages.

More specifically, the press-cutting roll is rotated in the direction in which the flat member and the sealant member are fed, and the sealant member strip is press-cut into sealants each sized and shaped to cover an opening in a bend portion on the flat member. When the sealant that is press-cut from the sealant member is press-bonded to the surface of the flat member to cover the opening, the periphery of the sealant is embedded in the flat member in the thickness direction. A protrusion protruding outwardly from the edges of the sealant embedded in the flat member is formed on the surface of the flat member along the edges of the sealant.

In this manner, the flat member to which the sealants are press-bonded used for bend-open packages is continuously manufactured.

These aspects of the invention provide a bend-open package that has an opening sealed with a sealant until bent to a predetermined bend angle or less, and a method for manufacturing the bend-open package.

DETAILED DESCRIPTION

Embodiments of the present invention will now be described with reference to the accompanying drawings.

First Embodiment

Figure 1A:
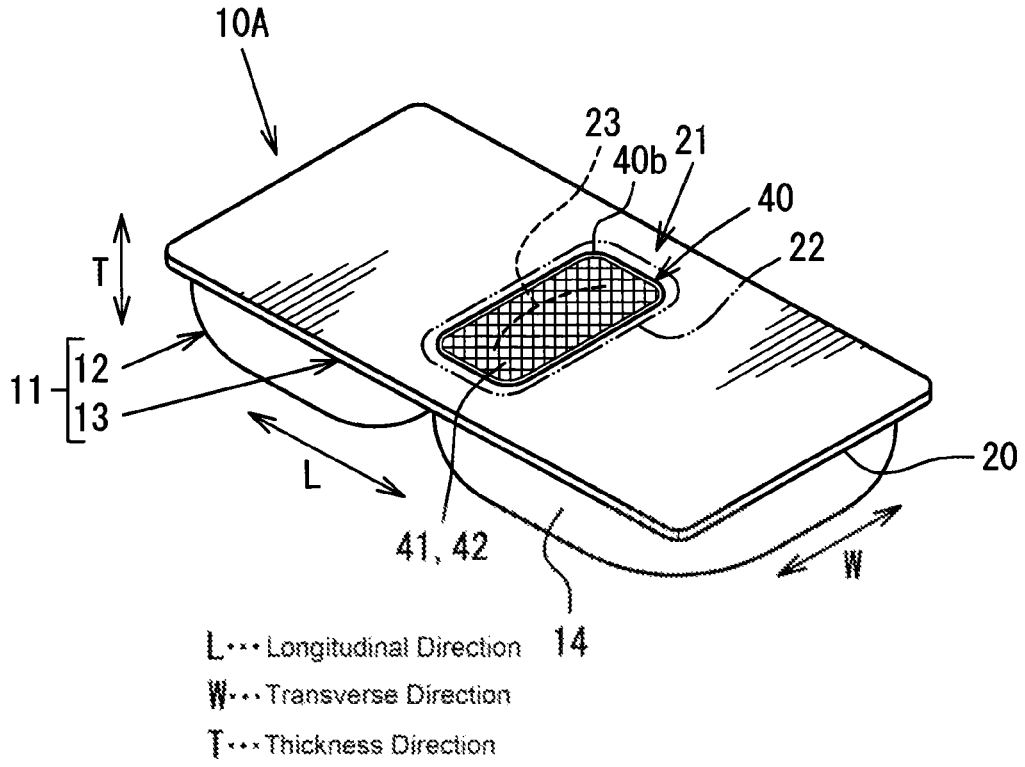
FIGS. 1(*a*) and 1(*b*) show a bend-open package according to a first embodiment.
Figure 1B:
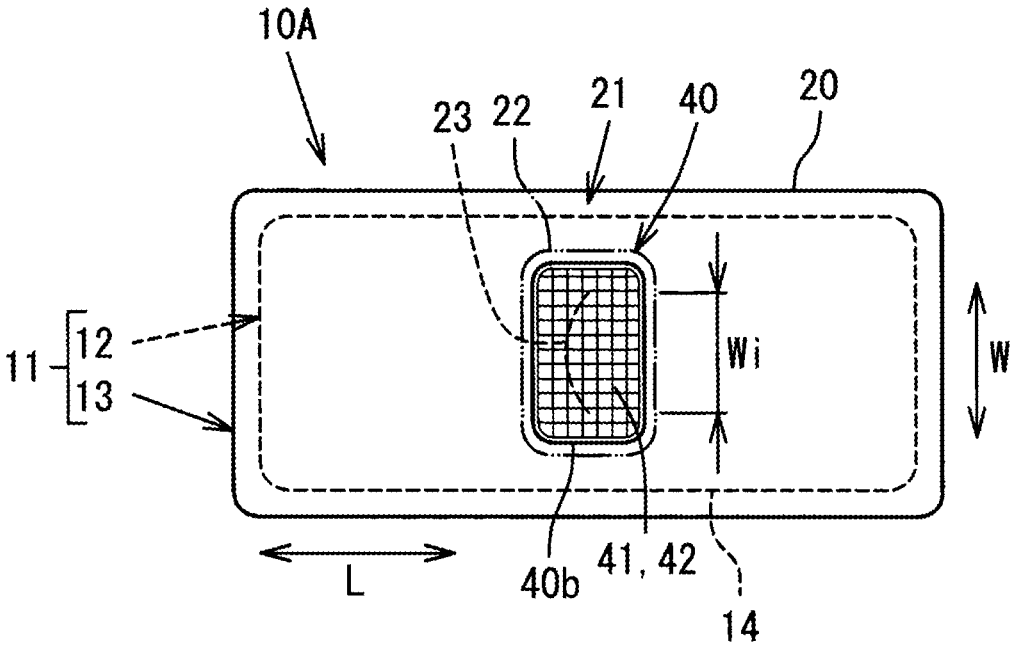

FIG. 1 is a diagram describing a bend-open package 10A according to a first embodiment. More specifically, FIG. 1(*a*) is a perspective view of the bend-open package 10A viewed from above, and FIG. 1(*b*) is a plan view of the bend-open package 10A showing its surface.

Figure 2A:
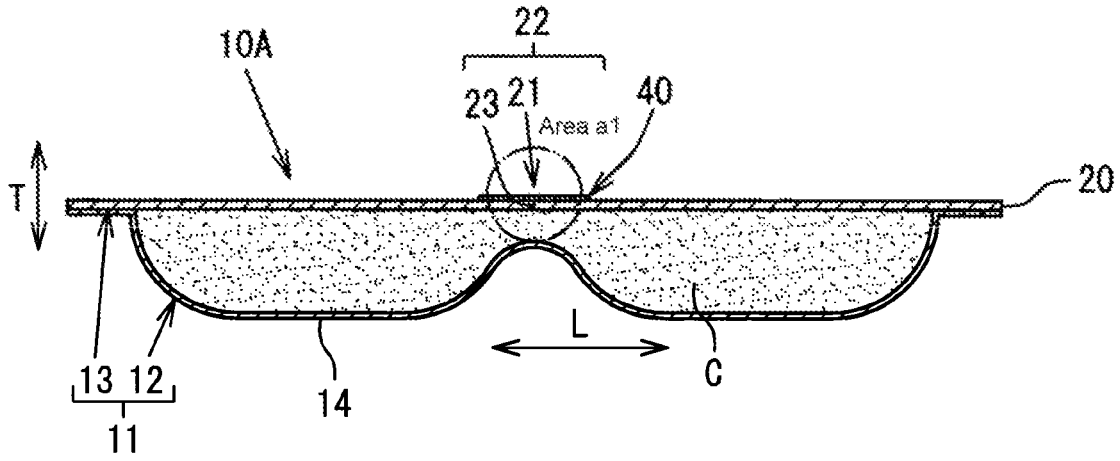
FIGS. 2(*a*) and 2(*b*) show the opening structure of the bend-open package.
Figure 2B:
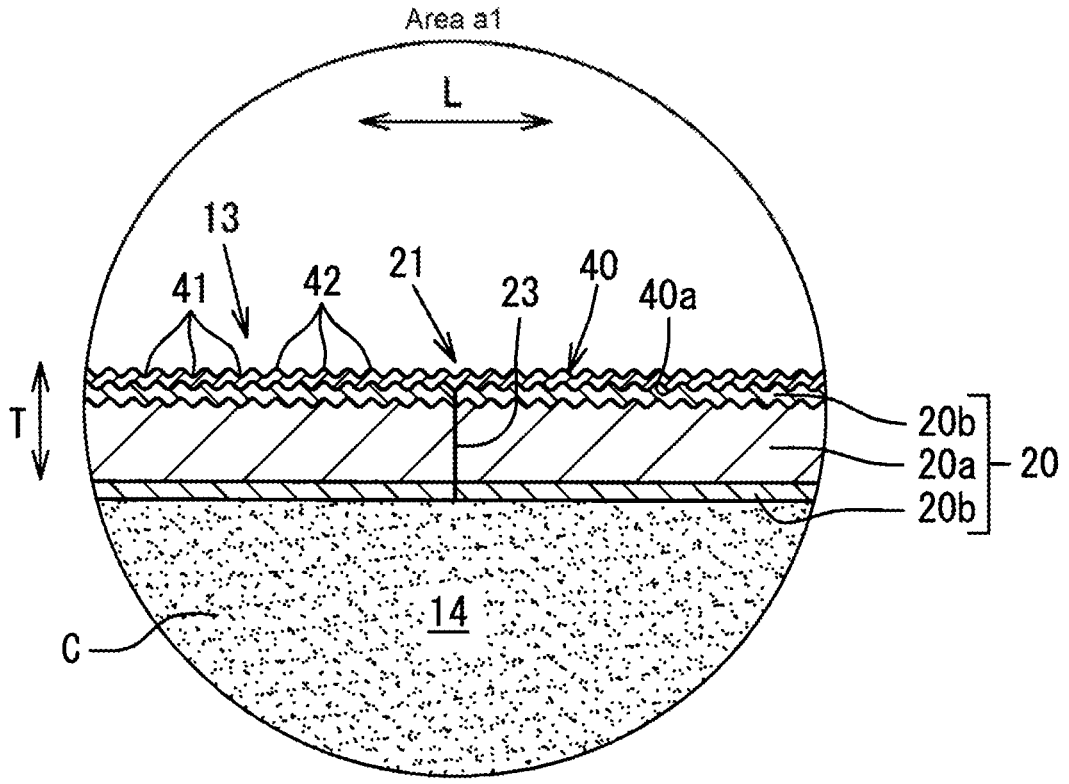

FIG. 2 is a diagram describing an opening structure of the bend-open package 10A. More specifically, FIG. 2(*a*) is a cross-sectional view of the bend-open package 10A taken along the centerline perpendicular to a transverse direction W, and FIG. 2(*b*) is an enlarged cross-sectional view of area a1 shown in FIG. 2(*a*).

Figure 3A:
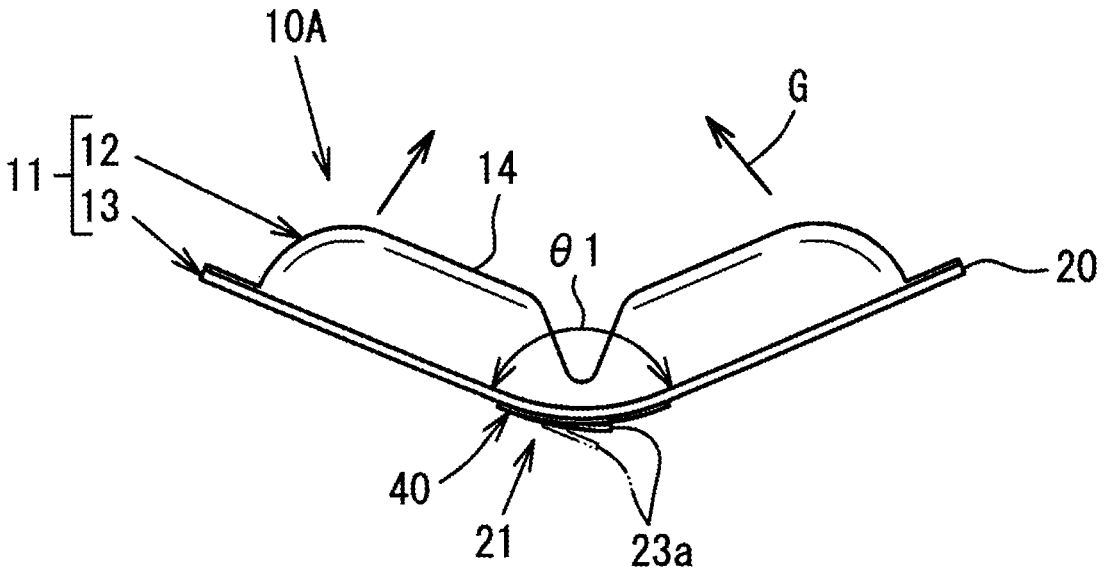
FIGS. 3(*a*) and 3(*b*) show the bending of the bend-open package.
Figure 3B:
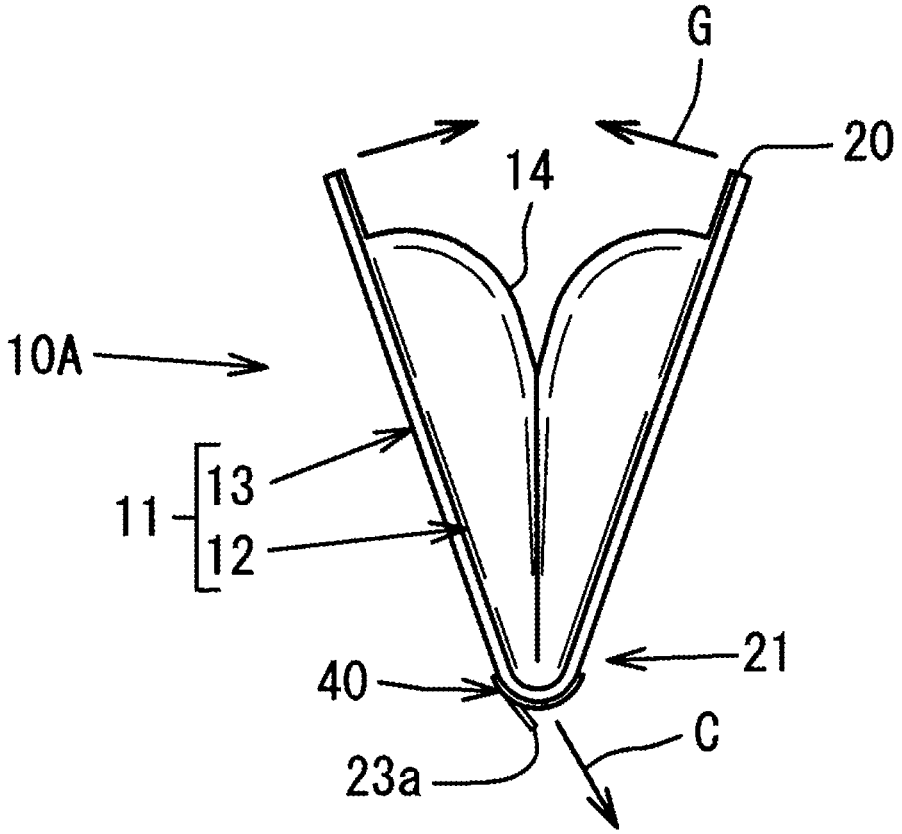

FIG. 3 is a diagram describing the bending of the bend-open package 10A. More specifically, FIG. 3(*a*) is a side view of the bend-open package 10A showing the start of bending, and FIG. 3(*b*) is a side view of the bend-open package 10A folded into two.

Figure 4:
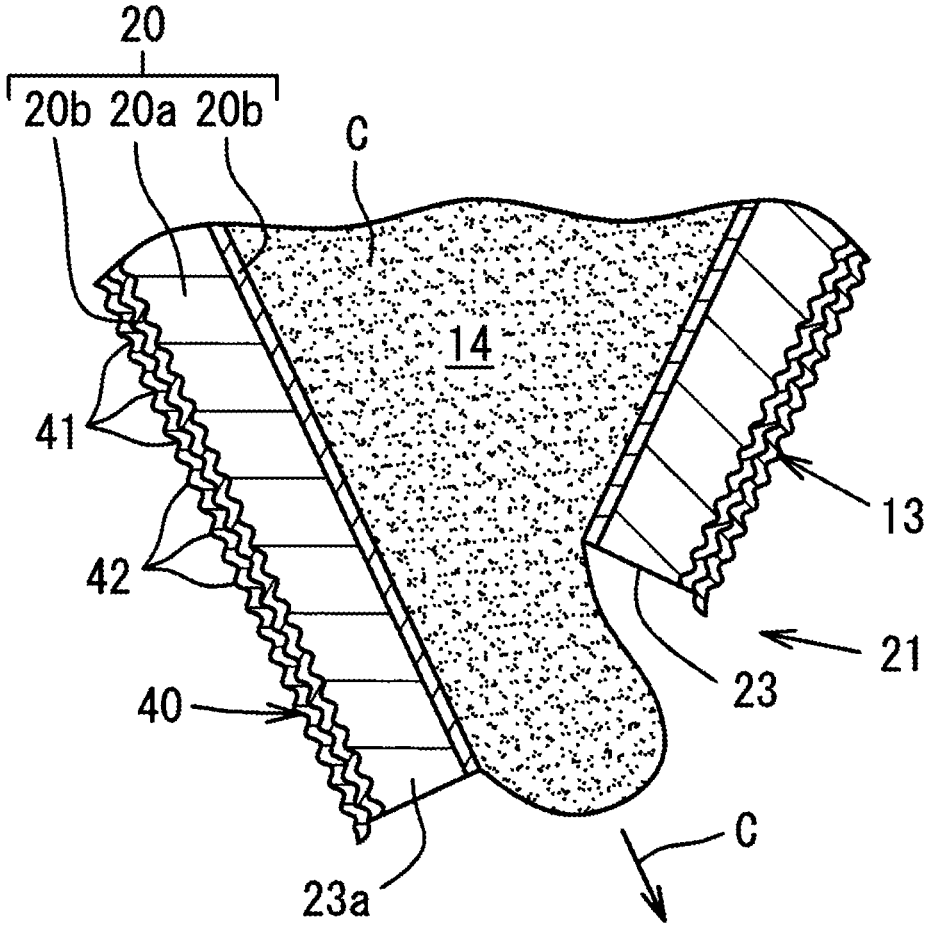
FIG. 4 is an enlarged partial cross-sectional view of the bend-open package showing dispensing of content from the package.

FIG. 4 is an enlarged partial cross-sectional view of the bend-open package 10A showing dispensing of content C from the package.

As used herein, a longitudinal direction L (lengthwise direction) is the same as the longitudinal direction of the bend-open package 10A substantially rectangular as viewed from above, and the transverse direction W (widthwise direction) is the direction perpendicular to the longitudinal direction L in plane.

The bend-open package 10A in the first embodiment is a small package containing (filled with) a single dose of content C, and includes a package body 11 containing content C. The package body 11 includes a flexible pouch-like body 12, and a lid 13 closing the opening of the body 12 (refer to FIGS. 1 and 2).

The body 12 includes a pouch-like container 14 containing a predetermined dose of content C. The container 14 is formed from a synthetic resin film with a thickness of 150 μm (DIAMIRON F manufactured by Mitsubishi Plastics, Inc.) (refer to FIGS. 1 and 2).

The lid 13 includes a substantially flat synthetic resin sheet member 20 arranged on the inner side of the package body 11 (the lower side in FIG. 2(*a*)), and an aluminum foil sealant 40 press-bonded to the sheet member 20 on the outer side of the package body 11 (the upper side in FIG. 2(*a*)).

The sheet member 20 is sized and shaped to cover the opening of the body 12. The back periphery of the sheet member 20 is thermal-welded to the periphery of the opening of the body 12 to close the opening of the body 12 with the lid 13 (refer to FIG. 2(*a*)).

The sheet member 20 is a composite laminate of an amorphous polyethylene terephthalate (A-PET) sheet base 20*a* with a thickness of 0.3 mm and a polyethylene (PE) film sealant material 20*b* with a thickness of 0.03 mm (refer to FIG. 2(*b*)).

The film sealant material 20*b* is adhered to cover both front and back sides (or at least one of the two sides) of the sheet base 20*a*.

The sheet member 20 may also be a composite laminate including a biaxially oriented polyester (OPET) sheet (not shown) in addition to the sheet base 20*a* and the film sealant material 20*b*.

The sheet member 20 has, in its middle in the longitudinal direction L, a bend portion 21 foldable into two in the longitudinal direction L. The bend portion 21 extends in the transverse direction W perpendicular to the longitudinal direction L of the sheet member 20 (refer to FIGS. 1 and 2).

The bend portion 21 has, in its middle in the transverse direction W, an opening area 22 indicated by a two-dot chain line in FIG. 1. The opening area 22 on the sheet member 20 has a slit cut 23 in its middle surface. The slit cut 23 penetrates in a thickness direction T when the sheet member 20 is bent (refer to FIGS. 1 and 2).

The cut 23 is formed in the transverse direction W perpendicular to the longitudinal direction L of the sheet member 20, and has an arc shape curving to one end of the sheet member 20 in the longitudinal direction L as viewed in the thickness direction T of the sheet member 20. The cut 23 has a width Wi equal to or less (preferably about 70% or less) than the width of the sheet member 20 in the transverse direction W (refer to FIG. 1(*b*)).

The sealant 40 includes aluminum foil with a thickness of 0.02 mm and heat-sealable acrylic copolymer coated on both the front and back sides of the aluminum foil (refer to FIG. 2(*b*)).

The sealant 40 is one size smaller than the opening area 22 of the bend portion 21, and sized and shaped to cover the cut 23 in the opening area 22. The sealant 40 has a rupture strength that causes a rupture when the bend portion 21 of the sheet member 20 is bent to a predetermined bend angle θ1 or less (refer to FIGS. 3 and 4).

The back side of the sealant 40, which is press-bonded to the surface of the sheet member 20, is substantially uniformly coated (or covered) with an adhesive layer 40*a* formed from an adhesive such as a hot-melt (refer to FIG. 2(*b*)).

More specifically, the sealant 40 is press-bonded to the outer surface of the opening area 22, which is to be mountain folded when the bend portion 21 of the sheet member 20 is folded into two, to cover the cut 23 in the opening area 22 (refer to FIGS. 1 to 3).

A large number of depressions 41 and projections 42 are substantially uniformly formed over the surface surrounded by a periphery 40*b* of the sealant 40 (refer to FIG. 2(*b*)). The entire periphery 40*b* is embedded in the surface of the sheet member 20 in the thickness direction T by a predetermined depth D1.

The embedding depth D1 of the periphery 40*b* is about 0.1 mm. The height difference D2 between the depressions 41 and the projections 42 is about 0.1 to 10 times a thickness E1 of the sealant 40, and may preferably be five times or less (refer to the enlarged view of area a1 shown in FIG. 2(*a*)).

In the bend-open package 10A described above, the entire periphery 40*b* of the sealant 40 covering the cut 23 in the sheet member 20, which forms the lid 13, is embedded in the surface of the sheet member 20 in the thickness direction T. The bend-open package 10A thus has an increased press-bonded area achieved by the embedded portion.

This embedding enables the periphery 40*b* of the sealant 40 to be more firmly press-bonded to the sheet member 20. Additionally, a fingertip touching the bond between the sheet member 20 and the press-bonded sealant 40 can receive smooth feel without being caught on the periphery 40*b* of the sealant 40.

Moreover, bend-open packages 10A may touch or abut each other when, for example, the packages are conveyed or transported. In such a case, a part of a bend-open package 10A is reliably prevented from touching or abutting the periphery 40*b* of the sealant 40 embedded in the sheet member 20 in an adjacent bend-open package 10A. The sealant 40 is reliably prevented from peeling or curling.

In addition, the sealant 40 has a thin part in which the depression 41 and the projection 42 are formed, and the thin part of the sealant 40 continuously ruptures when the bend-open package 10A is bent. The small rupture resistance to the rupture for opening the sealant 40 allows easy and reliable rupture and opening of the sealant 40 covering the cut 23 in the sheet member 20.

A method for dispensing content C from the bend-open package 10A will now be described.

First, the bend-open package 10A is held with the lid 13 of the package body 11 facing downward, and then starts being folded into two in a bending direction G.

When the bend portion 21 of the sheet member 20 is bent to the predetermined bend angle θ1 or less, the cut 23 in the bend portion 21 penetrates in the thickness direction T and the sealant 40 press-bonded to the opening area 22 of the bend portion 21 can rupture to open (refer to FIG. 3(*a*)).

The resultant cut 23 in the sheet member 20 connects to the container 14 of the body 12. Thus, the bend-open package 10A is bent to squeeze content C stored in the container 14 through the cut 23 (refer to FIGS. 3(*b*) and 4).

When the bend portion 21 of the sheet member 20 is folded into two, a tongue 23*a* of the cut 23 extends obliquely downward, and the content C that has been squeezed out flows along the tongue 23*a*. Thus, the content C stored in the container 14 is less likely to be squeezed out in a large amount at a time, and is prevented from splattering (refer to FIGS. 3(*b*) and 4).

In this manner, the sealant 40 is prevented from unsealing until the bend-open package 10A is bent to the predetermined bend angle θ1 or less. This prevents leakage of content C stored in the container 14 and reliably maintains the sealing of the sealant 40.

A method for manufacturing a sheet base 200 used for the sheet member 20 of the bend-open package 10A and a method for manufacturing the bend-open package 10A using the sheet base 200 to which the sealant 40 is press-bonded will now be described.

Figure 5:
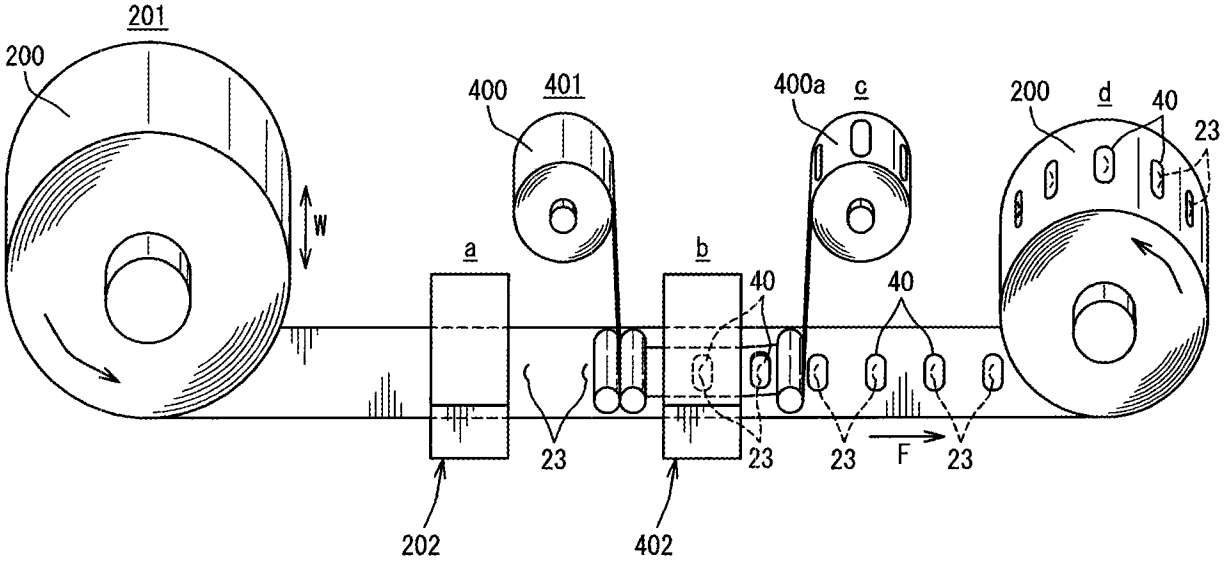
FIG. 5 is a diagram describing a method for manufacturing a sheet base used for a sheet member of the bend-open package.
Figure 6:
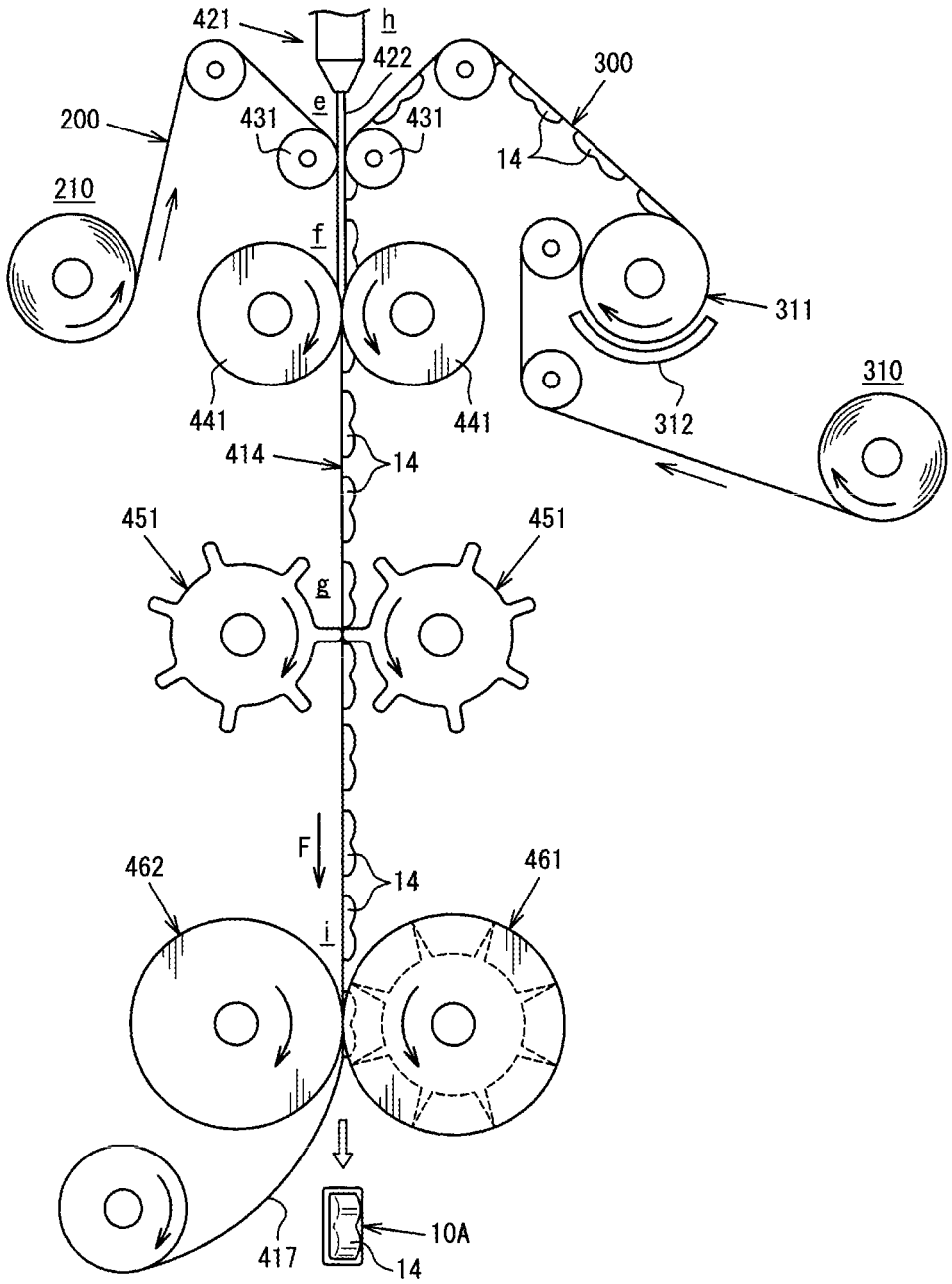
FIG. 6 is a diagram describing a method for manufacturing the bend-open package.

FIG. 5 is a diagram describing the method for manufacturing the sheet base 200 used for the sheet member 20 of the bend-open package 10A. FIG. 6 is a diagram describing the method for manufacturing the bend-open package 10A.

Figure 7:
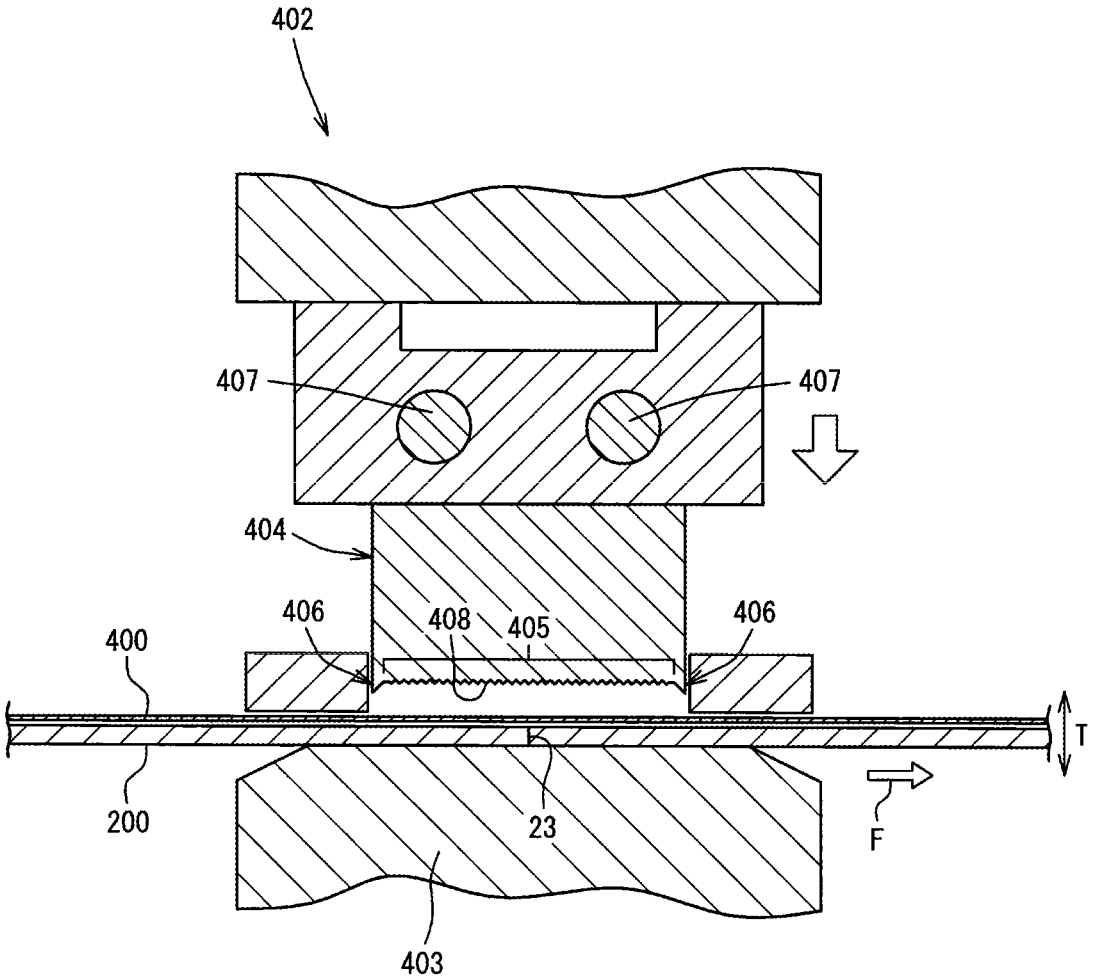
FIG. 7 is a cross-sectional view of a press-cutting/press-bonding machine.
Figure 8:
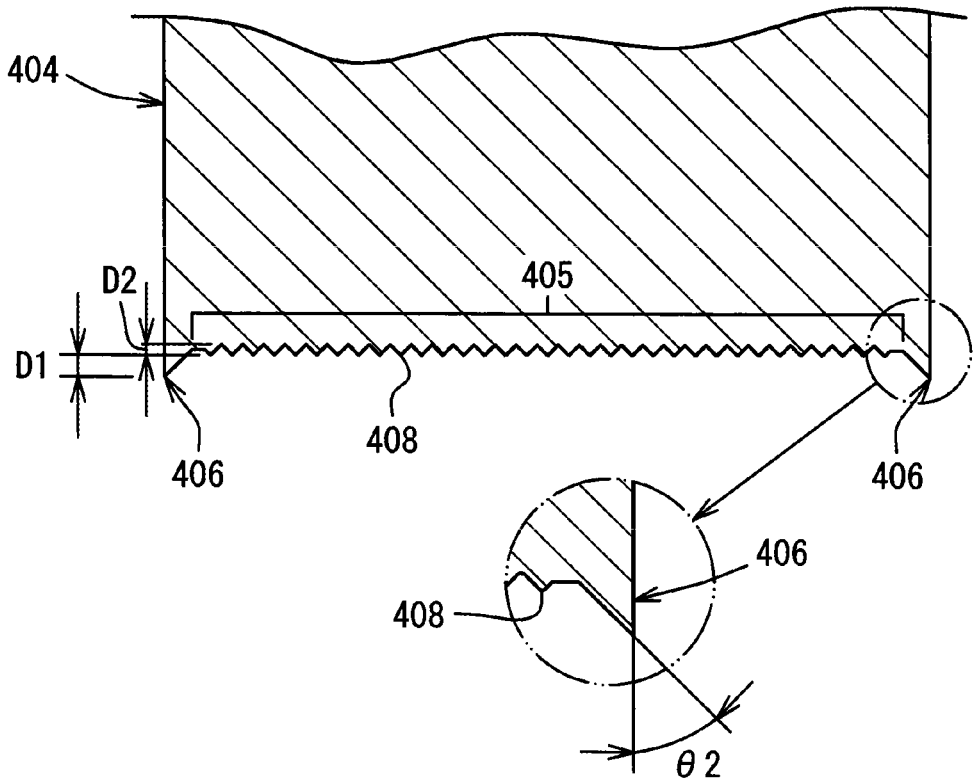
FIG. 8 is an enlarged cross-sectional view of a sealant press-cutting unit.
Figure 9:
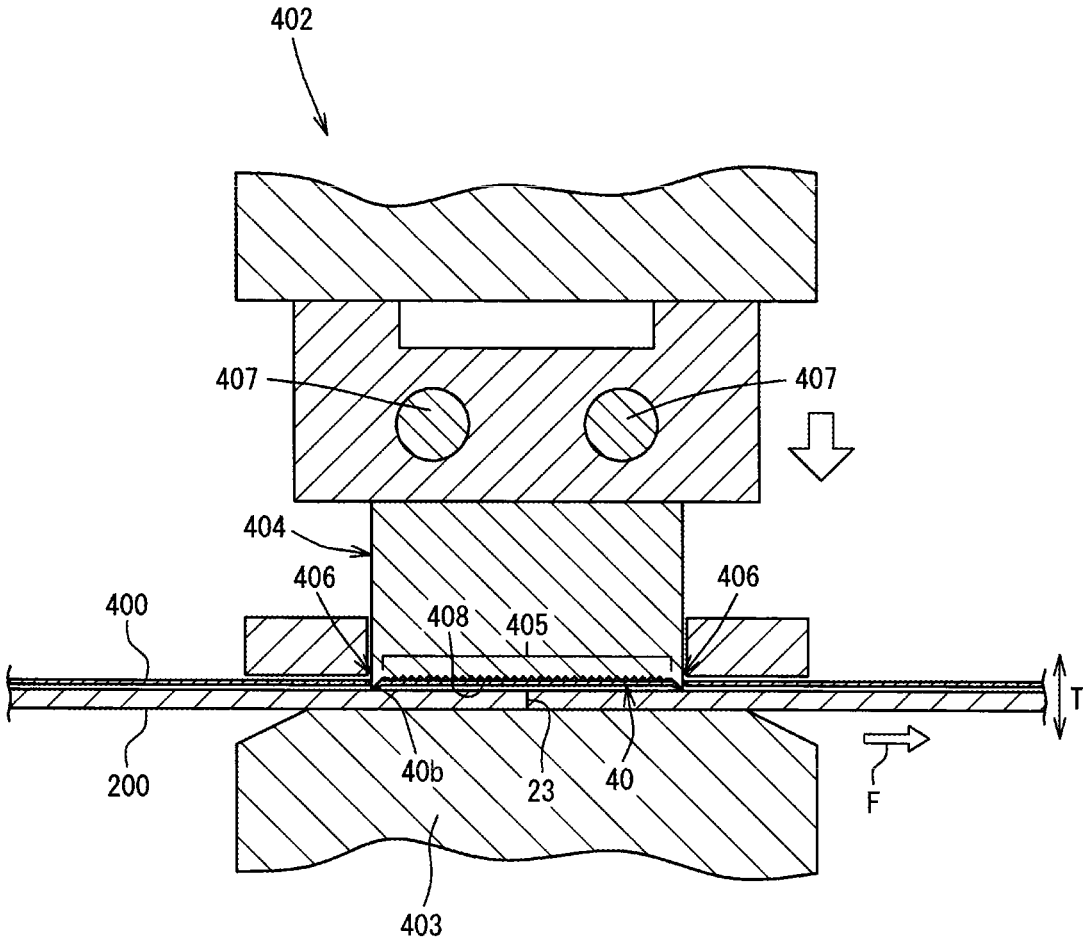
FIG. 9 is a cross-sectional view of the press-cutting/press-bonding machine that has press-cut a sealant base.
Figure 10:
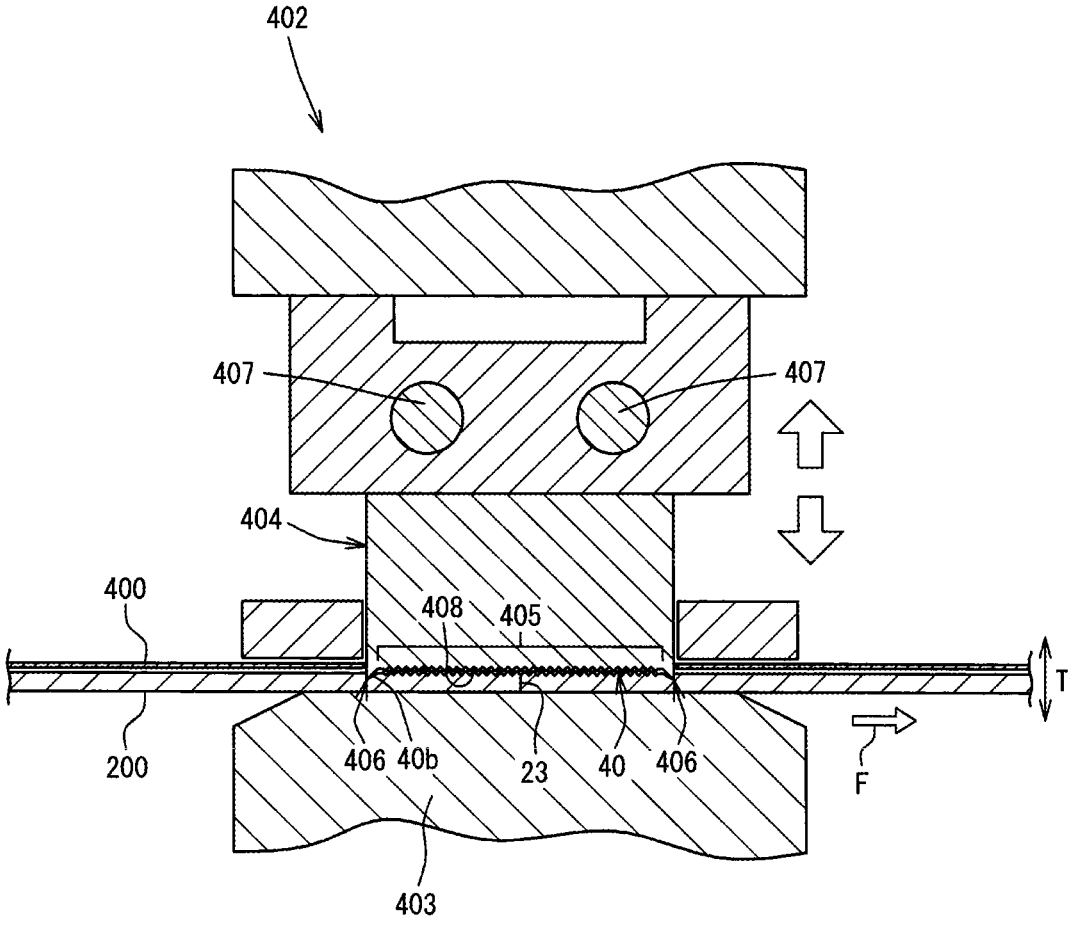
FIG. 10 is a cross-sectional view of the press-cutting/press-bonding machine that press-bonds a sealant to the sheet base.

FIG. 7 is a cross-sectional view of a press-cutting/press-bonding machine 402. FIG. 8 is an enlarged cross-sectional view of a sealant press-cutting unit 404. FIG. 9 is a cross-sectional view of the press-cutting/press-bonding machine 402 that has press-cut a sealant base 400. FIG. 10 is a cross-sectional view of the press-cutting/press-bonding machine 402 that press-bonds a sealant 40 to the sheet base 200.

Figure 11A:
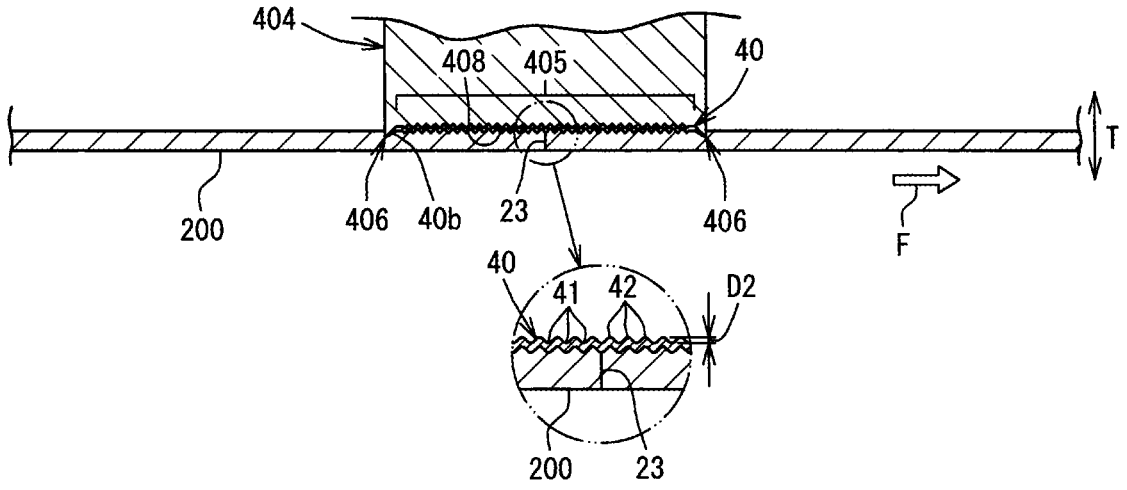
FIGS. 11(*a*) and 11(*b*) show the sealant press-cutting unit that press-bonds a sealant to the sheet base.
Figure 11B:
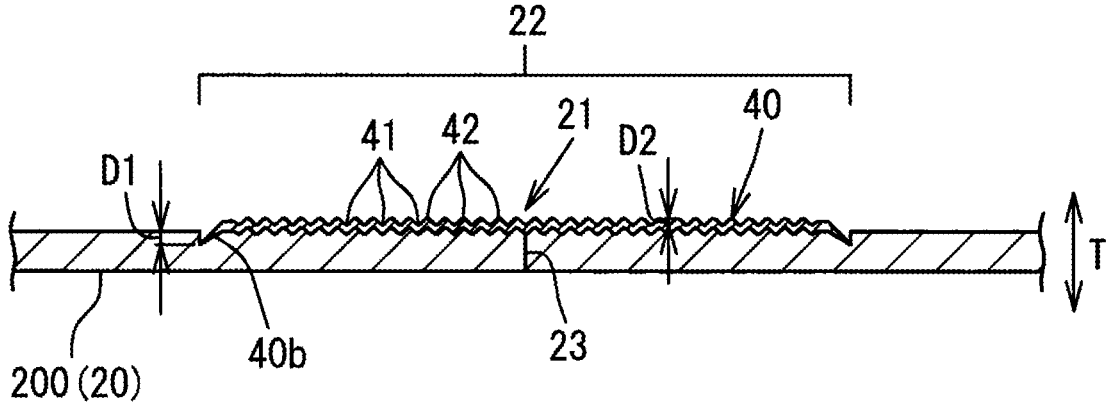

FIG. 11 is a diagram describing the sealant press-cutting unit 404 that press-bonds the sealant 40 to the sheet base 200. More specifically, FIG. 11(*a*) is an enlarged cross-sectional view of a sealant pressing part 405 in which the sealant 40 is press-bonded to the sheet base 200, and FIG. 11(*b*) is an enlarged cross-sectional view of the sheet base 200 to which the sealant 40 is press-bonded.

The method for manufacturing the sheet base 200 to which the sealants 40 are press-bonded includes a cut forming step (a) for forming cuts 23 in the surface of the synthetic resin sheet base 200 in a strip. The method also includes a sealant press-cutting/press-bonding step (b) for press-cutting the aluminum foil sealant base 400 in a strip into the sealants 40 sized and shaped to cover the cuts 23 in the sheet base 200, and press-bonding the sealants 40 press-cut from the sealant base 400 to the surface of the sheet base 200 to cover the cuts 23. The method further includes a base recovery step (c) for recovering a base waste 400*a* generated by separating the sealants 40 by winding it in a roll, and a base winding step (d) for winding the sheet base 200 to which the sealants 40 are press-bonded in a roll. These steps are performed in this order (refer to FIG. 5).

In the cut forming step (a), the sheet base 200 being unwound from a sheet holder 201 in a strip is fed at a constant speed in a feeding direction F toward a cutter 202. The cutter 202 forms slit cuts 23 in the middle of the sheet base 200 in the transverse direction W and at predetermined intervals in the longitudinal direction L of the sheet base 200 (refer to FIG. 5).

In the sealant press-cutting/press-bonding step (b), the sealant base 400 being unwound from a sealant holder 401 in a strip is overlaid on a middle portion of the surface of the sheet base 200 in the transverse direction W to cover the cuts 23, and the sealant base 400 is fed in the feeding direction F to the press-cutting/press-bonding machine 402 at a constant speed in synchronization with the feeding speed of the sheet base 200 (refer to FIG. 5).

The sealant base 400 has a width smaller than the width of the sheet base 200 in the transverse direction W to cover the cuts 23.

The press-cutting/press-bonding machine 402 includes a sheet mount 403 that is substantially trapezoidal in cross section and supports the sheet base 200 in a substantially horizontal position, and the sealant press-cutting unit 404 that press-cuts the sealant base 400 into a size and a shape to cover a cut 23 (refer to FIG. 7).

The sheet mount 403 is located under the position at which the sealant base 400 overlaid on the sheet base 200 is press-cut. The sealant press-cutting unit 404 is located above the position at which the sealant base 400 is press-cut, and faces the sealant base 400 overlaid on the sheet base 200 supported on the sheet mount 403 (refer to FIG. 7).

The sheet mount 403 is formed to substantially horizontally support the sheet base 200 on which the sealant base 400 is overlaid. The sealant press-cutting unit 404 is formed to press-cut the sealant base 400 overlaid on the sheet base 200 into sealants each sized and shaped to cover a cut 23 (refer to FIG. 7).

The sealant press-cutting unit 404 includes the sealant pressing part 405 that press-bonds the sealants 40 separated from the sealant base 400 to the middle surface portion of the sheet base 200 in the transverse direction W, a press-cutting section 406 that press-cuts the sealant base 400 into a size and a shape to cover a cut 23 in the sheet base 200, and a heater 407 that heats the sealant press-cutting unit 404 (refer to FIG. 7).

The entire sealant press-cutting unit 404 is vertically movable by a drive unit (not shown). The downward movement in the drawing presses the sealant base 400 against the sheet base 200, whereas the upward movement in the drawing releases the pressing of the sealant base 400 from the sheet base 200.

The sealant press-cutting unit 404 reciprocates between a press-bonding position indicated by solid lines in FIG. 10 and a standby position indicated by solid lines in FIG. 7. At the press-bonding position, the sealant press-cutting unit 404 press-cuts the sealant base 400 into a sealant 40 sized and shaped to cover a cut 23, and press-bonds the sealant 40 press-cut from the sealant base 400 to the surface of the sheet base 200 to cover the cut 23. At the standby position, the sealant base 400 is yet to be press-cut.

The sealant pressing part 405 has a pressing end middle area including a roughening section 408 that forms a large number of depressions 41 and projections 42 on the surface of the sealant 40. The working surface of the roughening section 408 is roughened in correspondence with the depressions 41 and the projections 42 to be formed on the sealant 40 (refer to FIG. 8).

The depressions 41 and the projections 42 are formed substantially uniformly over the surface surrounded by the periphery 40*b* of the sealant 40 when the sealant pressing part 405 of the sealant press-cutting unit 404 press-bonds the sealant 40 press-cut from the sealant base 400 to the surface of the sheet base 200 (refer to FIGS. 11(*a*) and 11(*b*)).

The press-cutting section 406 protrudes substantially vertically downward from the pressing end periphery of the sealant pressing part 405, and has an edge shape for press-cutting the sealant base 400 into a size and a shape to cover a cut 23 in the sheet base 200.

The press-cutting section 406 has a substantially triangle cross-section with an inner slope and an outer vertical plane meeting each other. The cutting edge has an embedding angle θ2 ranging from about 30 to 110 degrees. The roughened face of the roughening section 408 has a height difference D2 corresponding to the difference between the depressions 41 and the projections 42 to be formed on the sealant 40 (refer to FIG. 8).

Manufacturing the sheet base 200 to which the sealants 40 are press-bonded includes a cut forming step (a) for forming, with the cutter 202, cuts 23 in the surface of the sheet base 200, and feeding the sheet base 200 in the feeding direction F with the sealant base 400 being overlaid on the surface of the sheet base 200 to cover the cuts 23. The sheet base 200 is then transferred to the sealant press-cutting/press-bonding step (b) (refer to FIGS. 5 and 7).

In the sealant press-cutting/press-bonding step (b), the sealant press-cutting unit 404 in the press-cutting/press-bonding machine 402 is moved in the direction for press-cutting the sealant base 400, and the press-cutting section 406 press-cuts the sealant base 400 overlaid on the sheet base 200 into a sealant 40 sized and shaped to cover a cut 23 (refer to FIG. 9).

The sealant 40 press-cut from the sealant base 400 is press-bonded by the sealant pressing part 405 to the surface of the sheet base 200 to cover the cut 23. More specifically, a pressure of about 500 kg/cm$^2$ is applied to the sealant 40 for about 0.1 seconds while being heated at about 200° C. by the heater 407 (refer to FIG. 10).

The press-bonding may not include the heating by the heater 407.

The roughening section 408 in the sealant pressing part 405 vertically presses the surface surrounded by the periphery 40*b* of the sealant 40 in the thickness direction T. The pressing forms a large number of depressions 41 and projections 42 substantially uniformly over the surface surrounded by the periphery 40*b* of the sealant 40.

The entire periphery 40*b* of the sealant 40 is embedded in the surface of the sheet base 200 in the thickness direction T by a predetermined depth D1 by the press-cutting section 406 in the sealant pressing part 405 (refer to FIGS. 11(*a*) and 11(*b*)).

This process enables the continuous manufacture of the sheet base 200 to which the sealants 40 are press-bonded, which is to be used for the sheet members 20 in bend-open packages 10A.

The base waste 400*a* generated by separating the sealants 40 is recovered in the base recovery step (c) by winding it in a roll, whereas the sheet base 200 to which the sealants 40 are press-bonded is recovered in the base winding step (d) by winding it in a roll (refer to FIG. 5).

A method for manufacturing bend-open packages 10A using the sheet base 200 to which the sealants 40 are press-bonded will now be described.

The method for manufacturing the bend-open packages 10A includes a combining step (e) for combining a film base 300 supporting pouch-like containers 14 and the sheet base 200 to which the sealants 40 are press-bonded while vertically feeding them in the feeding direction F. The method also includes a longitudinally sealing step (f) for heat-sealing the bases 200 and 300 in the longitudinal direction L at their both edges, and a transversely sealing step (g) for heat-sealing the bases 200 and 300 in the transverse direction W at their overlaps above and under each container 14. The method further includes a filling step (h) for filling a longitudinally and transversely sealed tubular package 414 with content C, and a dividing step (i) for separating the tubular package 414 filled with a predetermined dose of content C into individual bend-open packages 10A. These steps are performed in this order (refer to FIG. 6).

The sheet base 200 to which the sealants 40 are press-bonded is wound in a roll around and held on the sheet holder 210. The film base 300 yet to include the containers 14 is wound in a roll around and held on a film holder 310.

When the film base 300 is unwound from the film holder 310, the film base 300 is wound around a forming drum 311. The film base 300 wound around the forming drum 311 is heated by a heater 312 to soften the film base 300 and sequentially form the containers 14 as pouches on the inner surface wound around the film holder 310 (refer to FIG. 6).

In the combining step (e), the side of the film base 300 unwound from the film holder 310 opposite to the containers 14 and the side of the sheet base 200 unwound from the sheet holder 210 opposite to the press-bonded sealants 40 are combined with each other. The combined bases are vertically fed in the feeding direction F by a pair of feeding rolls 431 and transferred to the longitudinally sealing step (f) (refer to FIG. 6).

In the longitudinally sealing step (f), while the bases 200 and 300 are being vertically fed in the feeding direction F by a pair of longitudinally sealing rolls 441, both longitudinal edges of the bases 200 and 300 are sealed outside the containers 14. The resultant tubular package 414 is transferred to the transversely sealing step (g) (refer to FIG. 6).

In the transversely sealing step (g), while the tubular package 414 is being vertically fed in the feeding direction F by a pair of transversely sealing rolls 451, the transverse overlaps of the tubular package 414 that are above and under each container 14 are sealed. The resultant tubular package 414 is transferred to the dividing step (i).

In the filling step (h), the tubular package 414 is filled from above with content C supplied through a filling tube 422 included in a filling device 421 (refer to FIG. 6).

In the dividing step (i), while the tubular package 414 is being vertically fed in the feeding direction F by a rotary blade 461 and a support roll 462, the longitudinal sealed areas and the transverse sealed areas of the tubular package 414 are cut in the transverse direction W. As a result, the tubular package 414 that is continuous in the longitudinal direction L is separated into individual bend-open packages 10A each filled with a predetermined dose of content C (refer to FIG. 6).

This manufacturing method thus enables the continuous manufacture of many bend-open packages 10A.

A package waste 417 generated by separating the bend-open packages 10A from the tubular package 414 is recovered by winding it in a roll.

Moreover, the bend-open packages 10A are manufactured more efficiently by separating the sheet base 200 to which the sealants 40 are press-bonded into a size and a shape corresponding to the sheet member 20 included in the lid 13 of each package body 11, and separating the film base 300 into a size and a shape corresponding to the body 12 of the package body 11.

In manufacturing the sheet members 20, each sealant 40 is overlaid on the surface of the sheet base 200 yet to be separated into the sheet members 20 to cover the corresponding cut 23, and the sealant 40 is pressed against the surface of the sheet base 200 in the thickness direction T by the sealant pressing part 405 and the roughening section 408 in the sealant press-cutting unit 404.

The entire sealant 40 pressed by the sealant pressing part 405 has a smaller thickness, and the area in which the depressions 41 and the projections 42 are formed by the roughening section 408 also has a smaller thickness.

Thus, bending the bend-open package 10A ruptures the sealant 40 to open with smaller rupture resistance, and the sealant 40 covering the cut 23 in the sheet member 20 can rupture to open more easily and reliably.

Additionally, the sealant 40 deformed to have depressions and projections provides a larger press-bonded area between the sealant 40 and the sheet base 200 than the area achieved by press-bonding the sealant 40 to the surface of the sheet base 200 in a flat manner. Thus, the sealant 40 can be more firmly press-bonded to the surface of the sheet base 200.

More specifically, the depressions 41 and the projections 42 substantially uniformly formed on the surface of the sealant 40 provide substantially uniform press-bonding. The reliable press-bonding of the entire sealant 40 to the surface of the sheet base 200 can be visually observed.

Additionally, instead of adhering the sealant 40 to the sheet base 200 using an agent such as glue or adhesive, the sealant pressing part 405 press-bonds the sealant 40 more reliably to the surface of the sheet base 200 to cover the cut 23.

Other examples of the bend-open package 10A will now be described. The same or corresponding components herein are given the same reference numerals, and will not be described in detail.

Second Embodiment

In the first embodiment described above, the periphery 40*b* of the sealant 40 is embedded in the surface of the sheet base 200 by the press-cutting section 406. In a second embodiment, a press-cutting section 416 press-bonds a sealant 40 to the surface of the sheet base 200 to be substantially flush with the sheet base 200 as shown in FIG. 12.

Figure 12:
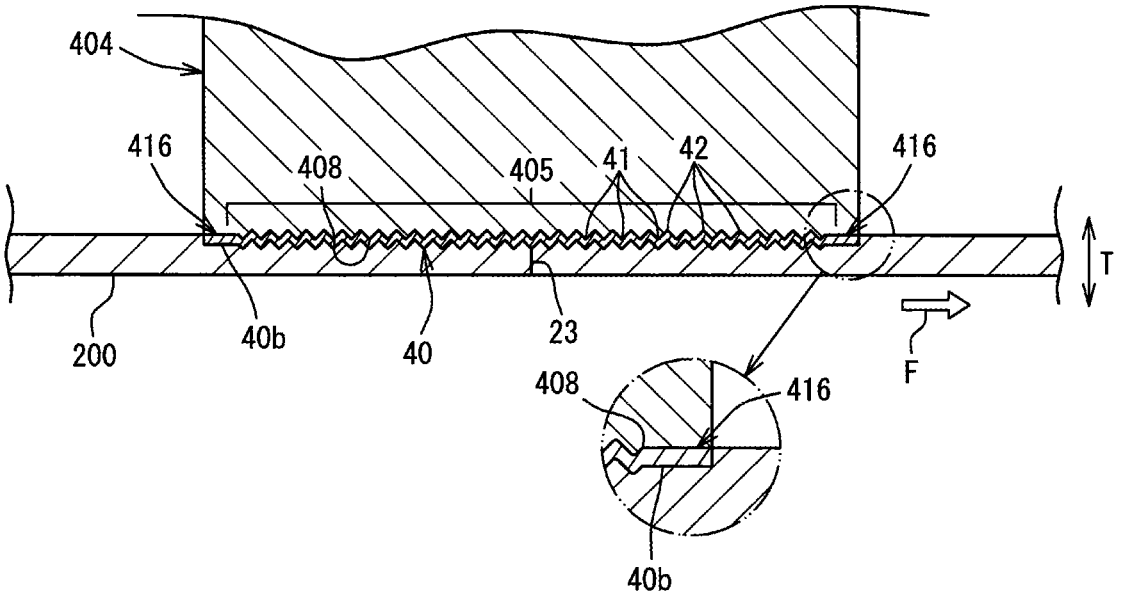
FIG. 12 is an enlarged cross-sectional view of another example showing press-bonding according to a second embodiment.

FIG. 12 is an enlarged cross-sectional view of another example showing press-bonding according to the second embodiment.

The press-cutting section 416 is included in a sealant press-cutting unit 404 according to the second embodiment and shaped to press the periphery 40*b* of the sealant 40 substantially flat. When the sealant 40 press-cut from the sealant base 400 is press-bonded to the surface of the sheet base 200 by a sealant pressing part 405, a roughening section 408 forms depressions 41 and projections 42 on the surface of the sealant 40 and the press-cutting section 416 press-bonds the periphery 40*b* of the sealant 40 to the surface of the sheet base 200 to be substantially flush with the sheet base 200.

A fingertip touching the bond between the sheet base 200 and the press-bonded sealant 40 can receive smooth feel without being caught on the periphery 40*b* of the sealant 40. This embodiment thus has functions and effects additional to those in the first embodiment.

Third Embodiment

In the first embodiment described above, the press-cutting section 406 extends vertically downward. In a third embodiment, a press-cutting section 426 extends outward and obliquely downward, and a press-cutting section 436 extends vertically downward as shown in FIG. 13.

Figure 13A:
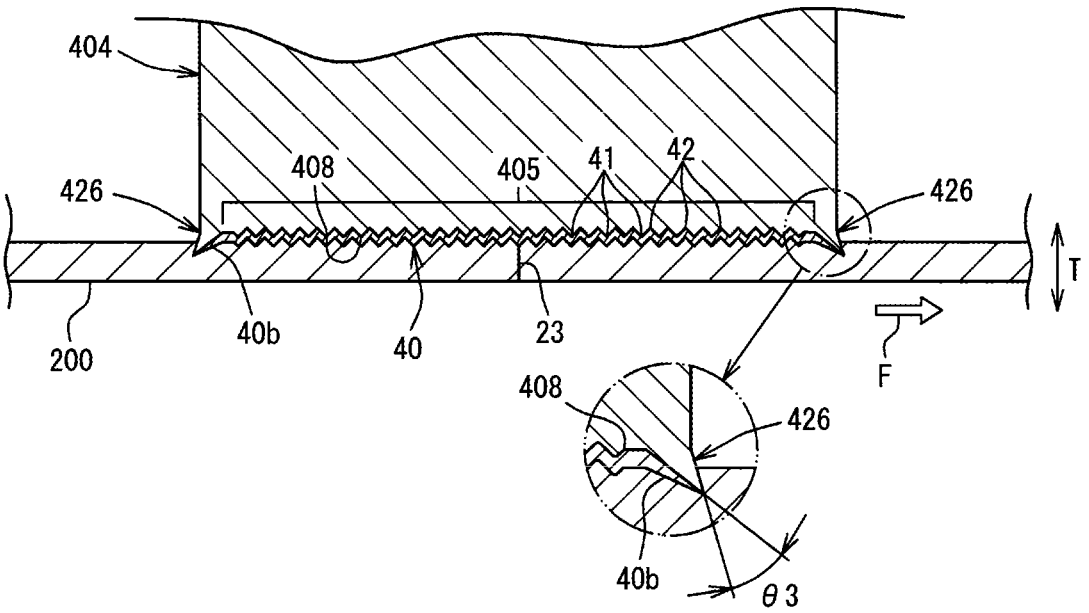
FIGS. 13(*a*) and 13(*b*) show still another example of press-bonding according to a third embodiment.
Figure 13B:
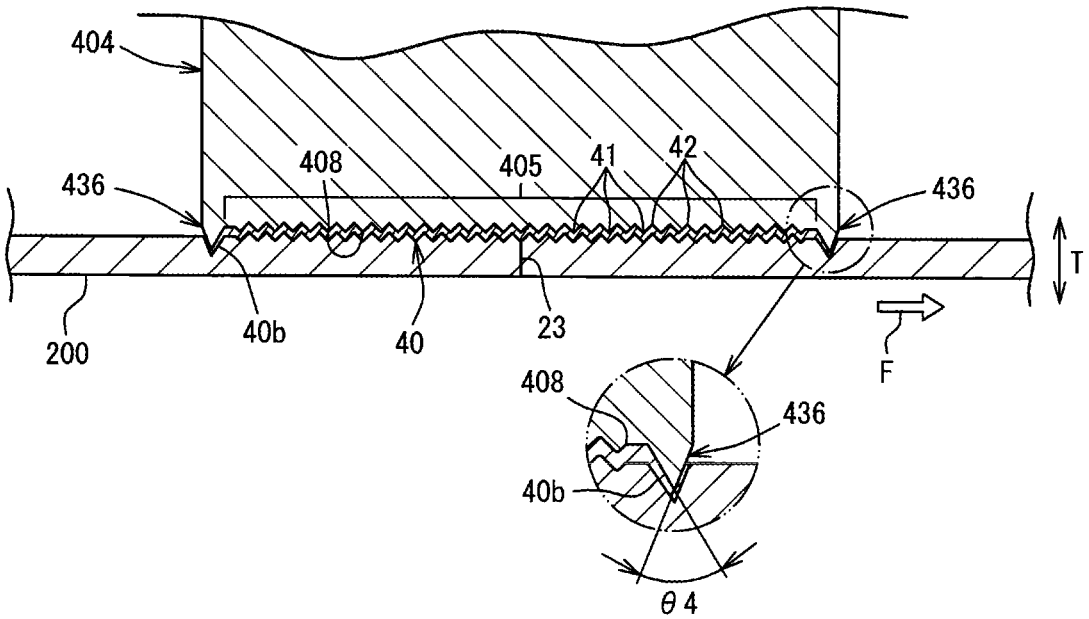

FIG. 13 is a diagram describing still another example of press-bonding according to the third embodiment. More specifically, FIG. 13(*a*) is an enlarged cross-sectional view of the sealant 40 showing its periphery 40*b* embedded in the sheet base 200 to extend outward in an obliquely downward direction. FIG. 13(*b*) is an enlarged cross-sectional view of the sealant 40 showing its periphery 40*b* embedded in the sheet base 200 to form an acute angle.

The press-cutting section 426 in FIG. 13(*a*) extends outward and obliquely downward, and includes a cutting edge with an angle θ3 smaller than the angle θ2 of the cutting edge of the press-cutting section 406 in the first embodiment (refer to the enlarged view in FIG. 13(*a*)).

The press-cutting section 426 deforms the periphery 40*b* of the sealant 40 acutely outward in obliquely downward directions that cross the thickness direction T. This embeds the periphery 40*b* of the sealant 40 more acutely and deeply in the surface of the sheet base 200. The periphery 40*b* of the sealant 40 can thus be more firmly press-bonded to the sheet base 200.

The press-cutting section 436 in FIG. 13(*b*) extends vertically downward, and includes a cutting edge with an angle θ4 larger than the angle θ2 of the cutting edge of the press-cutting section 406 (refer to the enlarged view in FIG. 13(*b*)).

The periphery 40*b* of the sealant 40 is embedded in the surface of the sheet base 200 by the press-cutting section 436 to form a substantially triangle cross-section with a pair of slopes meeting each other, and thus achieve a larger press-bonded area of the embedded part. The periphery 40*b* of the sealant 40 can thus be more firmly press-bonded to the sheet base 200.

Thus, this sealant 40 is prevented from unsealing until the bend-open package 10A is bent to the predetermined bend angle θ1 or less. This prevents leakage of content C stored in the container 14. This embodiment thus has functions and effects additional to those in the first embodiment.

Fourth Embodiment

In the first embodiment described above, the bend-open package 10A has the sealant 40 with its periphery 40*b* entirely embedded. In a fourth embodiment, a bend-open package 10A has a sealant 40 with its periphery 40*b* partially embedded as shown in FIG. 14.

Figure 14A:
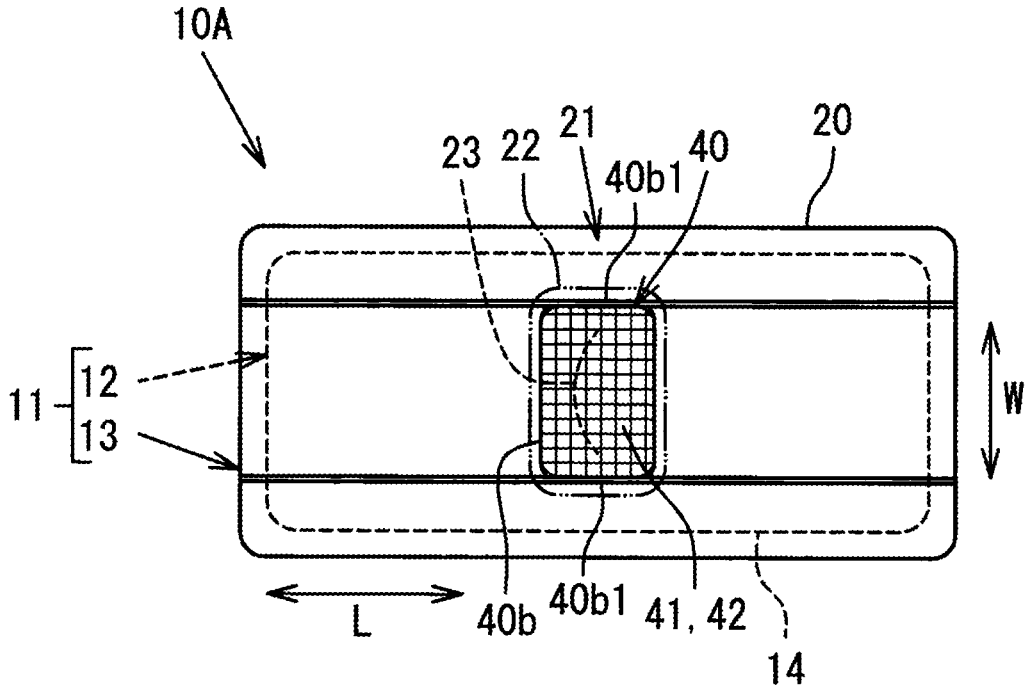
FIGS. 14(*a*) and 14(*b*) show a bend-open package according to a fourth embodiment.
Figure 14B:
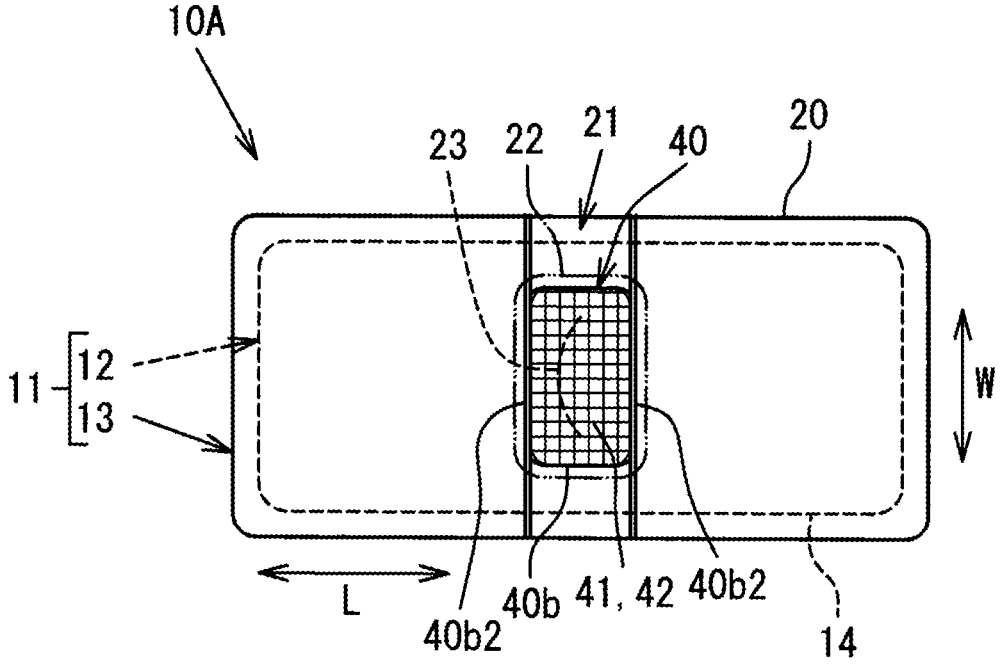

FIG. 14 is a diagram describing the bend-open package 10A according to the fourth embodiment. More specifically, FIG. 14(*a*) is a plan view of the bend-open package 10A with short-side edges 40*b*1 of the sealant 40 embedded in a sheet member 20, and FIG. 14(*b*) is a plan view of the bend-open package 10A with long-side edges 40*b*2 of the sealant 40 embedded in the sheet member 20.

In the bend-open package 10A according to the fourth embodiment, the periphery 40*b* of the sealant 40 has the pair of short-side edges 40*b*1 facing each other in the transverse direction W. The short-side edges 40*b*1 and extensions to the short-side edges 40*b*1 are embedded in the surface of the sheet member 20 (refer to FIG. 14(*a*)).

In some embodiments, the pair of long-side edges 40*b*2 of the periphery 40*b* of the sealant 40, which face each other in the longitudinal direction L, and extensions to the long-side edges 40*b*2 may be embedded in the surface of the sheet member 20 (refer to FIG. 14(*b*)).

Thus, the sealant 40 is prevented from unsealing until the bend-open package 10A is bent to the predetermined bend angle θ1 or less. This more reliably maintains the sealing of the sealant 40. This embodiment thus has functions and effects additional to those in the first embodiment.

Fifth Embodiment

In the first embodiment described above, the sealant 40 in the bend-open package 10A can rupture to open when bent. In a fifth embodiment, a sealant 40 in a bend-open package 10A is peeled to open when bent as shown in FIG. 15.

Figure 15A:
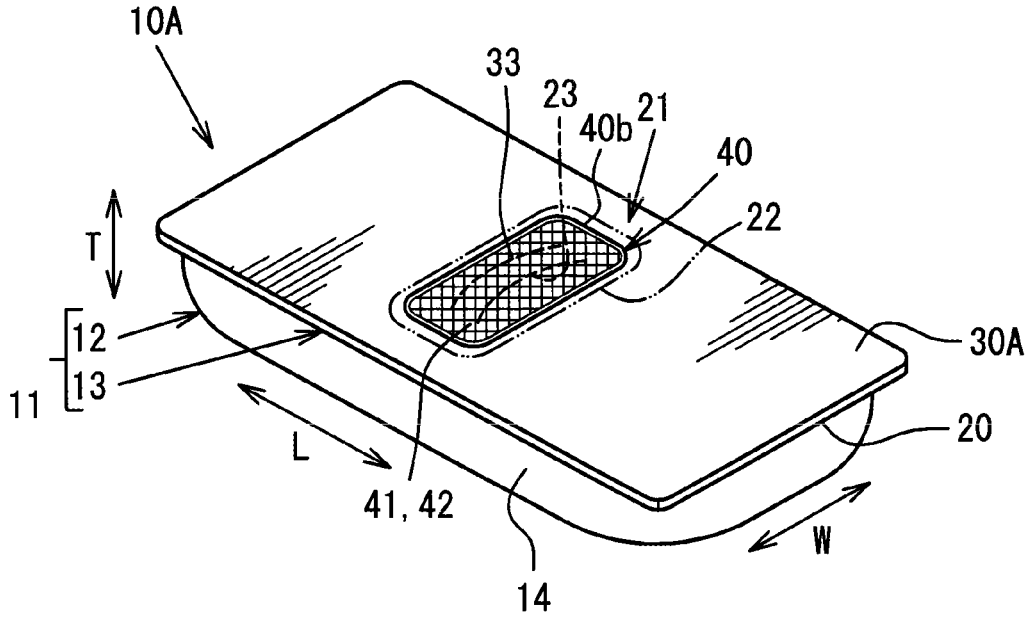
FIGS. 15(*a*) and 15(*b*) show a bend-open package according to a fifth embodiment.
Figure 15B:
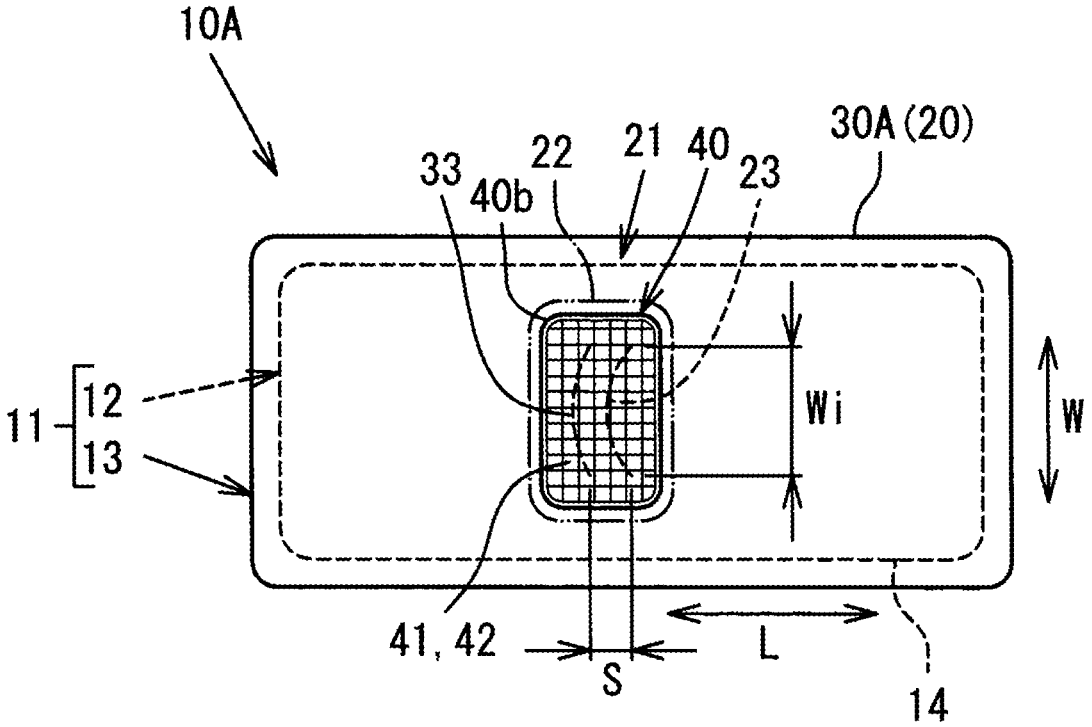

FIG. 15 is a diagram describing the bend-open package 10A according to the fifth embodiment. More specifically, FIG. 15(*a*) is a perspective view of the bend-open package 10A viewed from above, and FIG. 15(*b*) is a plan view of the bend-open package 10A showing its surface.

The bend-open package 10A in the fifth embodiment includes an adhesive layer having peelable adhesion that adheres a sheet member 20 and a film member 30A together. The adhesive layer adheres the opposite surfaces between a cut 23 in the sheet member 20 and a cut 33 formed in the film member 30A within the opening area 22. The sealant 40 having a large number of depressions 41 and projections 42 is press-bonded to the surface within the opening area 22 defined as a bend portion 21 for both the members 20 and 30A to cover the cuts 23 and 33.

When the bend-open package 10A in the fifth embodiment is bent, the area between the cuts 23 and 33 in the members 20 and 30 is peeled to open, and the sealant 40 also ruptures to open. The cuts 23 and 33 in the members 20 and 30 penetrate in the thickness direction T, and content C stored in the container 14 can be dispensed through the cuts 23 and 33.

Thus, the sealant 40 is prevented from unsealing until the bend-open package 10A is bent to the predetermined bend angle θ1 or less. This more reliably maintains the sealing of the cuts 23 and 33. This embodiment thus has functions and effects additional to those in the first embodiment.

Sixth Embodiment

In the first embodiment described above, the bend-open package 10A has the sealant 40 adhered to the sheet member 20. In a sixth embodiment, a bend-open package 10B has a sheet member 20B to which a sealant 40 is press-bonded, and the sheet member 20B is adhered to one film member 30B as shown in FIGS. 16 and 17.

Figure 16A:
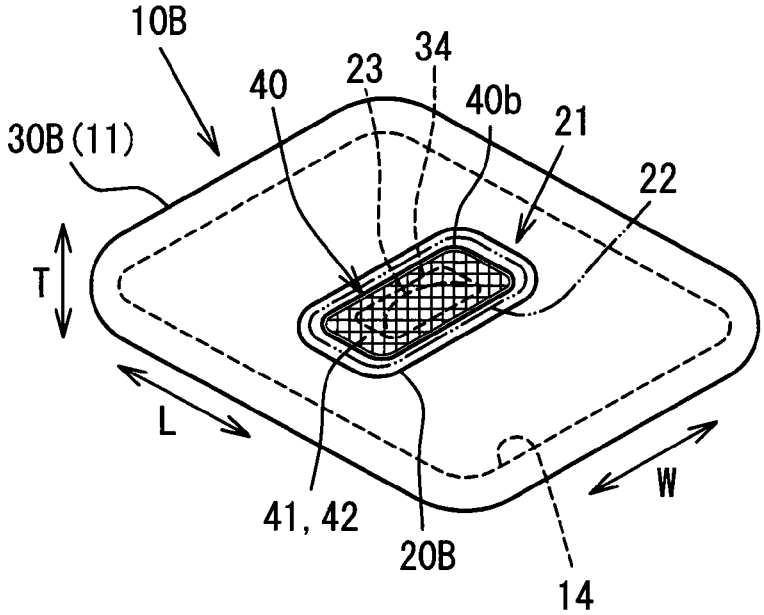
FIGS. 16(*a*) and 16(*b*) show a bend-open package according to a sixth embodiment.
Figure 16B:
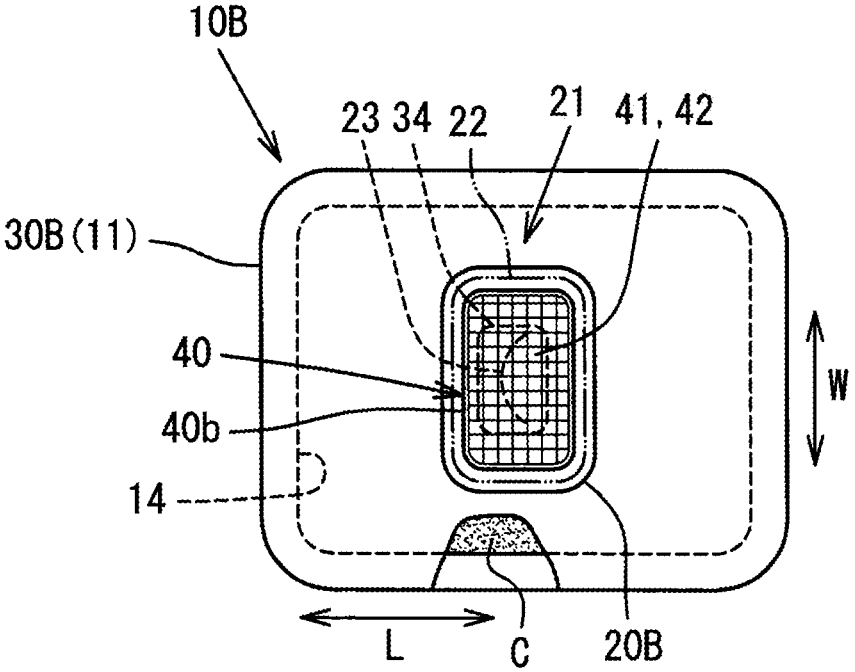

FIG. 16 is a diagram describing the bend-open package 10B according to the sixth embodiment. More specifically, FIG. 16(*a*) is a perspective view of the bend-open package 10B viewed from above, and FIG. 16(*b*) is a plan view of the bend-open package 10B showing its surface.

Figure 17A:
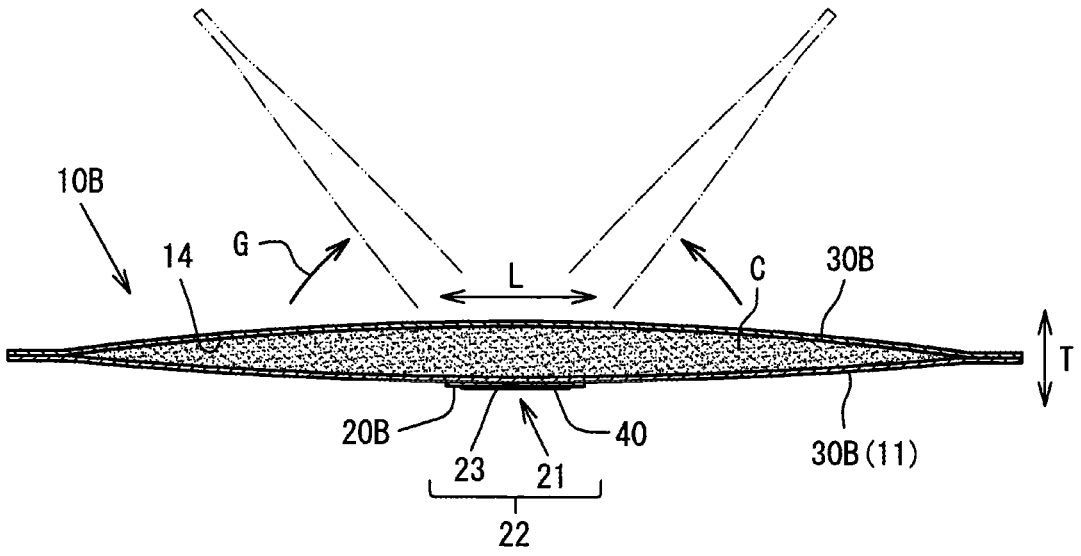
FIGS. 17(*a*) and 17(*b*) show dispensing of content from the bend-open package shown in FIG. 16.
Figure 17B:
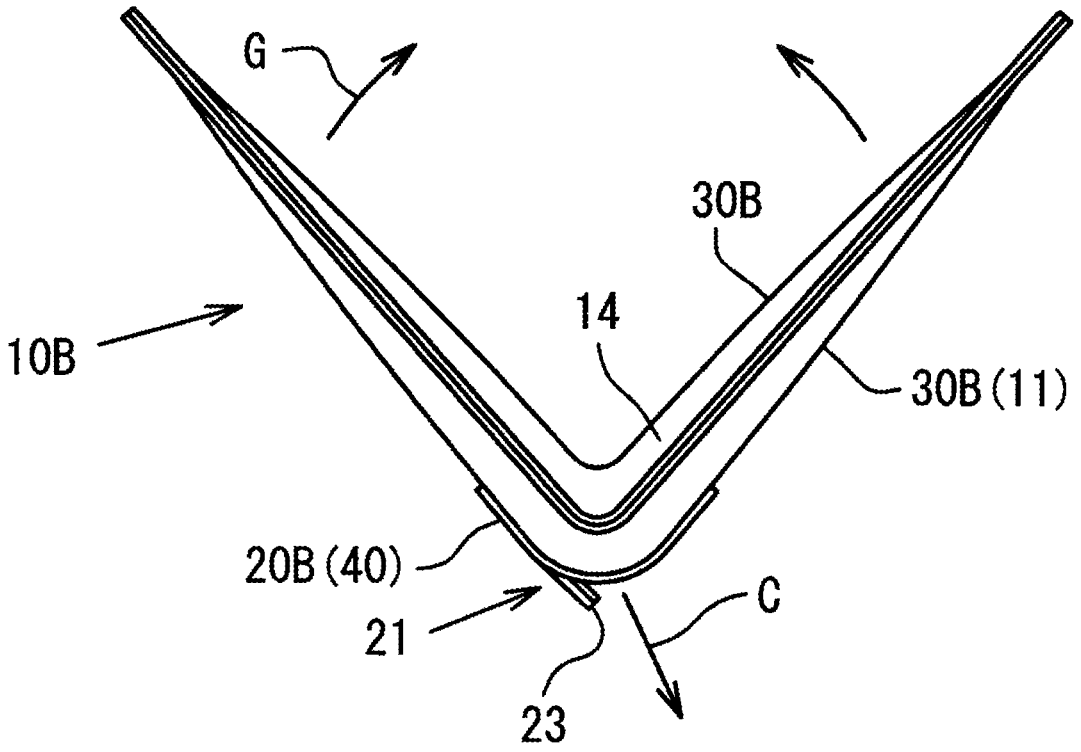

FIG. 17 is a diagram describing dispensing of content C from the bend-open package 10B shown in FIG. 16. More specifically, FIG. 17(*a*) is a cross-sectional view of the bend-open package 10B yet to be bent, taken along the centerline perpendicular to the transverse direction W, and FIG. 17(*b*) is a side view of the bend-open package 10B showing dispensing of content C from the package 10B.

The bend-open package 10B in the sixth embodiment includes a package body 11 formed from two film members 30B having substantially the same size and shape with their peripheries adhered to each other.

One of the film members 30B has an opening 34 in its surface, and the sheet member 20B has a cut 23. The opening 34 and the cut 23 are aligned with each other, and then the sheet member 20B to which the press-bonded sealant 40 is press-bonded is adhered to the film member 30B.

The sealant 40 can rupture to open when the bend-open package 10B is bent in the sixth embodiment, and thus content C stored in the container 14 can be dispensed through the cut 23 and the opening 34.

Thus, this sealant 40 more reliably maintains the sealing until the sealant 40 can rupture to open when the bend-open package 10B is bent. This embodiment thus has functions and effects additional to those in the first embodiment.

Seventh Embodiment

In the sixth embodiment described above, the bend-open package 10B has the two film members 30B adhered to each other. In a seventh embodiment, a bend-open package 10C is formed from one film member 30C folded into two as shown in FIG. 18.

Figure 18A:
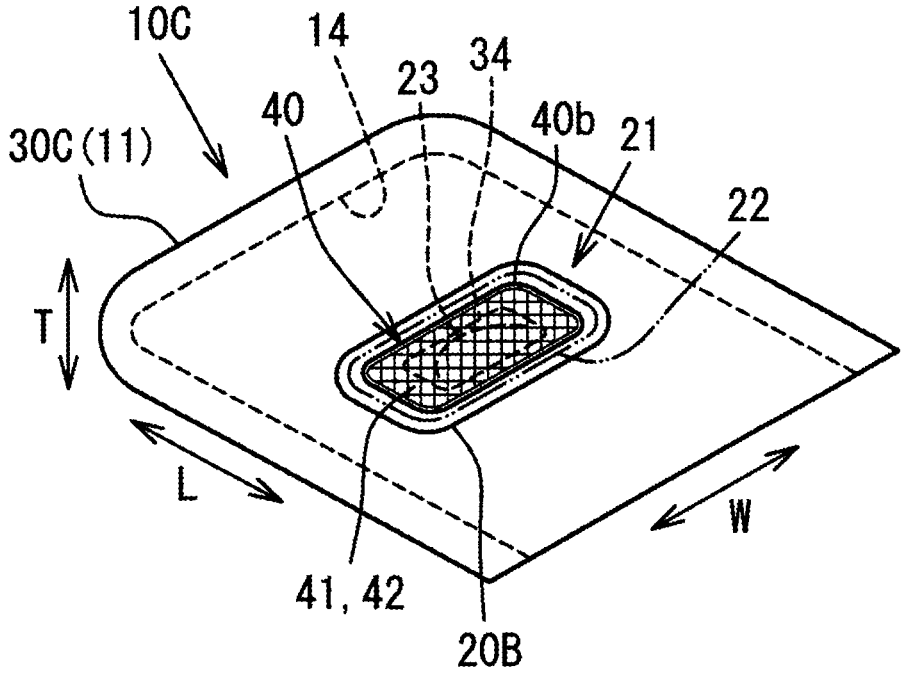
FIGS. 18(*a*) and 18(*b*) show a bend-open package according to a seventh embodiment.
Figure 18B:
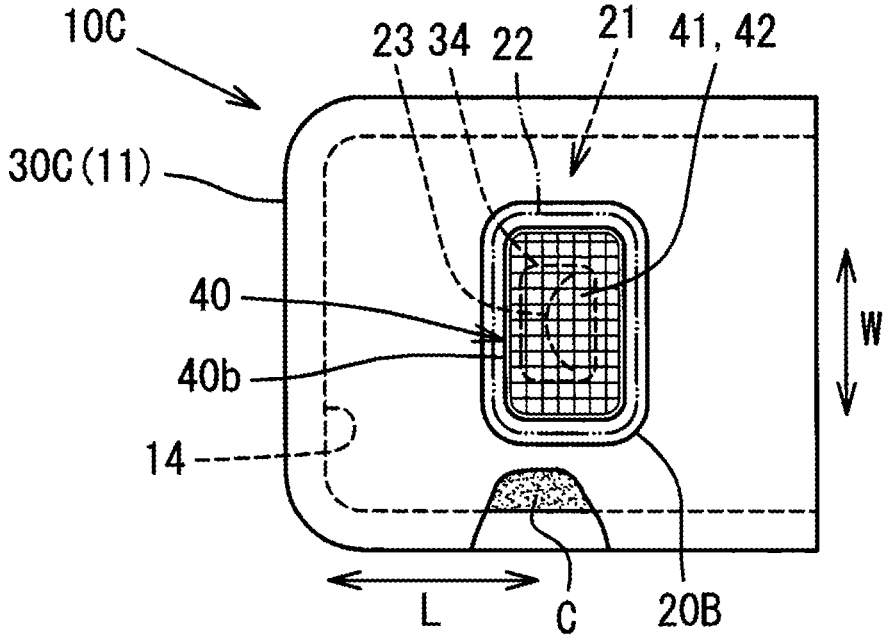

FIG. 18 is a diagram describing the bend-open package 10C according to the seventh embodiment. More specifically, FIG. 18(*a*) is a perspective view of the bend-open package 10C viewed from above, and FIG. 18(*b*) is a plan view of the bend-open package 10C showing its surface.

The bend-open package 10C in the seventh embodiment is formed by folding the film member 30C that is the package body 11 having substantially the same width as the two film members 30B. The film member 30C is folded into two along an imaginary bend line (not shown) that is the centerline in the transverse direction W, and the three corresponding facing edges are adhered to one another.

The film member 30C has an opening 34 in its one surface, and the sheet member 20B has a cut 23. The opening 34 and the cut 23 are aligned with each other, and then the sheet member 20B to which the sealant 40 is press-bonded is adhered to the film member 30C.

The sealant 40 can rupture to open when the bend-open package 10C is bent in the seventh embodiment, and thus content C stored in the container 14 can be dispensed through the cut 23 and the opening 34.

Thus, this sealant 40 more reliably maintains the sealing until the sealant 40 can rupture to open when the bend-open package 10C is bent. This embodiment thus has functions and effects additional to those in the first embodiment.

Eighth Embodiment

In the first to seventh embodiments described above, the bend-open packages 10A to 10C each have the sealant 40 with its periphery 40*b* embedded in and press-bonded to the surface of the sheet member 20 in the thickness direction T. In an eighth embodiment, a bend-open package 10D has a protrusion 24 protruding outwardly from the surface of a sheet member 20 and along the periphery 40*b* of a sealant 40 as shown in FIG. 19.

Figure 19A:
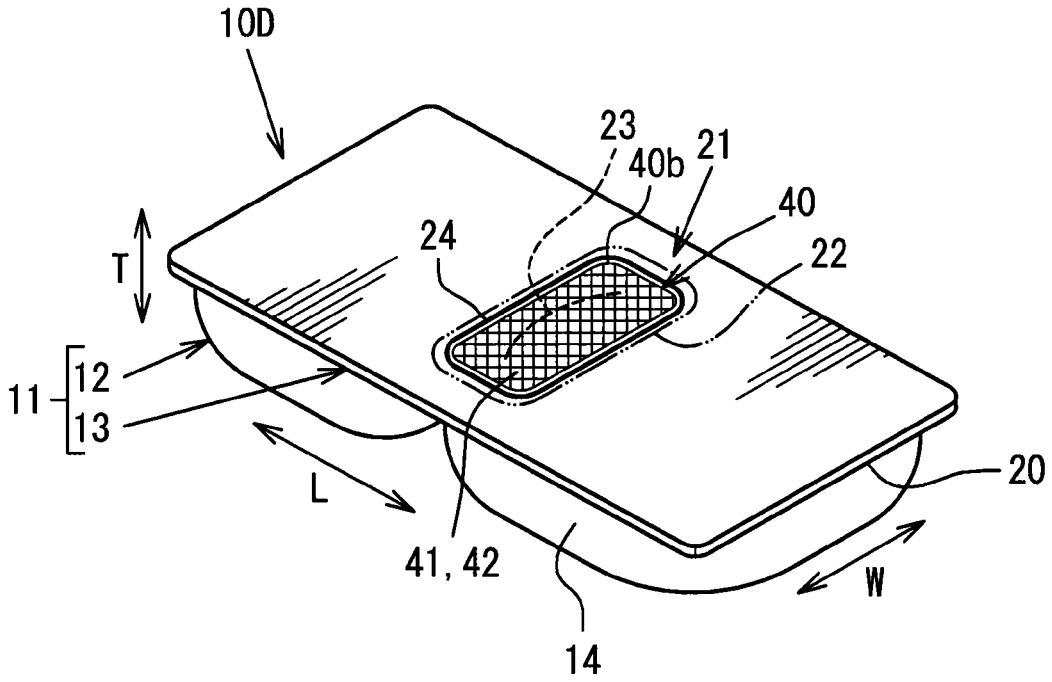
FIGS. 19(*a*) and 19(*b*) show perspective view of a bend-open package and enlarged cross-sectional view of a sheet base with a sealant that is press-bonded to it, respectively, according to an eighth embodiment.
Figure 19B:
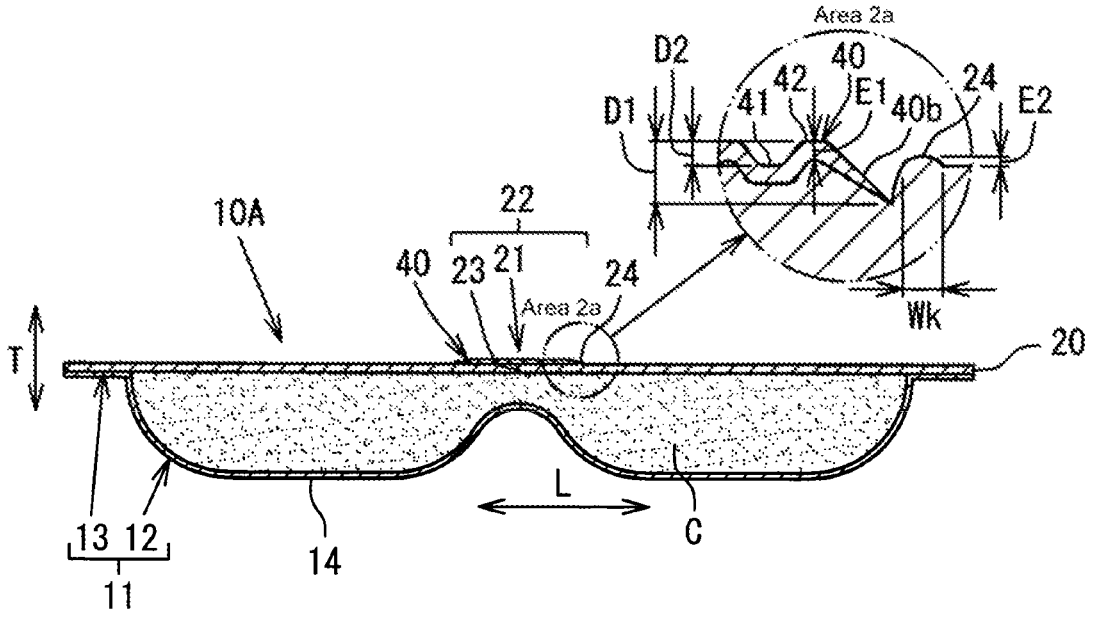

FIG. 19 is a diagram describing the bend-open package 10D according to the eighth embodiment. More specifically, FIG. 19(*a*) is a perspective view of the bend-open package 10D viewed from above, and FIG. 19(*b*) is a cross-sectional view of the bend-open package 10D taken along the centerline perpendicular to the transverse direction W.

Figure 20:
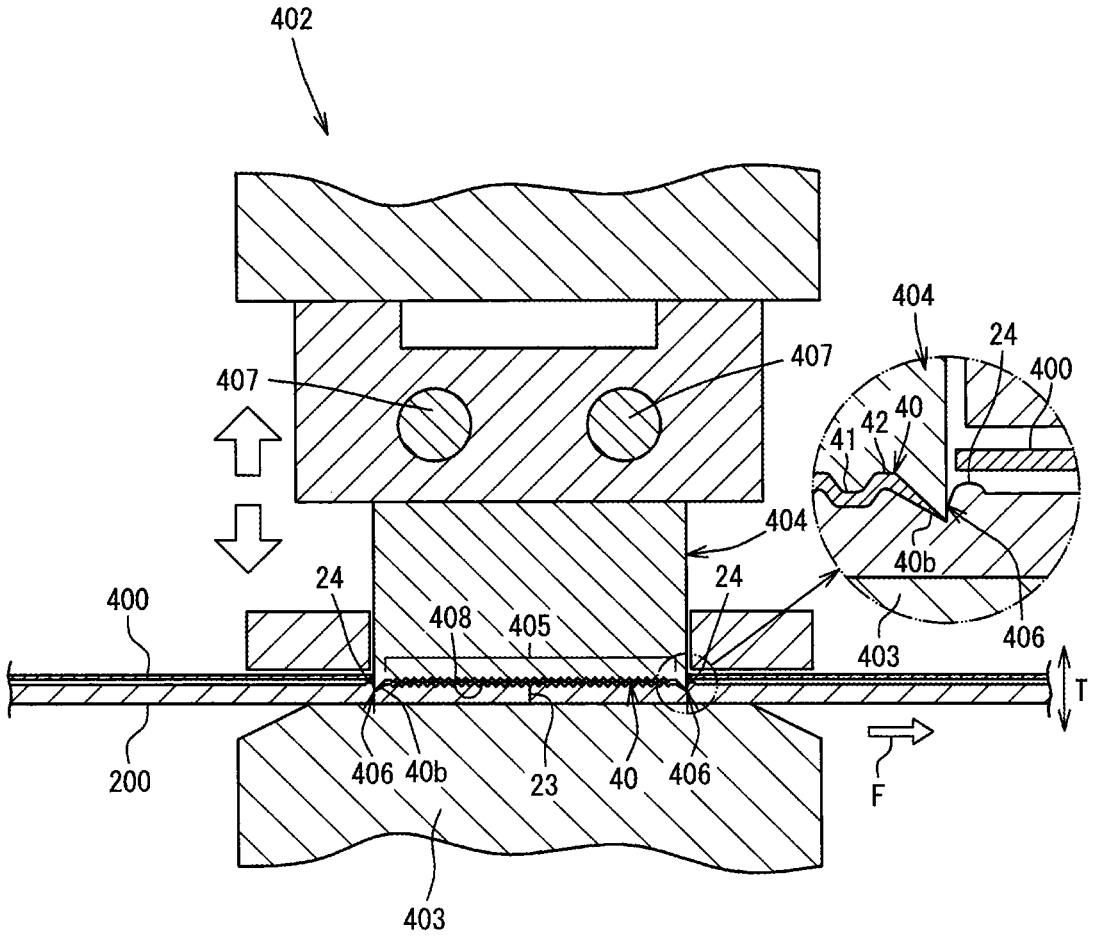
FIG. 20 is a cross-sectional view of a press-cutting/press-bonding machine that has press-bonded a sealant to the sheet base.
Figure 21A:
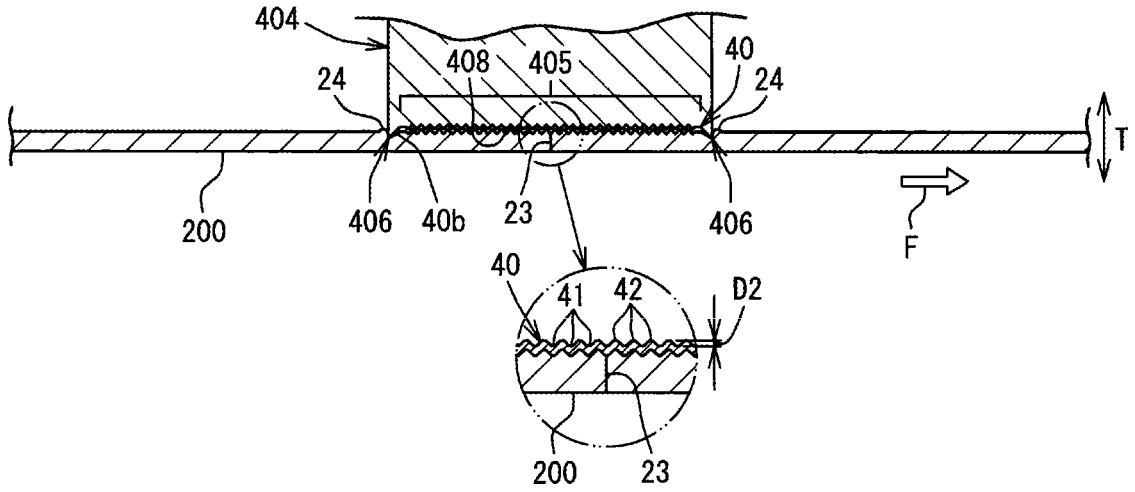
FIGS. 21(*a*) and 21(*b*) show a sealant press-cutting unit that press-bonds a sealant to the sheet base.
Figure 21B:
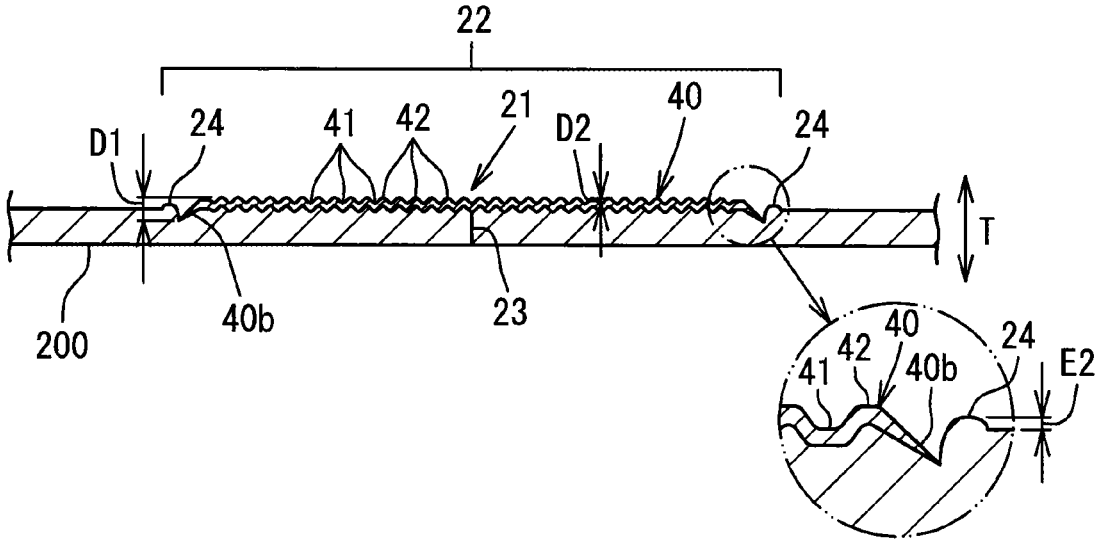

FIG. 20 is a cross-sectional view of a press-cutting/press-bonding machine 402 that press-bonds a sealant 40 to the sheet base 200. FIG. 21 is a diagram describing a sealant press-cutting unit 404 that press-bonds the sealant 40 to the sheet base 200. More specifically, FIG. 21(*a*) is an enlarged cross-sectional view of a sealant pressing part 405 in which the sealant 40 is press-bonded to the sheet base 200, and FIG. 21(*b*) is an enlarged cross-sectional view of the sheet base 200 to which the sealant 40 is press-bonded.

In the bend-open package 10D according to the eighth embodiment, the entire periphery 40*b* of the sealant 40 is embedded in and press-bonded to the surface of the sheet member 20 in the thickness direction T by a predetermined depth D1 to have an embedded portion having a depth gradually increasing from the middle toward the outer periphery of the sealant 40, and the press-bonded periphery 40*b* is buried under the surface of the sheet member 20 (refer to the enlarged view of area a2 shown in FIG. 19(*b*)).

The protrusion 24 that has substantially an arc cross-section and has a height smaller than the thickness E1 of the sealant 40 protruding outwardly from the surface of the sheet member 20 is formed on the surface within the opening area 22 of the sheet member 20 and along the periphery 40*b* of the sealant 40. The protrusion 24 is continuous along the entire periphery of the sealant 40 (refer to FIG. 19(*a*) and the enlarged view of area a2 shown in FIG. 19(*b*)).

The protrusion 24 has a width Wk of about 0.1 mm. The protrusion 24 has a smooth, curved outer surface that is gradually raised from the periphery of the sheet member 20 toward the periphery of the sealant 40 (refer to the enlarged view of area a2 shown in FIG. 19(*b*)).

The protrusion 24 has a height E2 equal to at least about 50% of the thickness E1 of the sealant 40. More specifically, the sealant 40 has a thickness of 0.02 mm (=20 μm), whereas the protrusion 24 has a height E2 of about 0.01 mm (=10 μm) (refer to the enlarged view of area a2 shown in FIG. 19(*b*)).

The height E2 of the protrusion 24, which is at least about 50% of the thickness E1 of the sealant 40, may be about 0.01 mm or more.

To manufacture the sheet base 200 to which the sealants 40 are press-bonded, which is to be used for the sheet member 20 of the bend-open package 10D according to the eighth embodiment, the sealant press-cutting unit 404 in the press-cutting/press-bonding machine 402 is lowered to cut each sealant 40 by press-cutting the sealant base 400 (refer to FIG. 20).

The entire periphery 40*b* of the sealant 40 press-cut from the sealant base 400 is embedded in the surface of the sheet base 200 in the thickness direction T by a press-cutting section 406. The sheet base 200 is heated to about 150° C. under pressure along the periphery 40*b* of the sealant 40, and the heated part deforms to protrude outwardly from the surface of the sheet base 200 (refer to the enlarged view in FIG. 20).

In this manner, the protrusion 24 that has substantially an arc cross-section and has a height smaller than the thickness E1 of the sealant 40 protruding outwardly from the surface of the sheet member 20 is formed continuously along the entire periphery 40*b* of the sealant 40 press-bonded to the surface of the sheet base 200 (refer to FIGS. 21(*a*) and 21(*b*)).

The sealant press-cutting unit 404 heats the sealant 40 at a temperature of about 150° C. The sealant press-cutting unit 404 press-bonds the sealant 40 to the sheet base 200 at a pressure of about 50 kg per $cm^2$ (10×10 mm). The sealant press-cutting unit 404 is lowered at a speed of about 10 m/s for press-cutting and press-bonding the sealant 40 to the sheet base 200.

In the bend-open package 10D according to the eighth embodiment, the entire periphery 40*b* of the sealant 40 covering the cut 23 in the sheet member 20 is embedded in and press-bonded to the surface within the opening area 22 on the sheet member 20 in the thickness direction T by the predetermined depth D1. The protrusion 24 protrudes outwardly from the surface of the sheet member 20 and is continuous along the entire periphery 40*b* of the sealant 40 (refer to FIG. 19).

When many bend-open packages 10D are conveyed or transported together, one bend-open package 10D obliquely touching or rubbing against the surface of the sheet member 20 in an adjacent bend-open package 10D in any direction more reliably avoids direct contact with or rubbing against the periphery 40*b* of the sealant 40 in the adjacent bend-open package 10D.

More specifically, when one bend-open package 10D moves onto the sealant 40 in another bend-open package 10D, which is press-bonded to the surface of the sheet member 20 to cover the cut 23, the bend-open package 10D comes in contact with the protrusion 24 along the periphery 40*b* of the sealant 40, and reliably avoids direct contact with the periphery 40*b* of the sealant 40.

The bend-open package 10D climbs over the protrusion 24 protruding from the surface of the sheet member 20 in the other bend-open package 10D, and smoothly moves onto the sealant 40. This more reliably prevents contact or rubbing against the periphery 40*b* of the sealant 40 press-bonded to the surface of the sheet member 20.

In this manner, when bend-open packages 10D touch each other or nib against each other, the sealant 40 covering the cut 23 is more reliably prevented from peeling or curling.

Thus, the sealant 40 is prevented from unsealing the cut 23 until the bend-open package 10D is bent to the predetermined bend angle θ1 or less. This more reliably prevents leakage of content C stored in the bend-open package 10D.

Moreover, when the bend-open package 10D is held with fingertips, the fingertips or fingernails are less likely to be caught on the periphery 40*b* of the sealant 40 press-bonded to the surface of the sheet member 20 in any direction. The fingertips or fingernails climb over the protrusion 24 protruding from the surface of the sheet member 20 and smoothly move onto the sealant 40. This more reliably prevents the sealant 40 covering the cut 23 from peeling or curling, thus providing smoother feel.

Additionally, the protrusion 24 has a smooth curved shape gradually being raised from the periphery of the sheet member 20 toward the periphery of the sealant 40, and thus has little resistance to being climbed over and allows a smooth move over the protrusion 24 to the sealant 40.

One bend-open package 10D or a fingertip or a fingernail smoothly climbs over the protrusion 24 and moves onto the sealant 40 in another bend-open package 10D. This more reliably prevents the sealant 40 covering the cut 23 from peeling or curling.

Thus, the sealant 40 is prevented from unsealing the cut 23 until the bend-open package 10D is bent to the predetermined bend angle θ1 or less. This embodiment thus has functions and effects additional to those in the first to seventh embodiments.

Ninth Embodiment

In the eighth embodiment described above, the protrusion 24 extends along the periphery 40*b* of the sealant 40. In a ninth embodiment, a sheet base 200 has a protrusion 24 covering the periphery 40*b* of a sealant 40 as shown in FIG. 22.

Figure 22:
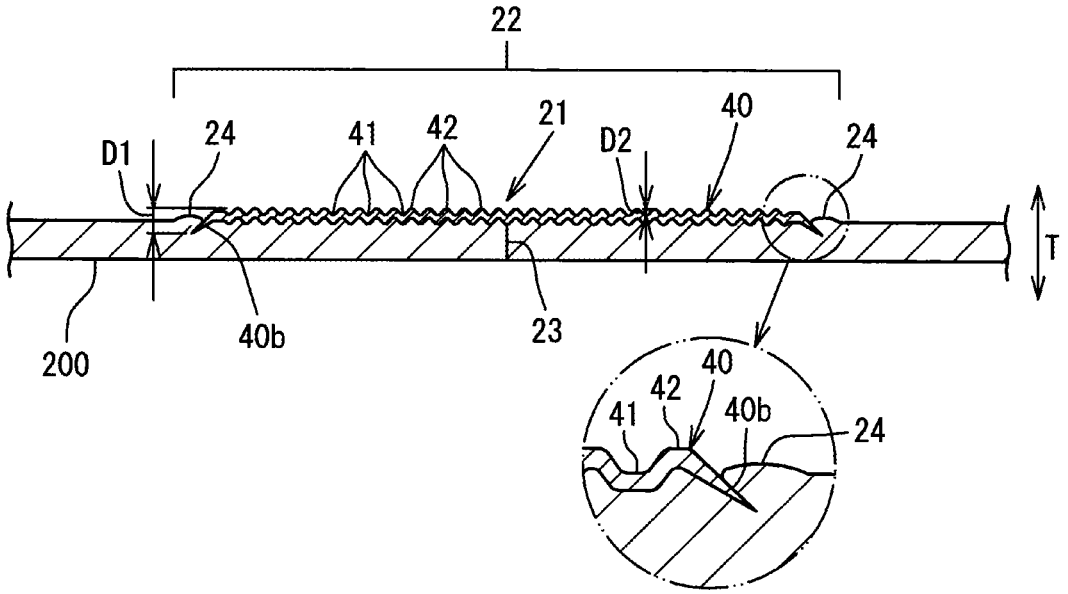
FIG. 22 is an enlarged cross-sectional view of a sheet base with a protrusion press-bonded to cover the periphery of a sealant according to a ninth embodiment.

FIG. 22 is an enlarged cross-sectional view of the sheet base 200 with the protrusion 24 in the ninth embodiment press-bonded to cover the periphery 40*b* of the sealant 40.

The sheet base 200 in the ninth embodiment has the protrusion 24 formed along the entire periphery 40*b* of the sealant 40, which is press-bonded to the surface within the opening area 22 on the sheet base 200 to cover the cut 23. The protrusion 24 covers the periphery 40*b* of the sealant 40 (refer to FIG. 22).

When many bend-open packages 10D manufactured using the sheet base 200 in the ninth embodiment are conveyed or transported together, adjacent bend-open packages 10D may touch each other or rub against each other, but can more reliably prevent the sealant 40 covering the cut 23 from peeling or curling.

Thus, the sealant 40 is prevented from unsealing the cut 23 until the bend-open package 10D is bent to the predetermined bend angle θ1 or less. This more reliably prevents leakage of content C stored in the package body 11. This embodiment thus has functions and effects additional to those in the first to eighth embodiments.

Tenth Embodiment

In the first to ninth embodiments described above, the depressions 41 and the projections 42 are formed in the sealant 40. In a tenth embodiment, the depressions 41 and the projections 42 are eliminated. A sealant press-cutting unit 404 forms a sealant 40 press-bonded to the surface of a sheet base 200 into a substantially flat or arc shape as shown in FIG. 23.

Figure 23A:
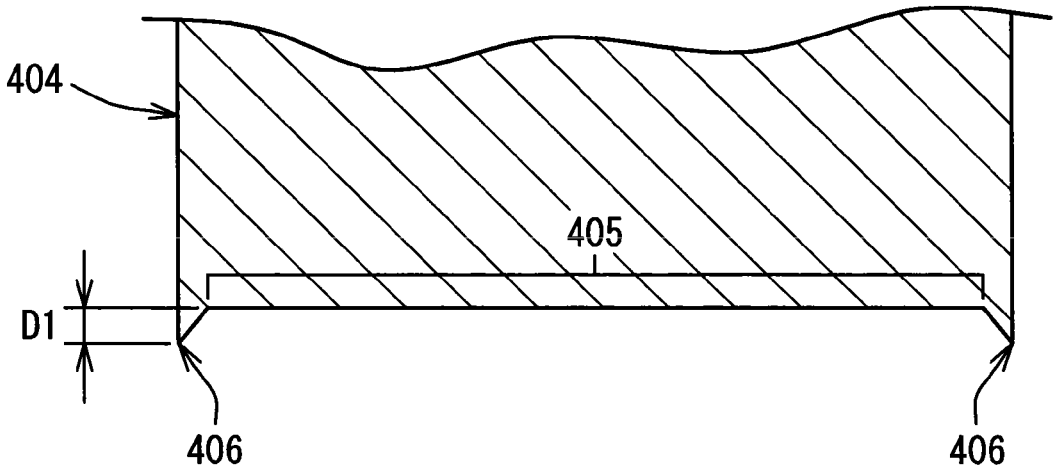
FIGS. 23(*a*) and 23(*b*) show an enlarged cross-sectional view of a sealant press-cutting unit that press-bonds a sealant to a sheet base according to a tenth embodiment.
Figure 23B:
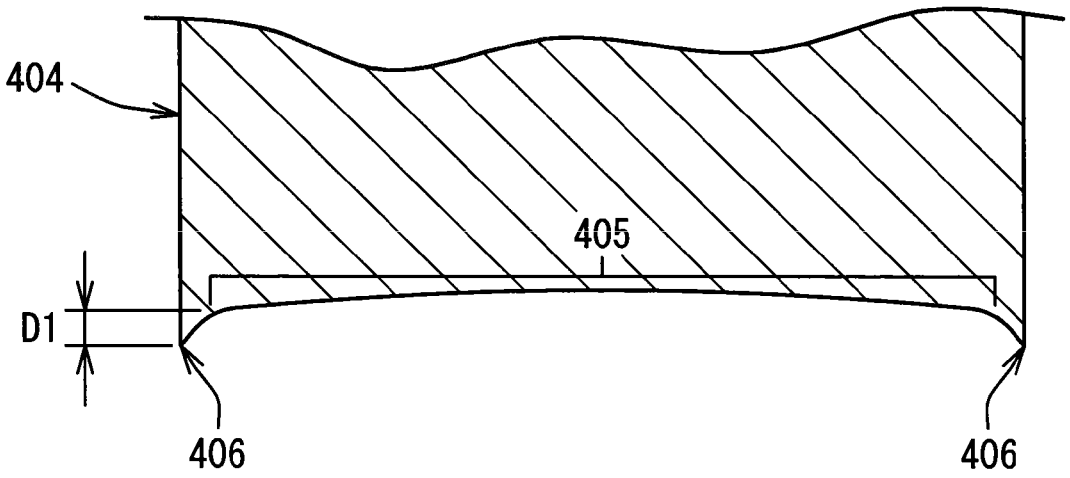

FIG. 23 is an enlarged cross-sectional view of the sealant press-cutting unit 404 that press-bonds the sealant 40 to the sheet base 200 according to the tenth embodiment. More specifically, FIG. 23(*a*) is an enlarged cross-sectional view of the sealant press-cutting unit 404 in which the pressing surface of a sealant pressing part 405 is substantially straight in cross section, and FIG. 23(*b*) is an enlarged cross-sectional view of the sealant press-cutting unit 404 in which the pressing surface of a sealant pressing part 405 is in a substantially arc and concave upward in cross section.

The sealant press-cutting unit 404 according to the tenth embodiment corresponds to the sealant press-cutting unit 404 shown in FIG. 23(*a*) with the sealant pressing part 405 substantially straight in cross section, and the sealant press-cutting unit 404 shown in FIG. 23(*b*) with the sealant pressing part 405 in a substantially arc and concave upward in cross section.

When a sealant 40 press-cut from the sealant base 400 is press-bonded to the surface of the sheet base 200 to cover the cut 23, the pressing of the sealant pressing part 405 in FIG. 23(*a*) forms the surface surrounded by the periphery 40*b* of the sealant 40 into a substantially straight in cross section. The press-bonding of the sealant pressing part 405 in FIG. 23(*b*) forms the surface surrounded by the periphery 40*b* of the sealant 40 into a substantially arc and convex upward in cross section.

More specifically, when the sealant press-cutting unit 404 in the tenth embodiment press-bonds the sealant 40 to the surface of the sheet base 200, the protrusion 24 is continuously formed along the entire periphery 40*b* of the sealant 40. This embodiment thus has functions and effects additional to those in the first to ninth embodiments.

Eleventh Embodiment

Figure 25A:
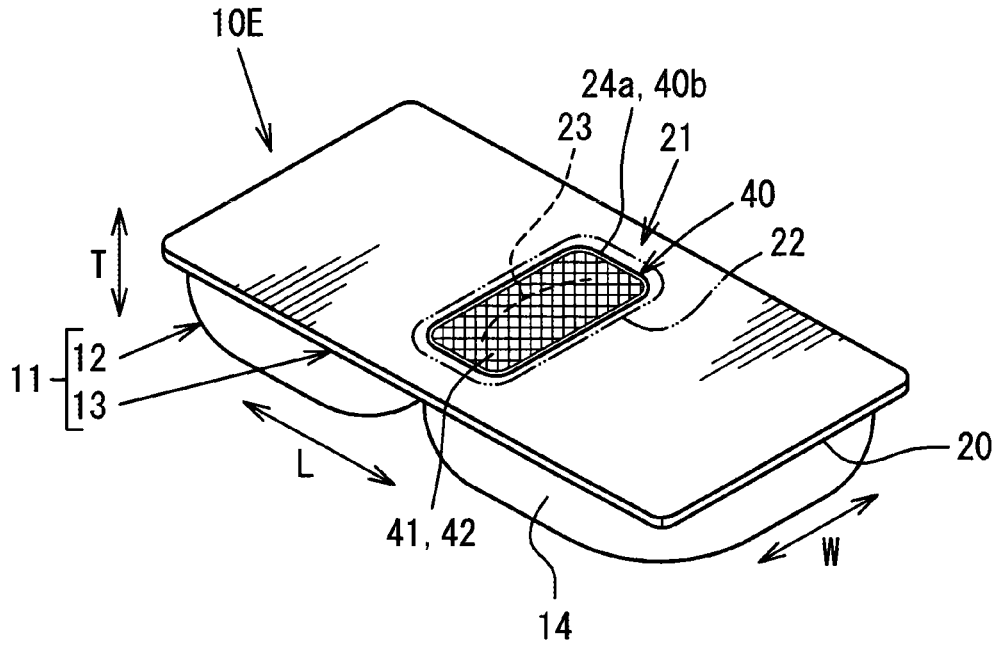
FIGS. 25(*a*) and 25(*b*) show a bend-open package according to an eleventh embodiment.
Figure 25B:
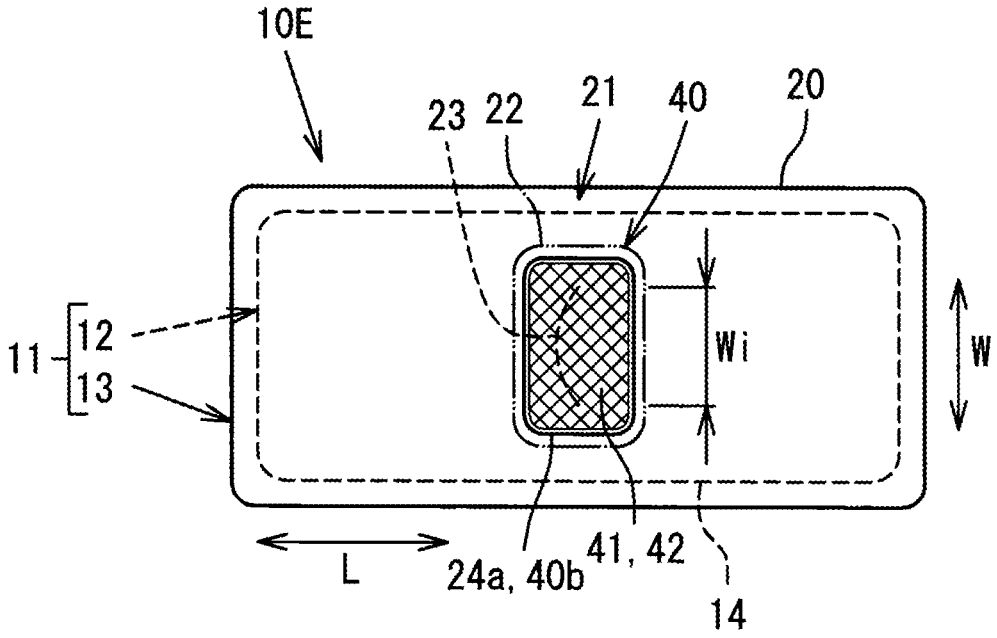

FIG. 25 is a diagram describing a bend-open package 10E according to an eleventh embodiment. More specifically, FIG. 25(*a*) is a perspective view of the bend-open package 10E viewed from above, and FIG. 25(*b*) is a plan view of the bend-open package 10E shown in FIG. 25(*a*).

Figure 26A:
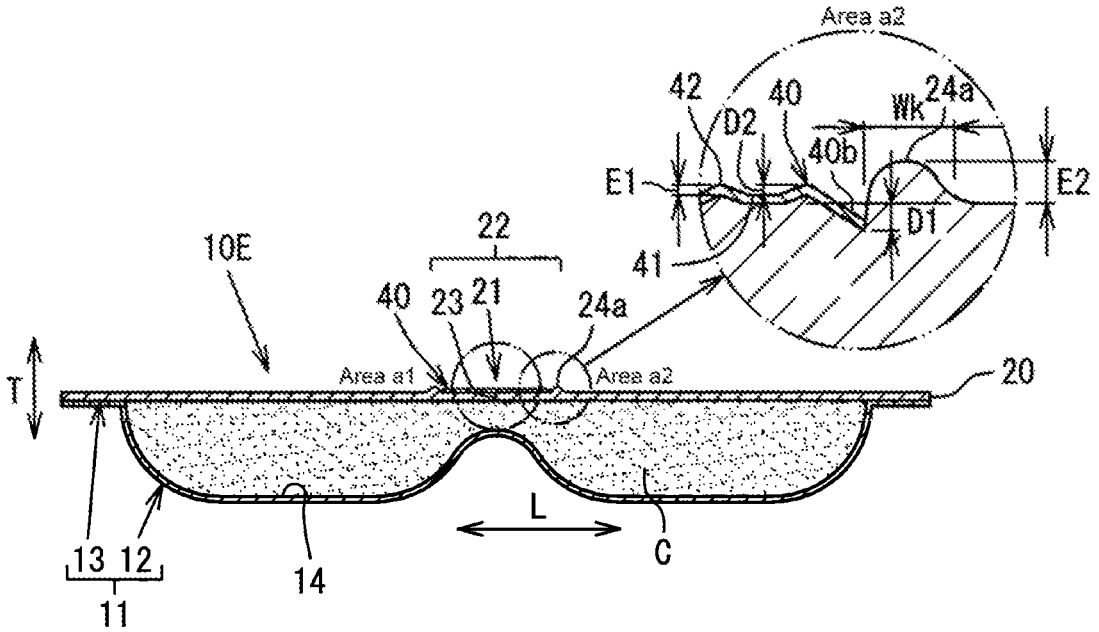
FIGS. 26(*a*) and 26(*b*) show an opening structure of the bend-open package.
Figure 26B:
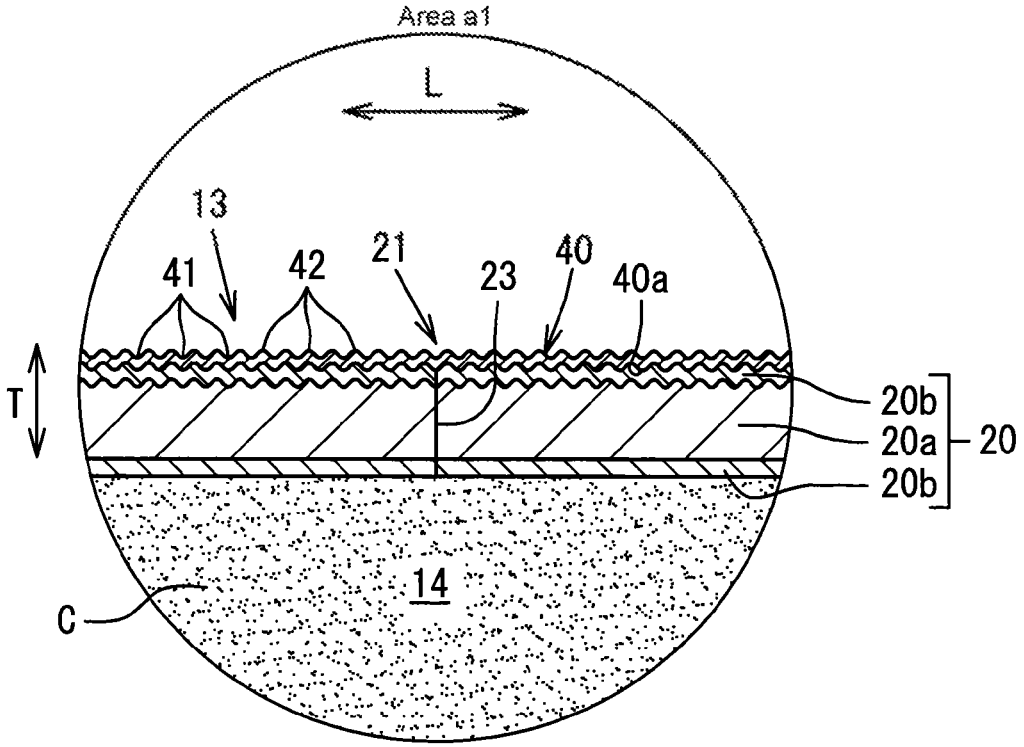

FIG. 26 is a diagram describing the opening structure of the bend-open package 10E. More specifically, FIG. 26(*a*) is a cross-sectional view of the bend-open package 10E taken along the centerline perpendicular to the transverse direction W, and FIG. 26(*b*) is an enlarged cross-sectional view of area a1 shown in FIG. 26(*a*).

Figure 27A:
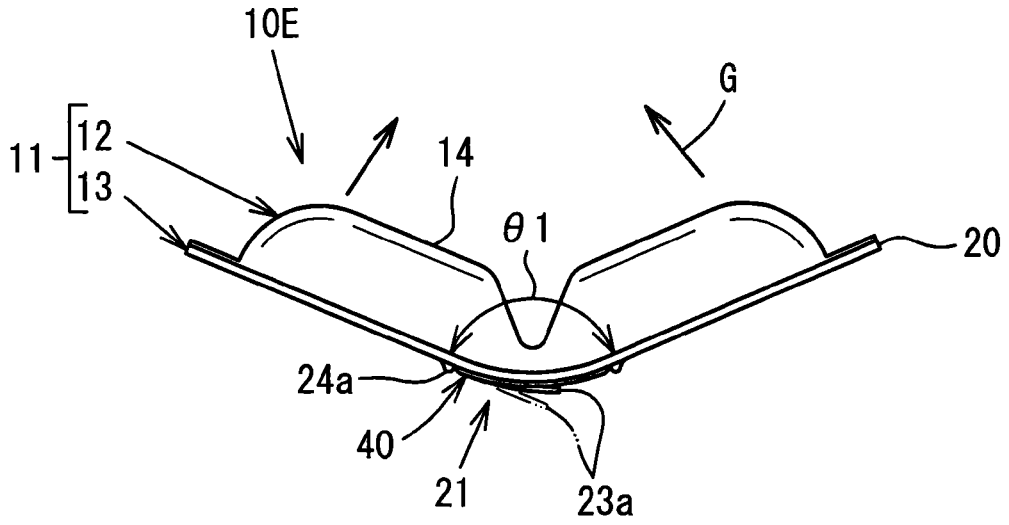
FIGS. 27(*a*) and 27(*b*) show the bending of the bend-open package.
Figure 27B:
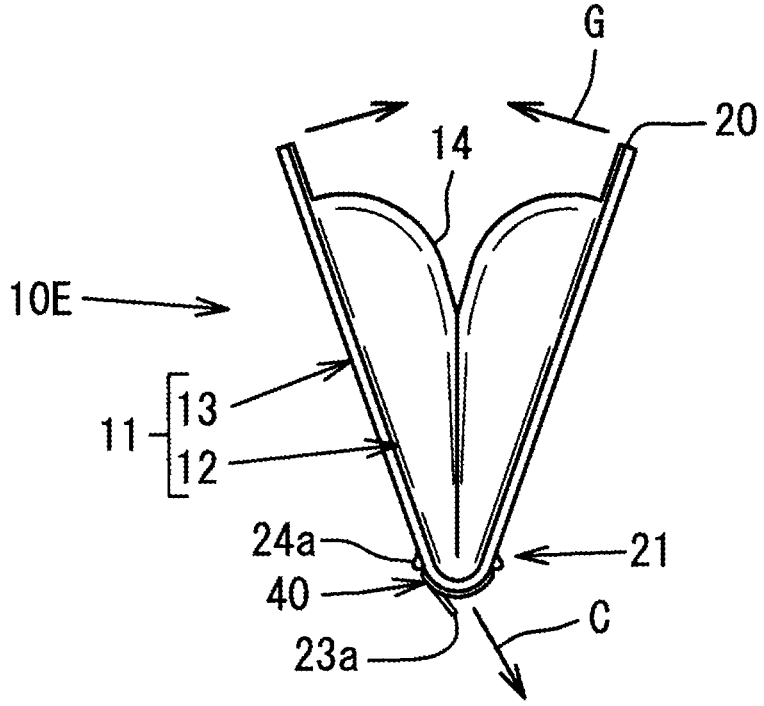
Figure 28:
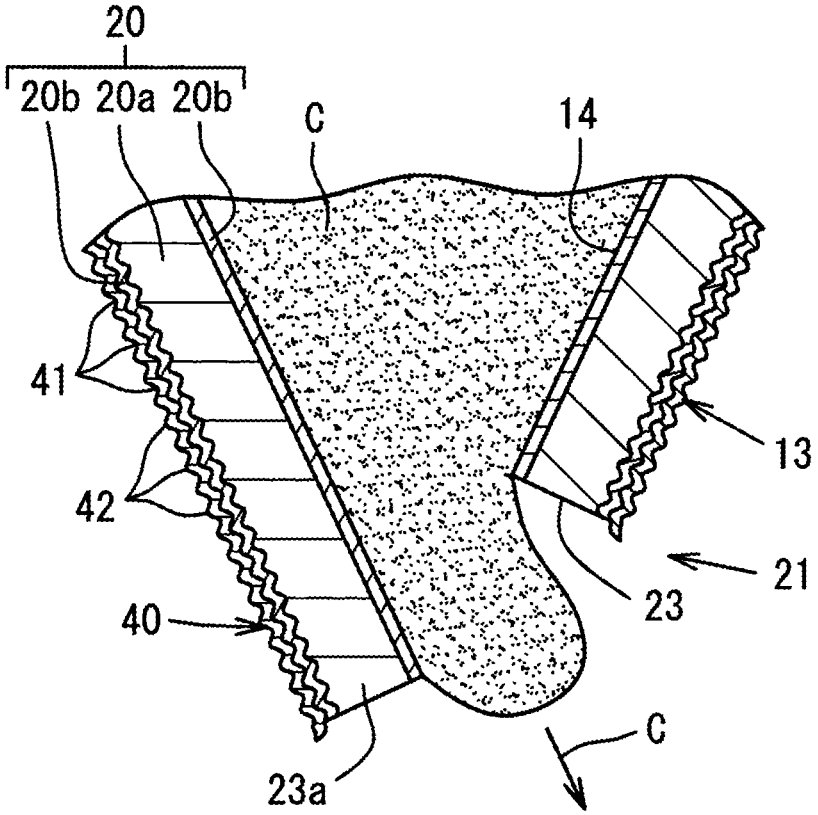
FIG. 28 is an enlarged partial cross-sectional view of the bend-open package showing dispensing of content from the package.

FIG. 27 is a diagram describing the bending of the bend-open package 10E. More specifically, FIG. 27(*a*) is a side view of the bend-open package 10E showing the start of bending, and FIG. 27(*b*) is a side view of the bend-open package 10E folded into two. FIG. 28 is an enlarged partial cross-sectional view of the bend-open package 10E showing dispensing of content C from the package.

As used herein, the longitudinal direction L (lengthwise direction) is the same as the longitudinal direction of the bend-open package 10E substantially rectangular as viewed from above, and the transverse direction W (widthwise direction) is the direction perpendicular to the longitudinal direction L in plane.

The bend-open package 10E in the eleventh embodiment is a small package containing (filled with) a single dose of content C, and includes a package body 11 substantially rectangular as viewed from above. The package body 11 includes a flexible pouch-like body 12, and a lid 13 closing the opening of the body 12 (refer to FIGS. 25 and 26).

The body 12 includes a pouch-like container 14 containing a predetermined dose of content C. The container 14 is formed from a synthetic resin film with a thickness of 150 μm (DIAMIRON F manufactured by Mitsubishi Plastics, Inc.) (refer to FIGS. 25 and 26).

The lid 13 includes a substantially flat synthetic resin sheet member 20 arranged on the inner side of the package body 11 (the lower side in FIG. 26(*a*)), and an aluminum foil sealant 40 press-bonded to the sheet member 20 on the outer side of the package body 11 (the upper side in FIG. 26(*a*)).

The sheet member 20 is sized and shaped to cover the opening of the body 12. The back periphery of the sheet member 20 is thermal-welded to the periphery of the opening of the body 12 to close the opening of the body 12 with the lid 13 (refer to FIG. 26(*a*)).

The sheet member 20 includes an A-PET sheet base 20*a* with a thickness of 300 μm. A PE film sealant material 20*b* is adhered to each of the front and back sides of the sheet base 20*a* (refer to FIG. 26(*b*)).

The film sealant material 20*b* is adhered to cover both the front and back sides (or at least one of the two sides) of the sheet base 20*a*.

The sheet member 20 may also be a composite laminate including an OPET sheet (not shown) in addition to the sheet base 20*a* and the film sealant material 20*b*.

The sheet member 20 has, in its middle in the longitudinal direction L, a bend portion 21 foldable into two in the longitudinal direction L. The bend portion 21 extends in the transverse direction W perpendicular to the longitudinal direction L of the sheet member 20 (refer to FIGS. 25 and 26).

The bend portion 21 has, in its middle in the transverse direction W, an opening area 22 indicated by a two-dot chain line in FIG. 25. The opening area 22 on the sheet member 20 has a slit cut 23 in its middle surface. The slit cut 23 penetrates in the thickness direction T of the sheet member 20 (refer to FIGS. 25 and 26).

The cut 23 is formed in the transverse direction W perpendicular to the longitudinal direction L of the sheet member 20, and has an arc shape curving to one end of the sheet member 20 in the longitudinal direction L as viewed in the thickness direction T of the sheet member 20. The cut 23 has a width Wi equal to or less (preferably about 70% or less) than the width of the sheet member 20 in the transverse direction W (refer to FIG. 25(*b*)).

The sealant 40 includes aluminum foil with a thickness of 20 μm, and has a substantially elliptic cross-section with a length of 20 mm and a width of 10 mm as viewed from above. The back side of the aluminum foil is coated with heat-sealable acrylic copolymer (refer to FIG. 26(*b*)).

The sealant 40 is one size smaller than the opening area 22 of the bend portion 21, and arranged on the outer surface of the opening area 22, which is to be mountain folded when the bend portion 21 of the sheet member 20 is folded into two. The sealant 40 is sized and shaped to cover the cut 23 in the opening area 22. The sealant 40 has a rupture strength that causes a rupture when the bend portion 21 of the sheet member 20 is bent to a predetermined bend angle θ1 or less (refer to FIGS. 27 and 28).

The back side of the sealant 40, which is press-bonded to the surface of the sheet member 20, is substantially uniformly coated (or covered) by about 5 μm with an adhesive layer 40*a* formed from an adhesive such as a hot-melt. A large number of depressions 41 and projections 42 are substantially uniformly formed over the surface surrounded by the periphery 40*b* of the sealant 40 (refer to FIG. 26(*b*)).

The periphery 40*b* of the sealant 40 is embedded in and press-bonded to the surface of the sheet member 20 in the thickness direction T by a predetermined depth D1 and is buried under the surface of the sheet member 20. The embedding depth of the press-bonded periphery 40*b* gradually increases from the middle toward the outer periphery of the sealant 40 (refer to the enlarged view of area a2 shown in FIG. 26(*a*)).

The embedding depth D1 of the periphery 40*b* is about 0.5 or more times the thickness E1 of the sealant 40, and is more specifically about 0.1 mm. The height difference D2 between the depressions 41 and the projections 42 is about 0.1 to 10 times the thickness E1 of the sealant 40, and may preferably be five times or less (refer to the enlarged view of area a2 shown in FIG. 26(*a*)).

The sheet member 20 has a smooth and curved protrusion 24*a* on its part along the periphery 40*b* of the sealant 40. The protrusion 24*a* is higher than the periphery 40*b* of the sealant 40 embedded in the sheet member 20 and protrudes outwardly from the surface of the sealant 40 press-bonded to the sheet member 20 (refer to the enlarged view of area a2 shown in FIG. 26(*a*)).

The protrusion 24*a* is formed on the surface of the sheet member 20 along the periphery 40*b* of the sealant 40 and is continuous along the entire periphery 40*b*. The protrusion 24*a* has a width Wk that is about once or more times the thickness E1 of the sealant 40. The protrusion 24*a* has a smooth, curved outer surface that is gradually raised from the periphery of the sheet member 20 toward the periphery of the sealant 40 (refer to the enlarged view of area a2 shown in FIG. 26(*a*)).

The protrusion 24*a* has a height E2 that is about 0.5 or more times the thickness E1 of the sealant 40. More specifically, the protrusion 24*a* on the sheet member 20 is higher than the surface of the sealant 40 press-bonded to the sheet member 20. The sealant 40 has a thickness of 20 μm, whereas the height E2 of the protrusion 24*a* is about 60 μm (refer to the enlarged view of area a2 shown in FIG. 26(*a*)).

When many bend-open packages 10E are conveyed or transported together, one bend-open package 10E may obliquely touch or rub against the surface of the sheet member 20 in an adjacent bend-open package 10E.

However, the protrusion 24*a* protruding from the surface of the sheet member 20 in the adjacent bend-open package 10E serves as a protective wall, which reliably prevents the bend-open package 10E from coming into direct contact with the periphery 40*b* of the sealant 40 in the adjacent bend-open package 10E.

This prevents the sealant 40 covering the cut 23 in the adjacent bend-open package 10E from having a scratch on its surface and peeling or curling at its edge. Additionally, the sealant 40 reliably seals the cut 23 until the sealant 40 can rupture to open when the bend-open package 10E is bent.

Thus, the sealant 40 is prevented from unsealing the cut 23 and maintains the sealing until the bend-open package 10E is bent to the predetermined bend angle θ1 or less. This reliably prevents leakage of content C stored in the container 14 of the body 12 included in the package body 11.

Moreover, the part corresponding to the protrusion 24*a* on the sheet member 20 has higher rigidity, and thus has strength high enough to withstand pressure applied from above to the sheet member 20. The sealant 40 is thus more reliably prevented from unsealing the cut 23.

Additionally, the entire periphery 40*b* of the sealant 40 is embedded in the surface of the sheet member 20 in the thickness direction T. Thus, a fingertip can receive smooth feel without being caught on the periphery 40*b* of the sealant 40.

In addition, the width Wk of the protrusion 24*a* is about once or more times the thickness E1 of the sealant 40. Thus, if one bend-open package 10E touches the protrusion 24*a* on a sheet member 20, the protrusion 24*a* is less likely to chip or deform, and will stably function as a protective wall.

A method for dispensing content C from the bend-open package 10E will now be described.

First, the bend-open package 10E is picked with fingers on the short sides. The bend-open package 10E is held with the lid 13 of the package body 11 facing downward, and then starts being folded into two in the bending direction G (refer to FIG. 27(*a*)).

When the bend-open package 10E is bent to the predetermined bend angle θ1 or less, the sealant 40 press-bonded to the opening area 22 on the bend portion 21 ruptures to open, and the cut 23 in the bend portion 21 is open in the thickness direction T (refer to FIG. 27(*b*)).

The open cut 23 in the sheet member 20 connects to the container 14 of the body 12. Thus, the bend-open package 10E is bent to squeeze content C stored in the container 14 through the cut 23 (refer to FIG. 28).

When the bend portion 21 of the sheet member 20 is folded into two, a tongue 23*a* of the cut 23 extends obliquely downward, and the content C that has been squeezed out flows along the tongue 23*a*. Thus, the content C stored in the container 14 is less likely to be squeezed out in a large amount at a time, and is prevented from splattering (refer to FIGS. 27(*b*) and 28).

In this manner, the sealant 40 is prevented from unsealing the cut 23 until the bend-open package 10E is bent to the predetermined bend angle θ1 or less, and the sealing by the sealant 40 is more reliably maintained. This prevents leakage of content C stored in the container 14.

A method for manufacturing a sheet base 200 used for the sheet member 20 of the bend-open package 10E and a method for manufacturing the bend-open package 10E using the sheet base 200 supporting a press-bonded sealant 40 will now be described.

Figure 29:
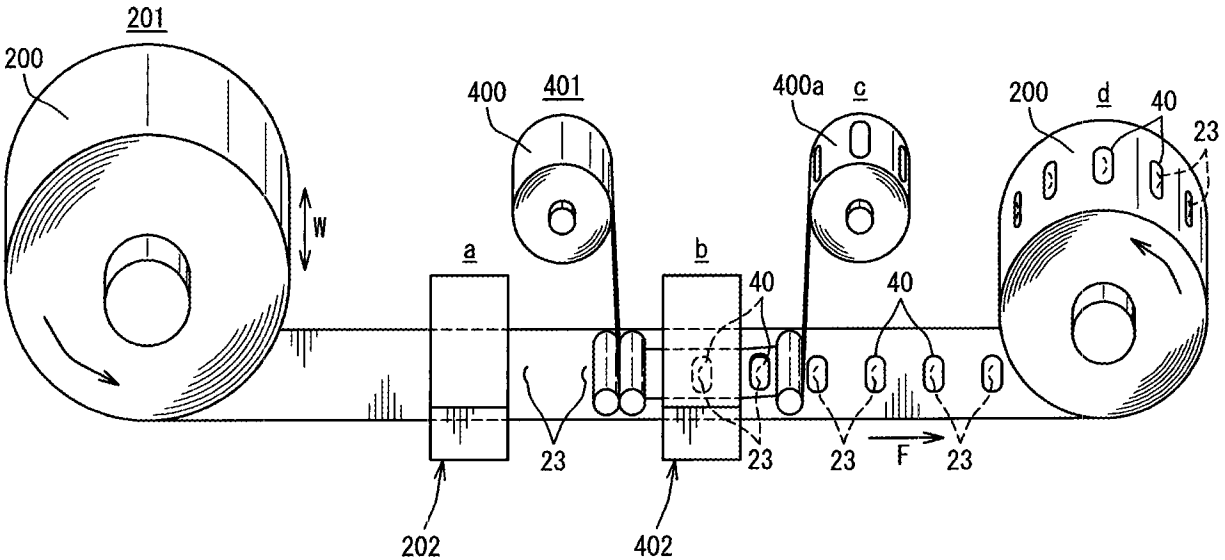
FIG. 29 is a diagram describing a method for manufacturing a sheet base used for a sheet member of the bend-open package.
Figure 30:
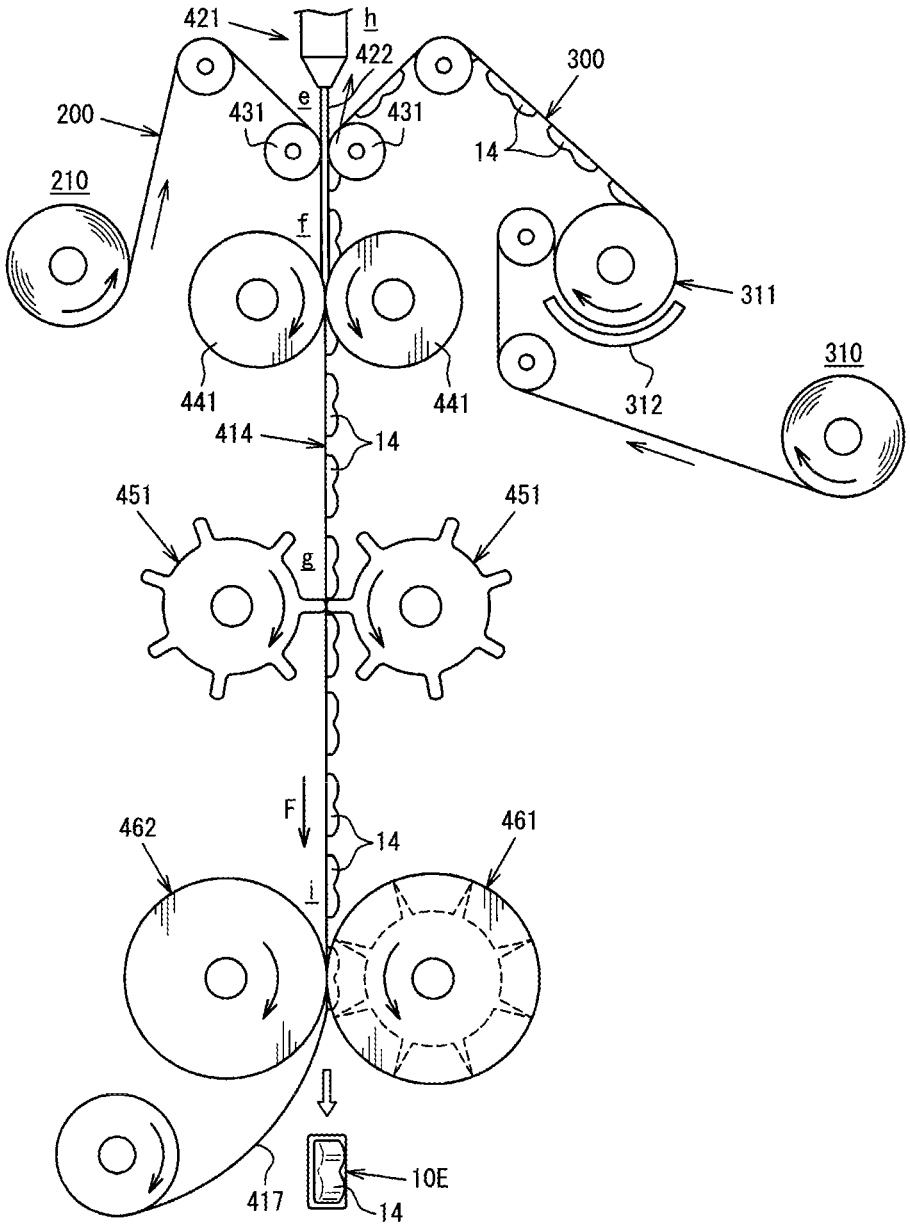
FIG. 30 is a diagram describing a method for manufacturing the bend-open package.

FIG. 29 is a diagram describing the method for manufacturing the sheet base 200 used for the sheet member 20 of the bend-open package 10E. FIG. 30 is a diagram describing the method for manufacturing the bend-open package 10E.

Figure 31:
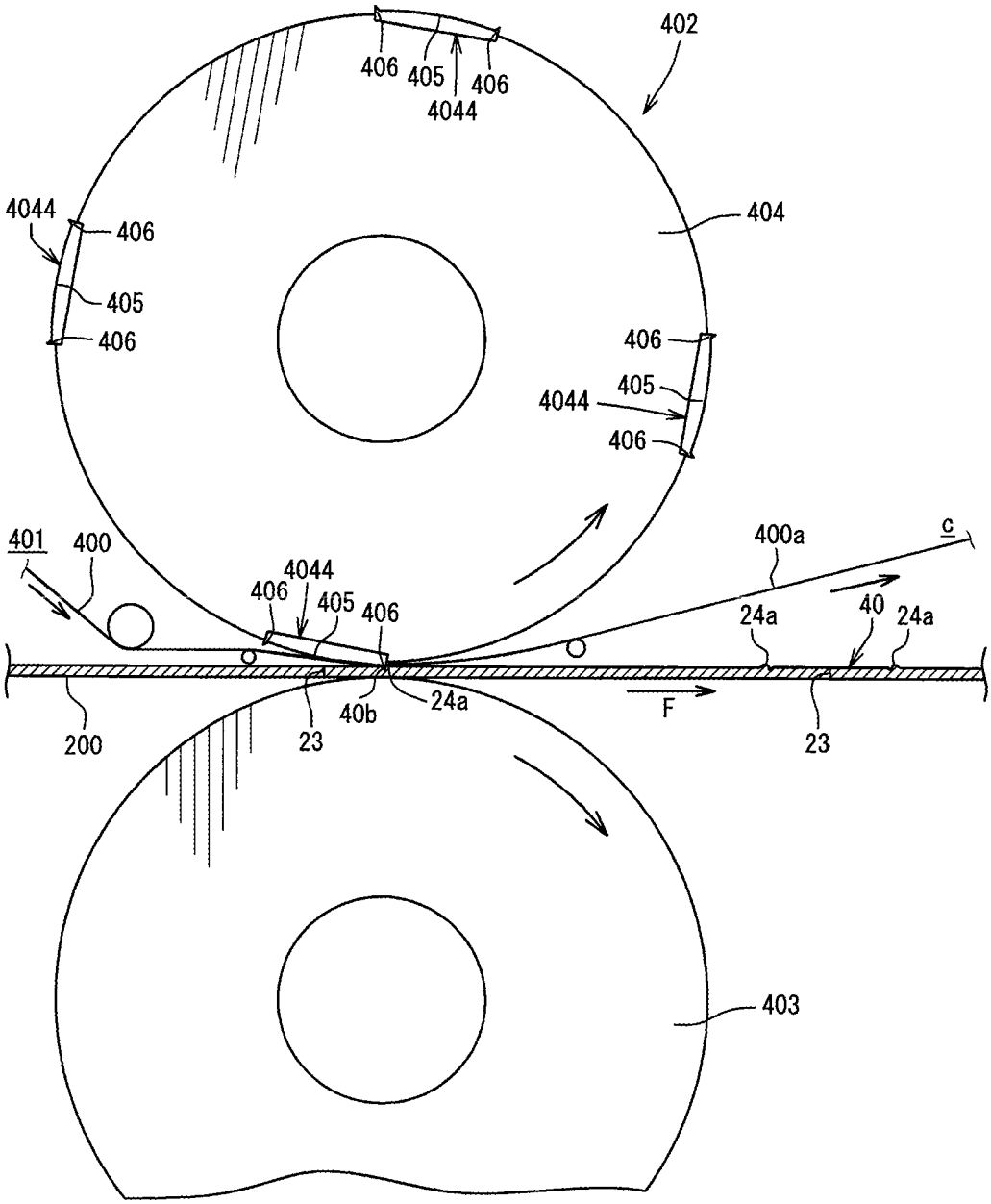
FIG. 31 is an enlarged side view of a press-cutting/press-bonding machine.
Figure 32:
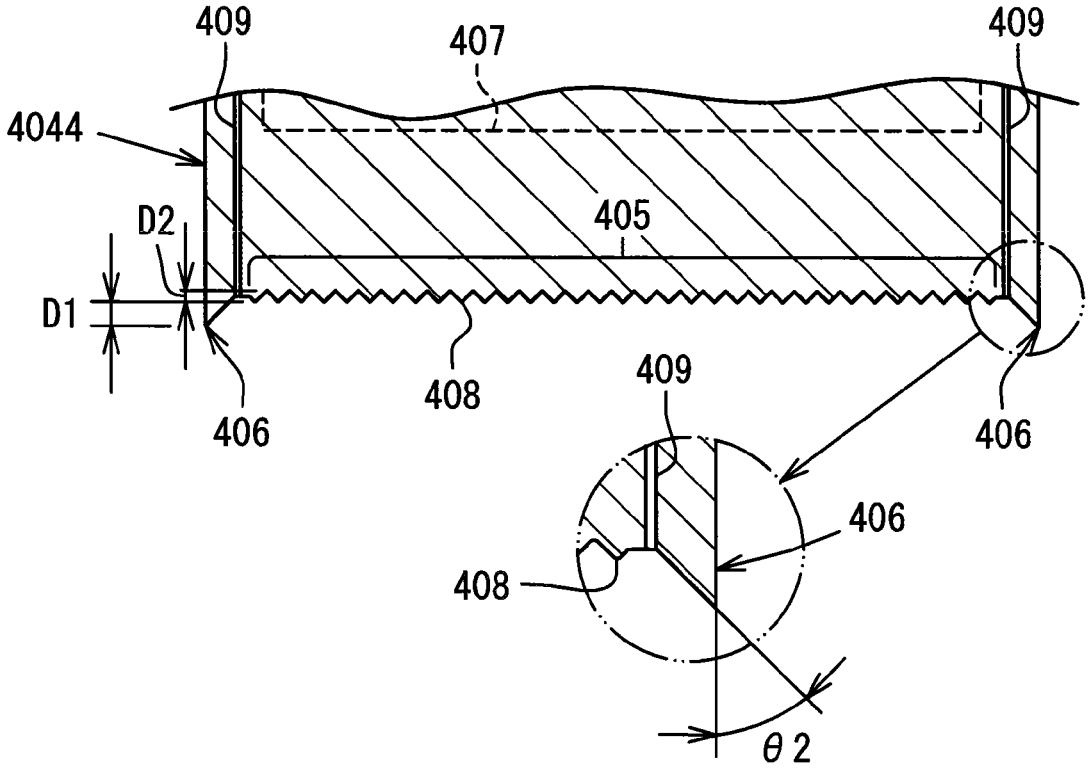
FIG. 32 is an enlarged cross-sectional view of a press-cutting roll.
Figure 33A:
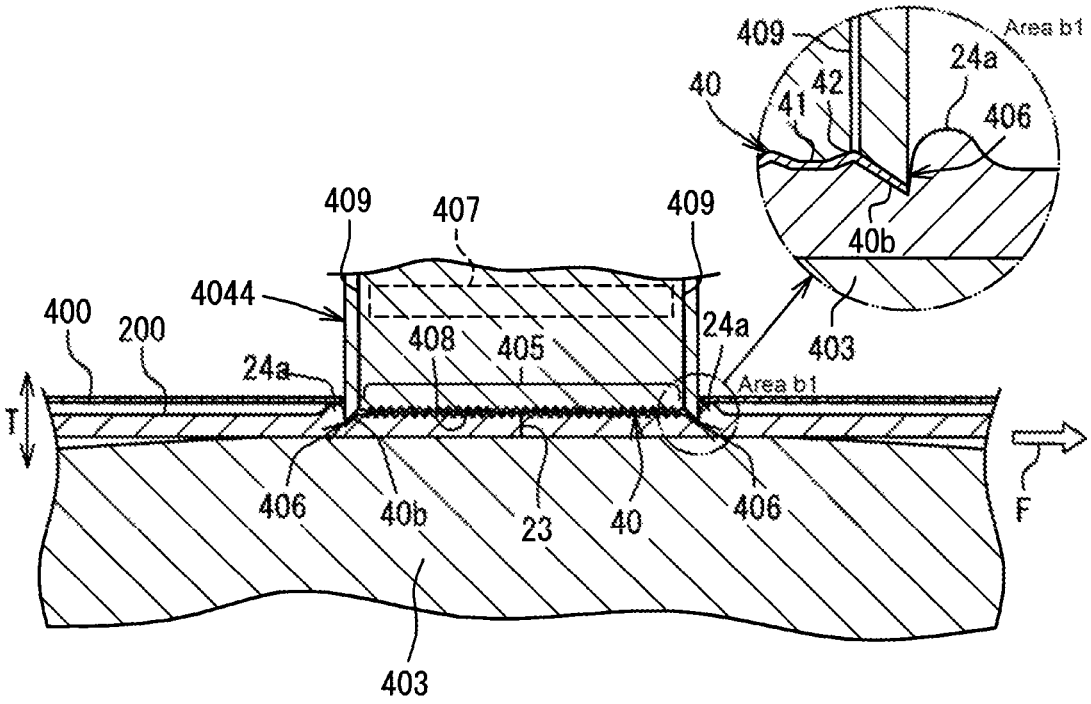
FIGS. 33(*a*) and 33(*b*) show the press-cutting roll that press-bonds a sealant to the sheet base.
Figure 33B:
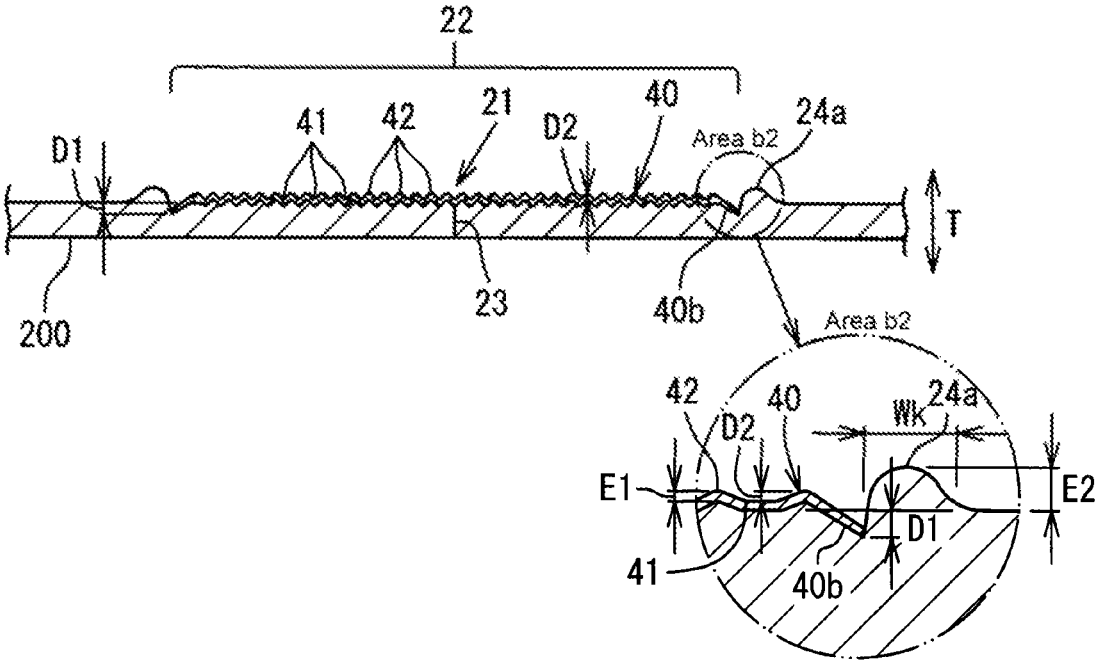

FIG. 31 is an enlarged side view of a press-cutting/press-bonding machine 402. FIG. 32 is an enlarged cross-sectional view of a press-cutting roll 404. FIG. 33 is a diagram describing the press-cutting roll 404 that press-bonds a sealant 40 to the sheet base 200. More specifically, FIG. 33(*a*) is an enlarged cross-sectional view of the sealant pressing part 405 that has press-bonded the sealant 40 to the sheet base 200, and FIG. 33(*b*) is an enlarged cross-sectional view of the sheet base 200 to which the sealant 40 is press-bonded.

The method for manufacturing the sheet base 200 to which the sealants 40 are press-bonded includes a cut forming step (a) for forming cuts 23 in the surface of the synthetic resin sheet base 200 in a strip. The method also includes a sealant press-cutting/press-bonding step (b) for press-cutting the aluminum foil sealant base 400 in a strip into the sealants 40 sized and shaped to cover the cuts 23 in the sheet base 200, and press-bonding the sealants 40 press-cut from the sealant base 400 to the surface of the sheet base 200 to cover the cuts 23 while heating. The method further includes a base recovery step (c) for recovering a base waste 400*a* generated by separating the sealants 40 by winding it in a roll, and a base winding step (d) for winding the sheet base 200 to which the sealants 40 are press-bonded in a roll. These steps are performed in this order (refer to FIG. 29).

In the cut forming step (a), the sheet base 200 being unwound from a sheet holder 201 in a strip is fed at a constant speed in the feeding direction F toward a cutter 202. The cutter 202 forms slit cuts 23 in the middle of the sheet base 200 in the transverse direction W and at predetermined intervals in the longitudinal direction L of the sheet base 200 (refer to FIG. 29).

In the sealant press-cutting/press-bonding step (b), the sealant base 400 being unwound from a sealant holder 401 in a strip is overlaid on a middle portion of the surface of the sheet base 200 in the transverse direction W to cover the cuts 23, and the sealant base 400 is fed in the feeding direction F to the press-cutting/press-bonding machine 402 at a constant speed in synchronization with the feeding speed of the sheet base 200 (refer to FIG. 29). The sealant base 400 has a width smaller than the width of the sheet base 200 in the transverse direction W to cover a cut 23.

The press-cutting/press-bonding machine 402 includes a support roll 403 that supports the sheet base 200 having cuts 23, and a press-cutting roll 404 that press-cuts the sealant base 400 into a sealant 40 and press-bonds the sealant 40 to the surface of the sheet base 200 to cover a cut 23 while heating (refer to FIG. 31).

The support roll 403 is located under the position at which the sealant base 400 overlaid on the sheet base 200 is press-cut. The press-cutting roll 404 is located above the position at which the sealant base 400 is press-cut, and faces the sealant base 400 overlaid on the sheet base 200 supported on the support roll 403. The rolls 403 and 404 are rotated by a drive unit (not shown) in the feeding direction F at a constant speed in synchronization with the feeding speed of the sheet base 200 (refer to FIG. 31).

The press-cutting roll 404 includes press-cutting units 4044 arranged at predetermined intervals in the circumferential direction of the press-cutting roll 404. Each press-cutting unit 4044 press-cuts the sealant base 400 into a size and a shape corresponding to a sealant 40 (refer to FIG. 31).

The press-cutting unit 4044 includes the sealant pressing part 405 that press-bonds the sealant base 400 to the middle surface portion of the sheet base 200 in the transverse direction W, a press-cutting section 406 that press-cuts the sealant base 400 into a size and a shape to cover a cut 23 in the sheet base 200, and a heater 407 that heats the press-cutting unit 4044 (refer to FIG. 31).

The sealant pressing part 405 has a substantially arc shape that is convex radially outward. The sealant pressing part 405 has a pressing end middle area including a roughening section 408 that forms a large number of depressions 41 and projections 42 on the surface of the sealant 40. The working surface of the roughening section 408 is roughened in correspondence with the depressions 41 and the projections 42 to be formed on the sealant 40 (refer to FIG. 32).

The press-cutting section 406 protrudes outwardly from the pressing end periphery of the sealant pressing part 405 in a direction substantially vertical to the circumference of the press-cutting roll 404, and has an edge shape for press-cutting the sealant base 400 into a size and a shape to cover a cut 23 in the sheet base 200.

The press-cutting section 406 has a substantially triangle cross-section with an inner slope and an outer vertical plane meeting each other. The cutting edge of the press-cutting section 406 has an embedding angle θ2 ranging from about 30 to 110 degrees, and particularly an angle of 45 degrees. The roughened face of the roughening section 408 has a height difference D2 corresponding to the difference between the depressions 41 and the projections 42 formed on the sealant 40 (refer to FIG. 32).

The sealant pressing part 405 and each press-cutting section 406 have a degassing hole 409 between them. During the press-bonding of a sealant 40 to the sheet base 200, the degassing hole 409 removes air left on the flat part. The degassing hole 409 has a pore size ranging from about 0.1 to 0.3 mm (refer to FIGS. 32 and 33).

The degassing hole 409, which removes air left on the flat part during the press-bonding of the sealant 40 to the sheet base 200, can prevent microcracks in a part of the sealant 40 press-bonded to the cut 23. A larger pore size of the degassing hole 409 may leave a pore mark on the sealant 40, and thus the above pore size range is desirable.

Manufacturing the sheet base 200 to which the sealants 40 are press-bonded includes a cut forming step (a) for forming, with the cutter 202, cuts 23 in the surface of the sheet base 200, and feeding the sheet base 200 in the feeding direction F with the sealant base 400 being overlaid on the surface of the sheet base 200 to cover the cuts 23. The sheet base 200 is then transferred to the sealant press-cutting/press-bonding step (b) (refer to FIGS. 29 and 31).

In the sealant press-cutting/press-bonding step (b), the support roll 403 and the press-cutting roll 404 in the press-cutting/press-bonding machine 402 are rotated in the feeding direction F at a constant speed, and the press-cutting section 406 of a press-cutting unit 4044 press-cuts the sealant base 400 overlaid on the sheet base 200 into a sealant 40 sized and shaped to cover a cut 23 (refer to FIGS. 31 and 33).

The sealant 40 is press-bonded by the sealant pressing part 405 to the surface of the sheet base 200 to cover the cut 23. More specifically, a pressure of about 10 kg/mm' is applied to the sealant 40 for about 0.1 seconds with the press-cutting units 4044 of the press-cutting roll 404 being heated at about 130° C. by the heater 407 (refer to FIGS. 31 and 33).

For press-cutting the sealant base 400 into the sealant 40, with the entire periphery 40*b* of the sealant 40 being embedded in the surface of the sheet base 200 in the thickness direction T by a predetermined depth D1 by the press-cutting section 406 of the press-cutting unit 4044, the part of the sheet base 200 corresponding to the periphery 40*b* of the sealant 40 is melted by heating (refer to FIG. 33(*a*)).

The melted part of the sheet base 200 is pressed by the press-cutting section 406 of the press-cutting unit 4044 and forced outwardly from the press-cutting section 406. The pressed part protrudes outwardly from the surface of the sheet base 200 into a substantially semicircular shape in cross section (refer to the enlarged view of area b1 shown in FIG. 33(*a*) and the enlarged view of area b2 shown in FIG. 33(*b*)).

In this manner, a smooth and curved protrusion 24*a* is formed on the surface of the sheet base 200. The protrusion 24*a* protrudes outwardly from the surface of the sealant 40 press-bonded to the sheet base 200 and along the periphery 40*b* of the sealant 40. The protrusion 24*a* is continuous along the entire periphery 40*b*.

For press-bonding the sealant 40 to the surface of the sheet base 200, the surface surrounded by the periphery 40*b* of the sealant 40 is pressed in the thickness direction T by the roughening section 408 in the sealant pressing part 405. The pressing forms a large number of depressions 41 and projections 42 substantially uniformly over the surface surrounded by the periphery 40*b* of the sealant 40.

This process enables the continuous manufacture of the sheet base 200 to which the sealants 40 are press-bonded, which is to be used for the sheet members 20 in bend-open packages 10E (refer to FIG. 33(*b*) and the enlarged view of area b2).

The base waste 400*a* generated by separating the sealants 40 is recovered in the base recovery step (c) by winding it in a roll, whereas the sheet base 200 to which the sealants 40 are press-bonded is recovered in the base winding step (d) by winding it in a roll (refer to FIG. 29).

A method for manufacturing bend-open packages 10E using the sheet base 200 to which the sealants 40 are press-bonded will now be described.

The method for manufacturing the bend-open packages 10E includes a combining step (e) for combining a film base 300 supporting pouch-like containers 14 and the sheet base 200 to which the sealants 40 are press-bonded while vertically feeding them in the feeding direction F. The method also includes a longitudinally sealing step (f) for heat-sealing the bases 200 and 300 in the longitudinal direction L at their both edges, and a transversely sealing step (g) for heat-sealing the bases 200 and 300 in the transverse direction W at their overlaps above and under each container 14. The method further includes a filling step (h) for filling a longitudinally and transversely sealed tubular package 414 with content C, and a dividing step (i) for separating the tubular package 414 filled with a predetermined dose of content C into individual bend-open packages 10E. The steps are performed in this order (refer to FIG. 30).

The sheet base 200 to which the sealants 40 are press-bonded is wound in a roll around and held on the sheet holder 210. The film base 300 yet to include the containers 14 is wound in a roll around and held on a film holder 310 (refer to FIG. 30).

When the film base 300 is unwound from the film holder 310, the film base 300 is wound around a forming drum 311. The film base 300 wound around the forming drum 311 is heated by a heater 312 to soften the film base 300 and sequentially form the containers 14 as pouches on the inner surface wound around the film holder 310 (refer to FIG. 30).

In the combining step (e), the side of the film base 300 unwound from the film holder 310 opposite to the containers 14 and the side of the sheet base 200 unwound from the sheet holder 210 opposite to the press-bonded sealants 40 are combined with each other. The combined bases are vertically fed in the feeding direction F by a pair of feeding rolls 431 and transferred to the longitudinally sealing step (f) (refer to FIG. 30).

In the longitudinally sealing step (f), while the bases 200 and 300 are being vertically fed in the feeding direction F by a pair of longitudinally sealing rolls 441, both longitudinal edges of the bases 200 and 300 are sealed outside the containers 14. The resultant tubular package 414 is transferred to the transversely sealing step (g) (refer to FIG. 30).

In the transversely sealing step (g), while the tubular package 414 is being vertically fed in the feeding direction F by a pair of transversely sealing rolls 451, the transverse overlaps of the tubular package 414 that are above and under each container 14 are sealed. The resultant tubular package 414 is transferred to the dividing step (i).

In the filling step (h), the tubular package 414 is filled from above with content C supplied through a filling tube 422 included in a filling device 421 (refer to FIG. 30).

In the dividing step (i), while the tubular package 414 is being vertically fed in the feeding direction F by a rotary blade 461 and a support roll 462, the longitudinal sealed areas and the transverse sealed areas of the tubular package 414 are cut in the transverse direction W. As a result, the tubular package 414 that is continuous in the longitudinal direction L is separated into individual bend-open packages 10E each filled with a predetermined dose of content C (refer to FIG. 30).

This manufacturing method enables the continuous and efficient manufacture of many bend-open packages 10E.

A package waste 417 generated by separating the bend-open packages 10E from the tubular package 414 is recovered by winding it in a roll.

The bend-open packages 10E are manufactured more efficiently by sequentially separating the sheet base 200 to which the sealants 40 are press-bonded into a size and a shape corresponding to the sheet member 20 included in the lid 13 of each package body 11, and sequentially separating the film base 300 into a size and a shape corresponding to the body 12 of the package body 11.

Other examples of the bend-open package 10E will now be described. The same or corresponding components herein are given the same reference numerals, and will not be described in detail.

Twelfth Embodiment

In the eleventh embodiment described above, the sheet base 200 has the protrusion 24*a* formed along the periphery 40*b* of the sealant 40. In a twelfth embodiment, a sheet base 200 has a protrusion 24*a* covering the periphery 40*b* of a sealant 40 as shown in FIG. 34.

Figure 34A:
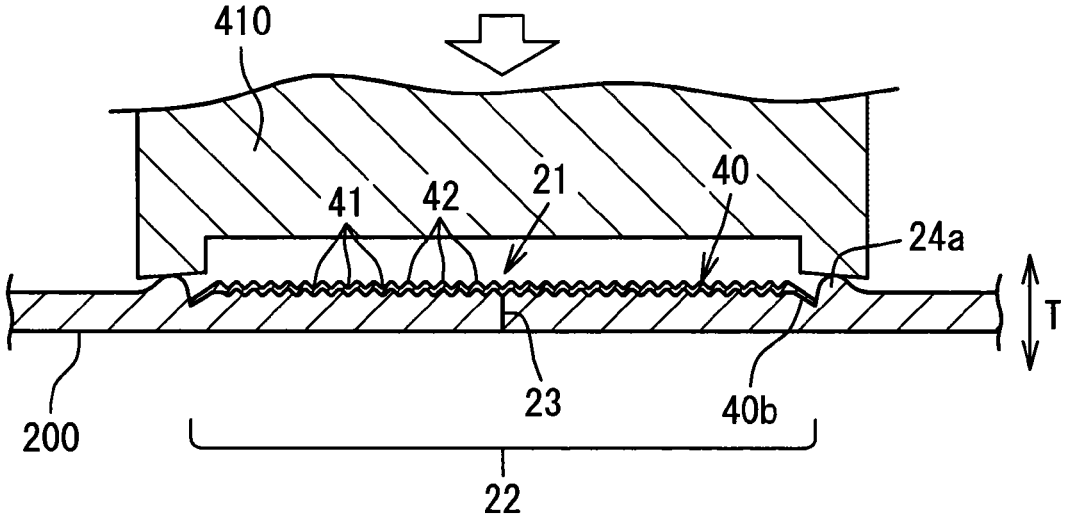
FIGS. 34(*a*) and 34(*b*) show a sheet base according to a twelfth embodiment.
Figure 34B:
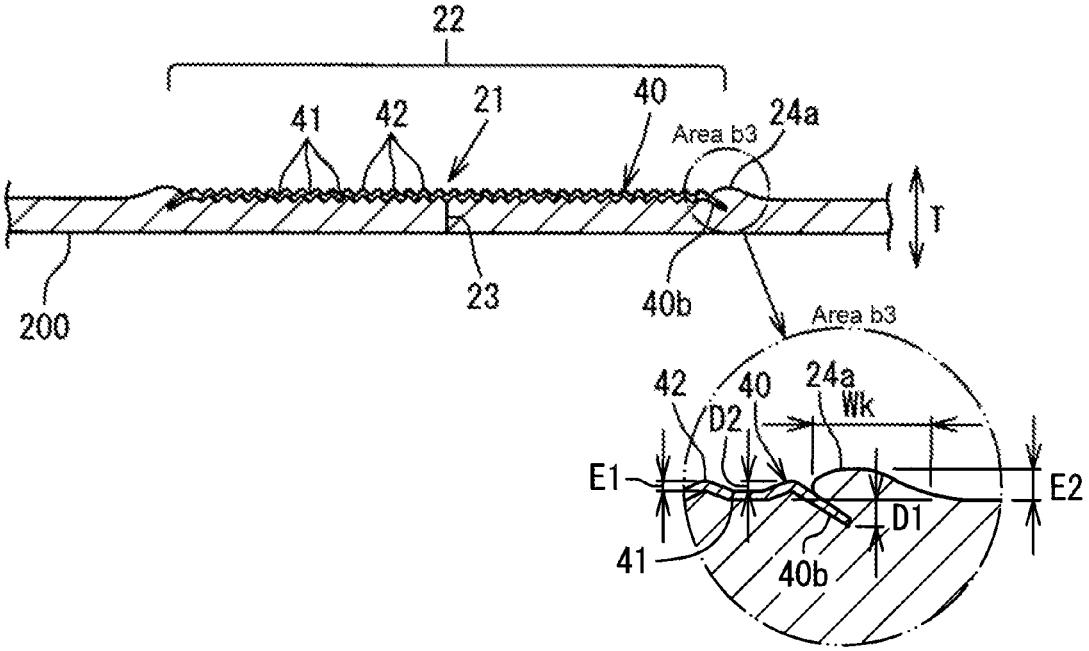

FIG. 34 is a diagram describing the sheet base 200 according to the twelfth embodiment. More specifically, FIG. 34(*a*) is an enlarged cross-sectional view of the sheet base 200 immediately before the protrusion 24*a* is deformed, and FIG. 34(*b*) is an enlarged cross-sectional view of the sheet base 200 after the protrusion 24*a* is deformed.

The sheet base 200 in the twelfth embodiment has the protrusion 24*a* formed along the periphery 40*b* of the sealant 40 and protruding outwardly from the surface of the sheet base 200. The protrusion 24*a* protruding from the surface of the sheet base 200 is pressed in the thickness direction T by a press unit 410 having a substantially gatelike cross-section. This deforms the protrusion 24*a* to cover the periphery 40*b* of the sealant 40 embedded in the sheet base 200 in the thickness direction T (refer to FIGS. 34(*a*) and 34(*b*), and the enlarged view of area b3).

In the sheet base 200 according to the twelfth embodiment, the protrusion 24*a* protruding from the surface of the sheet base 200 covers the periphery 40*b* of the sealant 40 embedded in the surface of the sheet base 200 in the thickness direction T. The part of the press unit 410 that presses the protrusion 24*a* slopes gradually upward from outside to inside (about 0.5 to 2 degrees).

When many bend-open packages 10E manufactured using sheet members 20 separated from the sheet base 200 according to the twelfth embodiment are conveyed or transported together, one bend-open package 10E touching or rubbing against an adjacent other bend-open package 10E can avoid direct contact with the periphery 40*b* of the sealant 40 covered by the protrusion 24*a* in the other bend-open package.

This more reliably prevents the sealant 40 covering the cut 23 from peeling or curling at its edge. The periphery 40*b* of the sealant 40 is also prevented from curling or peeling at its part embedded in the sheet base 200. Additionally, the bend-open packages 10E have no recess on the periphery 40*b* in which dirt or dust may otherwise be caught. Thus, the bend-open packages 10E are suitable for use as individual packages food or medicine.

Thus, the sealant 40 more reliably seals the cut 23 until the sealant 40 can rupture to open when the bend-open package 10E is bent. This embodiment thus has functions and effects additional to those in the eleventh embodiment.

Moreover, the periphery 40*b* of the sealant 40 is embedded in the surface of the sheet member 20 in the thickness direction T, and thus the sealant 40 covering the cut 23 is prevented from peeling or curling more reliably at its edge.

Thirteenth Embodiment

In the twelfth embodiment described above, the bend-open package 10E has the protrusion 24*a* on the sheet member 20 along the periphery 40*b* of the sealant 40. In a thirteenth embodiment, a bend-open package 10E has a protrusion 40*c* on the periphery 40*b* of a sealant 40 and along a protrusion 24*a* on a sheet member 20 as shown in FIG. 35.

Figure 35A:
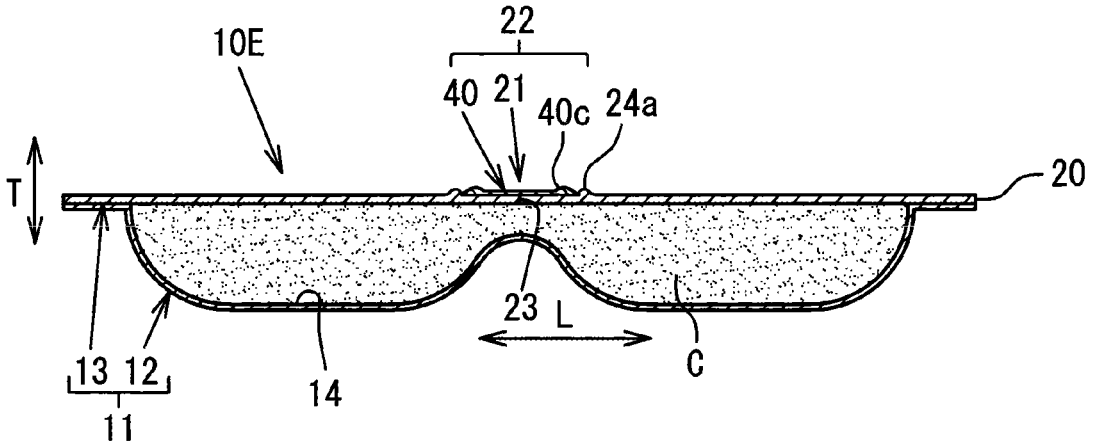
FIGS. 35(*a*) and 35(*b*) show a bend-open package according to a thirteenth embodiment.
Figure 35B:
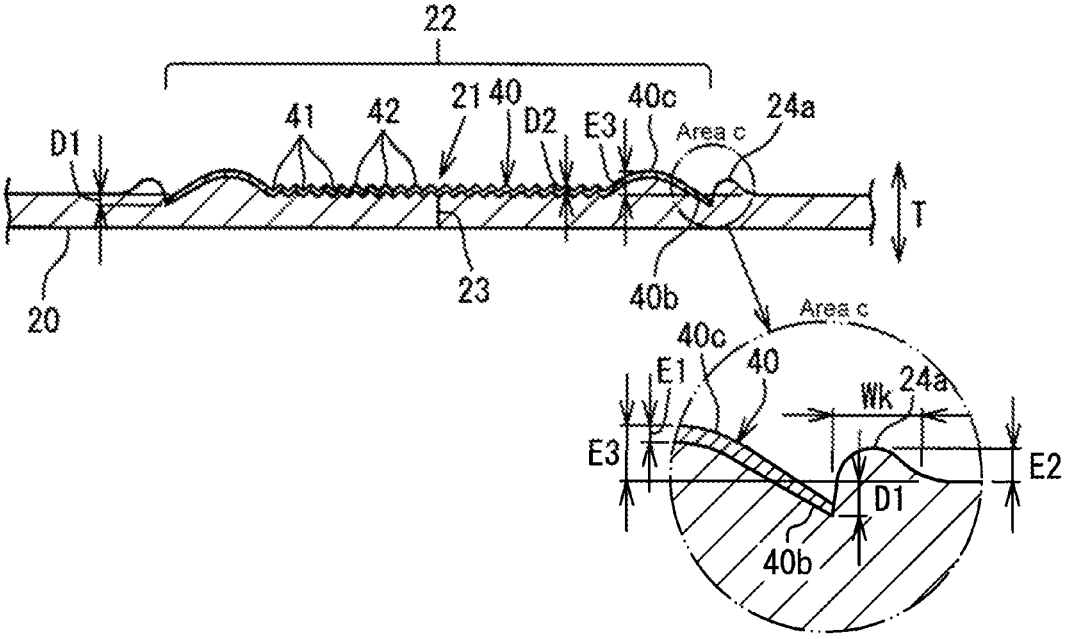

FIG. 35 is a diagram describing the bend-open package 10E according to the thirteenth embodiment. More specifically, FIG. 35(*a*) is a cross-sectional view of the bend-open package 10E taken along the centerline perpendicular to the transverse direction W and FIG. 35(*b*) is an enlarged cross-sectional view of the opening area 22 on the sheet member 20 shown in FIG. 35(*a*).

The bend-open package 10E in the thirteenth embodiment has the protrusion 40*c* protruding outwardly from the sheet member 20 and the surface of the sealant 40. The protrusion 40*c* is formed inside the periphery 40*b* of the sealant 40 and along the protrusion 24*a* on the sheet member 20 (refer to FIGS. 35(*a*) and 35(*b*)).

The protrusion 40*c* has a height E3 that is about 0.5 or more times the thickness E1 of the sealant 40. More specifically, the protrusion 40*c* on the sealant 40 is higher than the protrusion 24*a* on the sheet member 20 (refer to FIG. 35(*b*) and the enlarged view of area c shown in FIG. 35(*b*)).

The bend-open package 10E in the thirteenth embodiment includes two protrusions, which are the protrusion 24*a* on the sheet member 20 and the protrusion 40*c* on the sealant 40. Although a bend-open package 10E adjacent to another package may avoid contact with one of the two protrusions, or specifically the protrusion 24*a*, the bend-open package 10E will touch the other protrusion 40*c*. The bend-open package 10E can thus avoid direct contact with the periphery 40*b* of the sealant 40 in the other package.

The protrusion 24*a* on the sheet member 20 and the protrusion 40*c* on the sealant 40 serve as protective walls, which more reliably prevent the surface of the sealant 40 covering the cut 23 from having a scratch and the sealant 40 from peeling or curling at its edge.

The sealant 40 is prevented from unsealing the cut 23 until the sealant 40 can rupture to open when the bend-open package 10E is bent, and the sealant 40 more reliably seals the cut 23. This embodiment thus has functions and effects additional to those in the eleventh and twelfth embodiments.

The protrusion 40*c* on the sealant 40 may have substantially the same height as the protrusion 24*a* on the sheet member 20.

Fourteenth Embodiment

In the eleventh to thirteenth embodiments described above, the bend-open package 10E has the protrusion 24*a* that is higher than the surface of the sealant 40 press-bonded to the sheet member 20. In a fourteenth embodiment, a bend-open package 10E has a protrusion 24*a* having the same height as the surface of a sealant 40 press-bonded to a sheet member 20 as shown in FIG. 36.

Figure 36A:
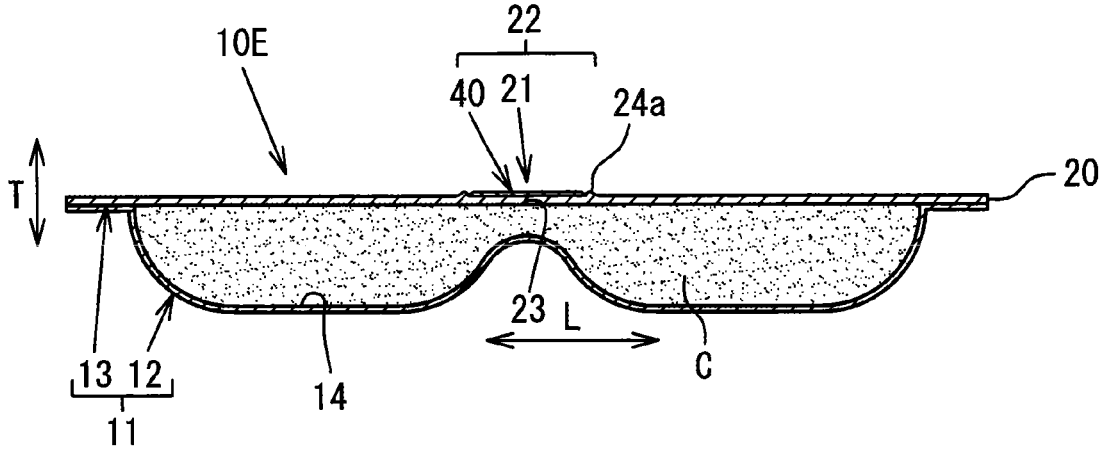
FIGS. 36(*a*) and 36(*b*) show a bend-open package according to a fourteenth embodiment.
Figure 36B:
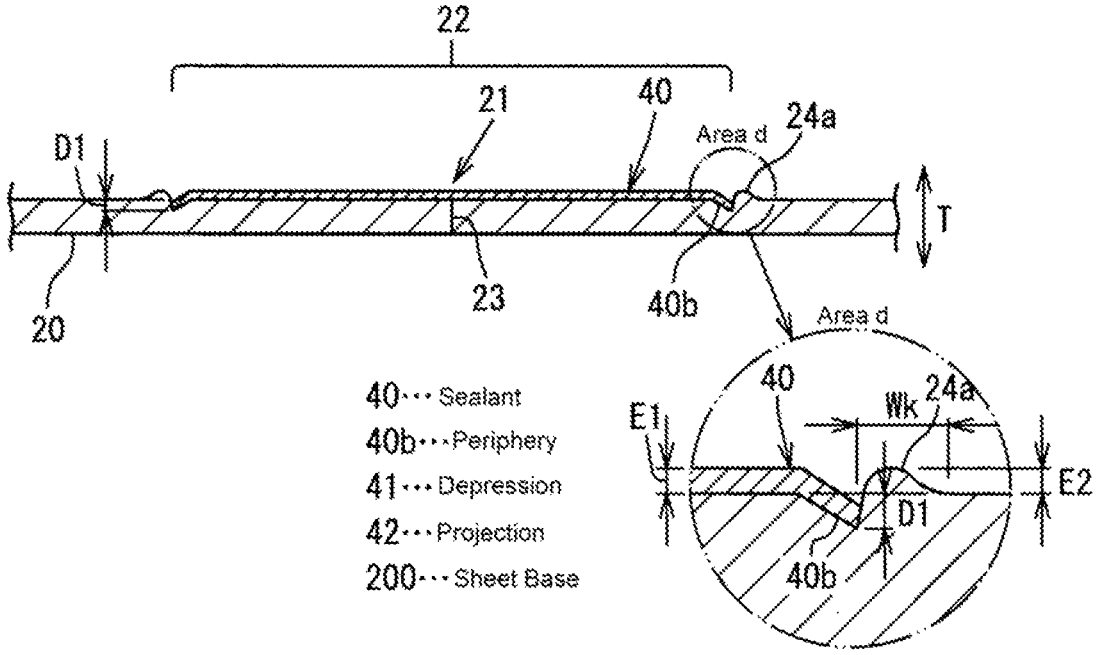

FIG. 36 is a diagram describing the bend-open package 10E according to the fourteenth embodiment. More specifically, FIG. 36(*a*) is a cross-sectional view of the bend-open package 10E taken along the centerline perpendicular to the transverse direction W, and FIG. 36(*b*) is an enlarged cross-sectional view of the opening area 22 on the sheet member 20 shown in FIG. 36(*a*).

The bend-open package 10E in the fourteenth embodiment has a substantially flat surface surrounded by the periphery 40*b* of the sealant 40. The sheet member 20 has the protrusion 24*a* on its surface along the periphery 40*b* of the sealant 40. The protrusion 24*a* is higher than the periphery 40*b* of the sealant 40 embedded in the sheet member 20 and protrudes outwardly from the surface of the sheet member 20 (refer to FIGS. 36(*a*) and 36(*b*)).

The protrusion 24*a* has a height E2 substantially the same as the thickness E1 of the sealant 40 press-bonded to the sheet member 20. More specifically, the protrusion 24*a* on the sheet member 20 is substantially at the same height as the surface of the sealant 40 press-bonded to the sheet member 20 (refer to FIG. 36(*b*), and the enlarged view of area d shown in FIG. 36(*b*)).

When many bend-open packages 10E according to the fourteenth embodiment are conveyed or transported together, one bend-open package 10E touching or rubbing against an adjacent other bend-open package 10E can have its protrusion 24*a* protruding from the surface of the sheet member 20, which serves as a protective wall, and thus can avoid direct contact with the periphery 40*b* of the sealant 40 in the other bend-open package 10E.

This prevents the sealant 40 covering the cut 23 from having a scratch on its surface and from peeling or curling at its edge. Additionally, the sealant 40 more reliably seals the cut 23 until the sealant 40 can rupture to open when the bend-open package 10E is bent. This embodiment thus has functions and effects additional to those in the eleventh to thirteenth embodiments.

Fifteenth Embodiment

In the eleventh to fourteenth embodiments described above, the bend-open package 10E has the sealant 40 with its periphery 40*b* entirely embedded. In a fifteenth embodiment, a bend-open package 10E has a sealant 40 with its periphery 40*b* partially embedded as shown in FIG. 37.

Figure 37A:
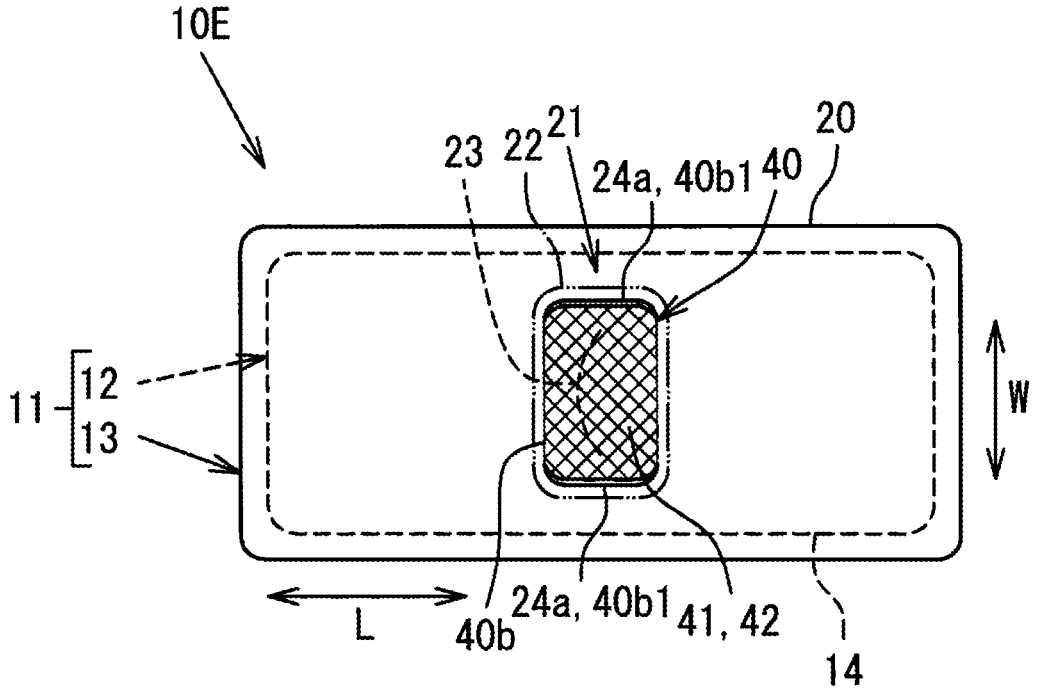
FIGS. 37(*a*) and 37(*b*) show a bend-open package according to a fifteenth embodiment.
Figure 37B:
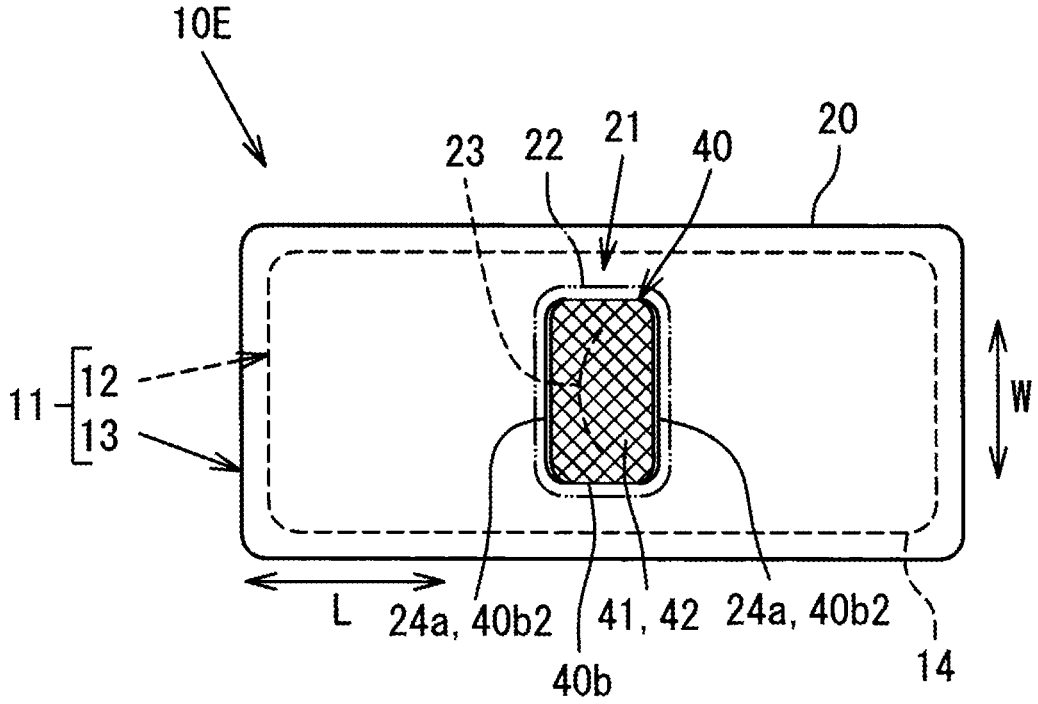

FIG. 37 is a diagram describing the bend-open package 10E according to the fifteenth embodiment. More specifically, FIG. 37(*a*) is a plan view of the bend-open package 10E with short-side edges 40*b*1 of the sealant 40 embedded in the sheet member 20, and FIG. 37(*b*) is a plan view of the bend-open package 10E with long-side edges 40*b*2 of the sealant 40 embedded in the sheet member 20.

In the bend-open package 10E according to the fifteenth embodiment, the periphery 40*b* of the sealant 40 has the pair of short-side edges 40*b*1 facing each other in the transverse direction W. The short-side edges 40*b*1 and extensions to the short-side edges 40*b*1 are embedded in the surface of the sheet member 20 (refer to FIG. 37(*a*)).

In some embodiments, the pair of long-side edges 40*b*2 of the periphery 40*b* of the sealant 40, which face each other in the longitudinal direction L, and extensions to the long-side edges 40*b*2 may be embedded in the surface of the sheet member 20 (refer to FIG. 37(*b*)).

Along the short-side edges 40*b*1 and the long-side edges 40*b*2 of the sealant 40, the protrusion 24*a* is formed on the sheet member 20 and protrudes outwardly from the surface of the sealant 40 press-bonded to the sheet member 20 (refer to FIG. 37(*a*)(*b*)).

Thus, the sealant 40 is prevented from unsealing the cut 23 until the bend-open package 10E is bent to a predetermined bend angle θ1 or less, and the sealing by the sealant 40 is maintained. This prevents leakage of content C stored in the container 14. This embodiment thus has functions and effects additional to those in the eleventh embodiment.

Sixteenth Embodiment

In the eleventh to fifteenth embodiments described above, the bend-open package 10E is open by rupturing the sealant 40. In a sixteenth embodiment, a bend-open package 10E is open when a sealant 40 is bent and peeled as shown in FIG. 38.

Figure 38A:
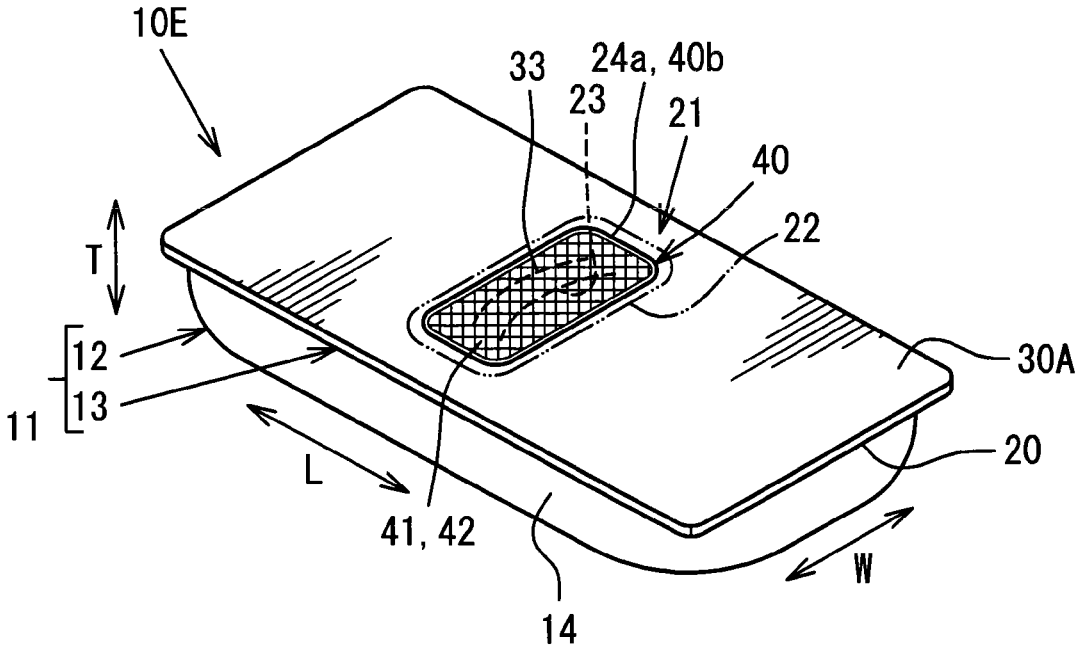
FIGS. 38(*a*) and 38(*b*) show a bend-open package according to a sixteenth embodiment.
Figure 38B:
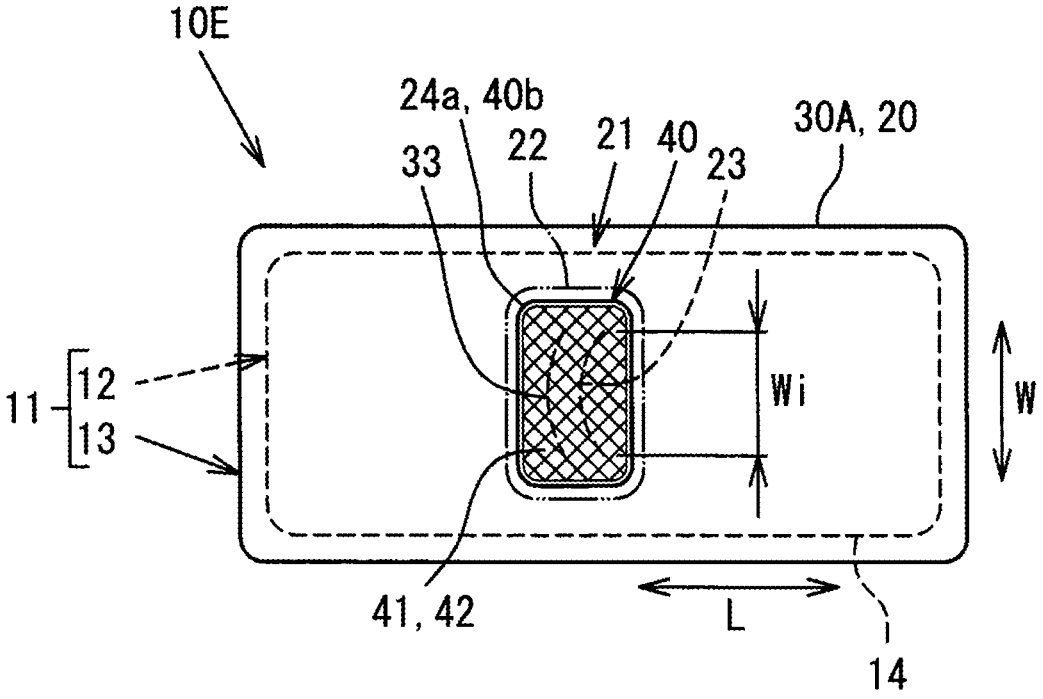

FIG. 38 is a diagram describing the bend-open package 10E according to the sixteenth embodiment. More specifically, FIG. 38(*a*) is a perspective view of the bend-open package 10E viewed from above, and FIG. 38(*b*) is a plan view of the bend-open package 10E shown in FIG. 38(*a*).

The bend-open package 10E in the sixteenth embodiment includes an adhesive layer having peelable adhesion that adheres the opposite surfaces between a cut 23 in the sheet member 20 and a cut 33 formed in the film member 30A within the opening area 22. The foil sealant 40 is press-bonded to the surface within the opening area 22 defined as a bend portion 21 for both the members 20 and 30A to cover the cuts 23 and 33 (refer to FIGS. 38(*a*) and 38(*b*)).

The sheet member 20 has a protrusion 24*a* on its part along the periphery 40*b* of the sealant 40. The protrusion 24*a* is higher than the periphery 40*b* of the sealant 40 embedded in the sheet member 20 and protrudes outwardly from the surface of the sealant 40 press-bonded to the sheet member 20 (refer to FIGS. 38(*a*) and 38(*b*)).

When many bend-open packages 10E according to the sixteenth embodiment are conveyed or transported together, one bend-open package 10E touching or rubbing against an adjacent other bend-open package 10E has its protrusion 24*a* protruding from the surface of the sheet member 20, which serves as a protective wall, and thus can avoid direct contact with the periphery 40*b* of the sealant 40 in the other bend-open package 10E.

This prevents the sealant 40 covering the cut 23 from having a scratch on its surface and from peeling or curling at its edge. Additionally, the sealant 40 more reliably seals the cut 23 until the sealant 40 is peeled to open when the bend-open package 10E is bent. This embodiment thus has functions and effects additional to those in the eleventh embodiment.

Seventeenth Embodiment

In the eleventh embodiment described above, the bend-open package 10E has the sealant 40 adhered to the sheet member 20. In a seventeenth embodiment, a bend-open package 10F is formed from two film members 30B adhered to each other as shown in FIGS. 39 and 40.

Figure 39A:
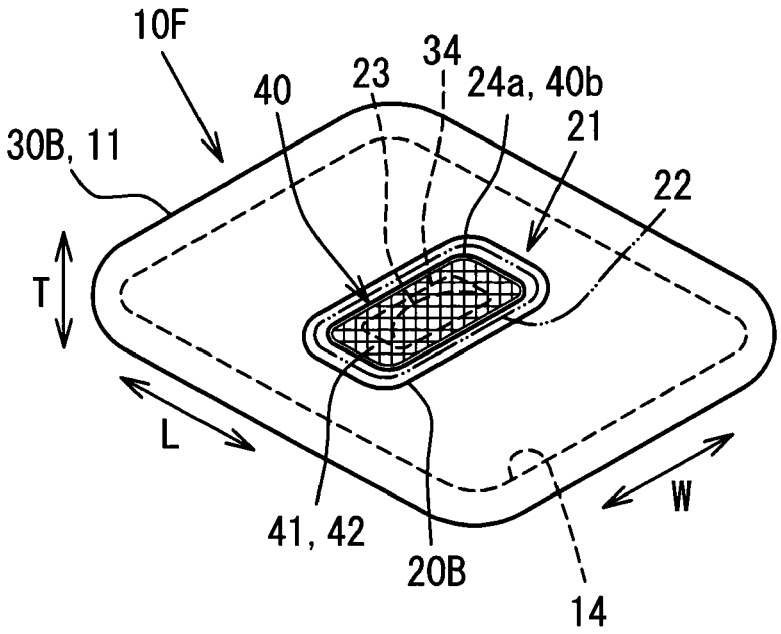
FIGS. 39(*a*) and 39(*b*) show a bend-open package according to a seventeenth embodiment.
Figure 39B:
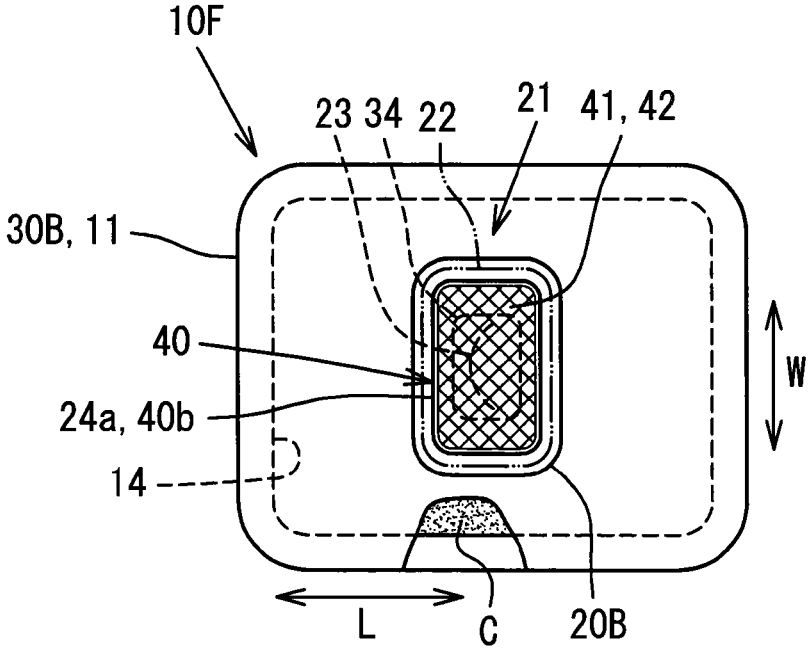

FIG. 39 is a diagram describing the bend-open package 10F according to the seventeenth embodiment. More specifically, FIG. 39(*a*) is a perspective view of the bend-open package 10F viewed from above, and FIG. 39(*b*) is a plan view of the bend-open package 10F shown in FIG. 39(*a*).

Figure 40A:
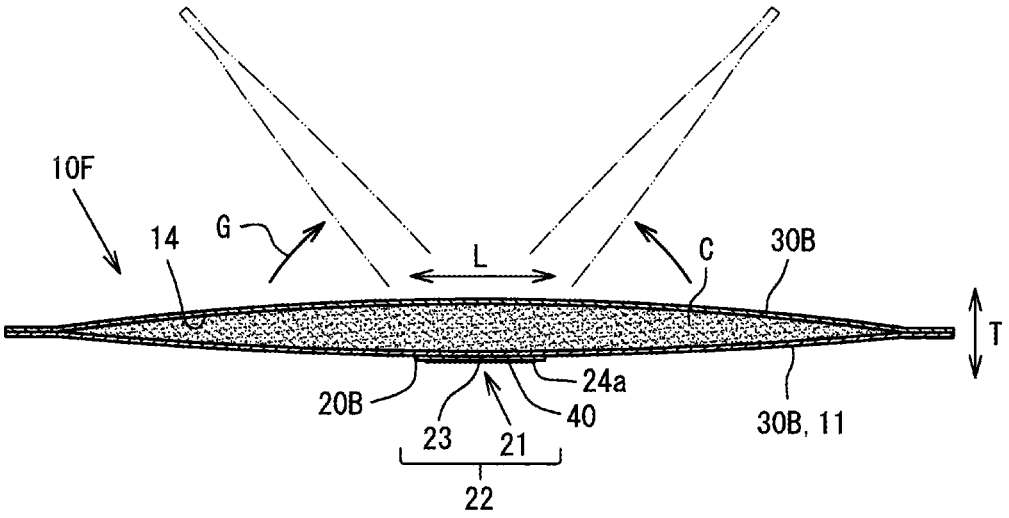
FIGS. 40(*a*) and 40(*b*) show dispensing of content from the bend-open package shown in FIGS. 39(*a*) and 39(*b*)
Figure 40B:
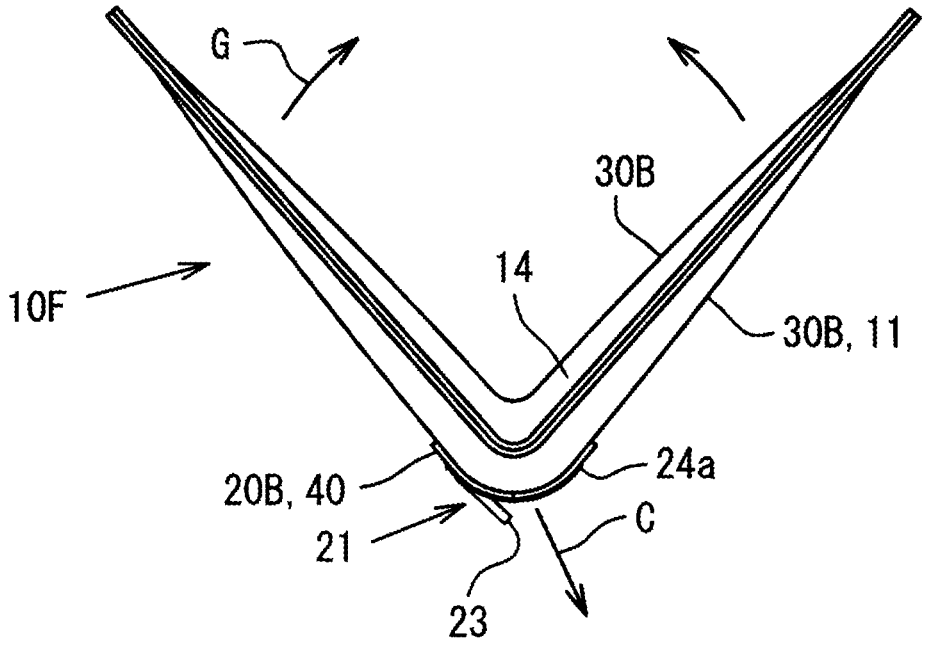

FIG. 40 is a diagram describing dispensing of content C from the bend-open package 10F shown in FIG. 39. More specifically, FIG. 40(*a*) is a cross-sectional view of the bend-open package 10F yet to be bent, taken along the centerline perpendicular to the transverse direction W, and FIG. 40(*b*) is a side view of the bend-open package 10F showing dispensing of content C from the package.

The bend-open package 10F in the seventeenth embodiment includes a package body 11 including the two film members 30B having substantially the same size and shape. The package body 11 is fabricated by overlaying the film members 30B on each other with the corresponding opposite peripheries of the film members 30B adhered to each other (refer to FIGS. 39(*a*), 39(*b*), and 40(*a*)).

One of the film members 30B has an opening 34 in its surface, and the sheet member 20B has a cut 23. The opening 34 and the cut 23 are aligned with each other, and then the sheet member 20B to which the sealant 40 is press-bonded is adhered to the film member 30B.

The sheet member 20B has a protrusion 24*a* on its part along the periphery 40*b* of the sealant 40. The protrusion 24*a* is higher than the periphery 40*b* of the sealant 40 embedded in the sheet member 20B and protrudes outwardly from the surface of the sealant 40 press-bonded to the sheet member 20B (refer to FIGS. 39(*a*) and 39(*b*)).

When many bend-open packages 10F according to the seventeenth embodiment are conveyed or transported together, one bend-open package 10F touching or rubbing against an adjacent other bend-open package 10F has its protrusion 24*a* protruding from the surface of the sheet member 20B, which serves as a protective wall, and can avoid direct contact with the periphery 40*b* of the sealant 40 in the other bend-open package 10F.

This prevents the sealant 40 covering the cut 23 from having a scratch on its surface and from peeling or curling at its edge. Additionally, the sealant 40 more reliably seals the cut 23 until the sealant 40 can rupture to open when the bend-open package 10F is bent (refer to FIGS. 40(*a*) and 40(*b*)). This embodiment thus has functions and effects additional to those in the eleventh embodiment.

Eighteenth Embodiment

Figure 41A:
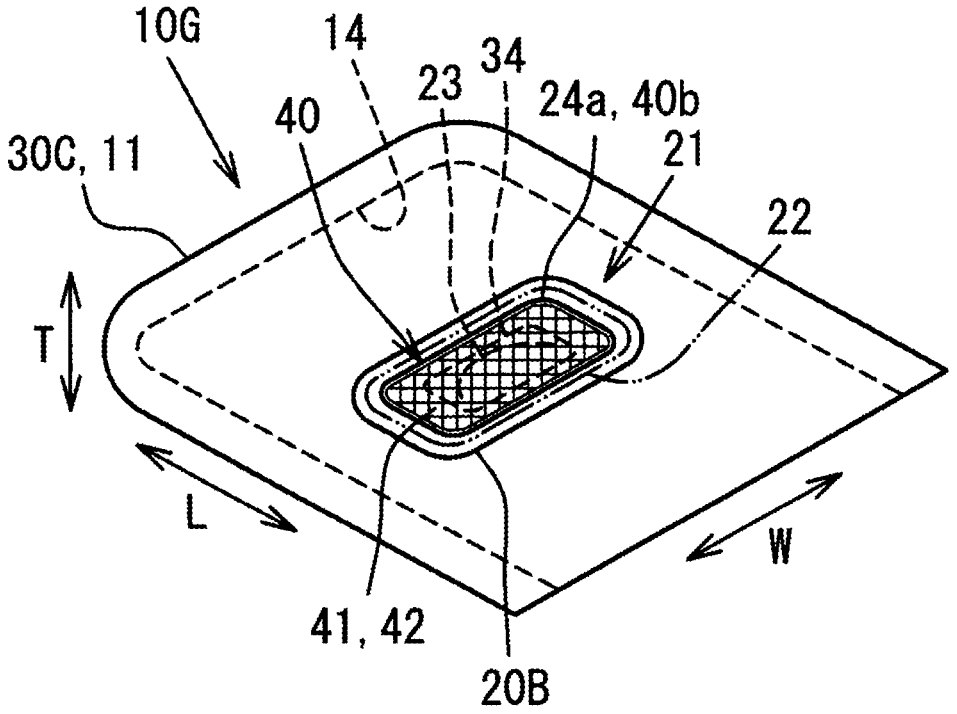
FIGS. 41(*a*) and 41(*b*) show a bend-open package according to an eighteenth embodiment.
Figure 41B:
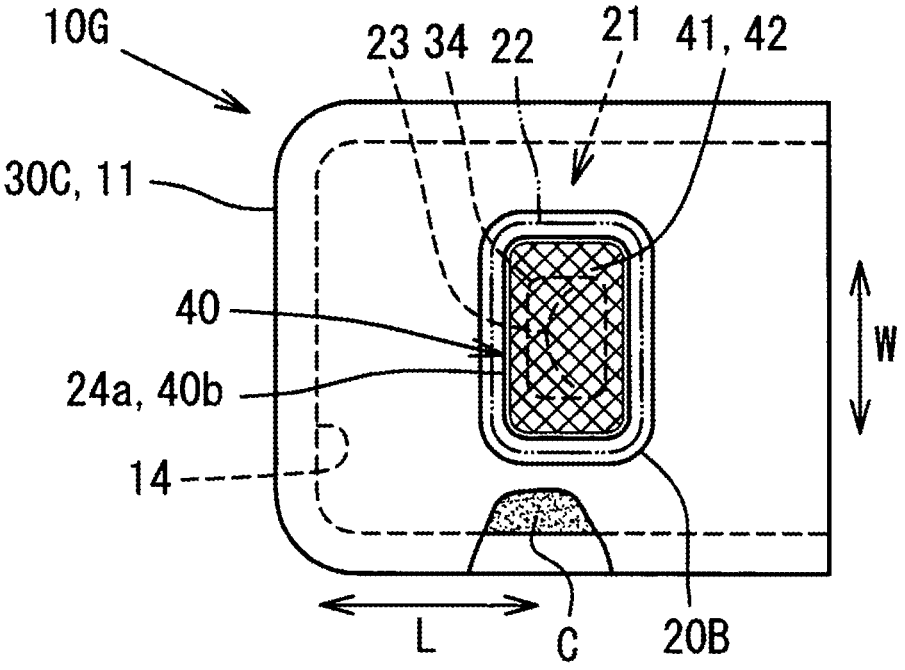

In an eighteenth embodiment, a bend-open package 10G is formed by folding one film member 30C into two as shown in FIG. 41.

FIG. 41 is a diagram describing the bend-open package 10G according to the eighteenth embodiment. More specifically, FIG. 41(*a*) is a perspective view of the bend-open package 10G viewed from above, and FIG. 41(*b*) is a plan view of the bend-open package 10G shown in FIG. 41(*a*).

The bend-open package 10G according to the eighteenth embodiment includes a package body 11 including a film member 30C having a size and a shape corresponding to two film members 30B placed side by side in the longitudinal direction L. The package body 11 is formed by folding the film member 30C into two along an imaginary bend line (not shown) that is the centerline in the transverse direction W, and joining together the three corresponding facing edges of the film member 30C folded into two (refer to FIGS. 41(*a*) and 41(*b*)).

The film member 30C has an opening 34 in its one surface, and the sheet member 20B has a cut 23. The opening 34 and the cut 23 are aligned with each other, and then the sheet member 20B to which the sealant 40 is press-bonded is adhered to the film member 30C.

The sheet member 20B has a protrusion 24*a* on its part along the periphery 40*b* of the sealant 40. The protrusion 24*a* is higher than the periphery 40*b* of the sealant 40 embedded in the sheet member 20B and protrudes outwardly from the surface of the sealant 40 press-bonded to the sheet member 20B (refer to FIGS. 41(*a*) and 41(*b*)).

When many bend-open packages 10G according to the eighteenth embodiment are conveyed or transported together, one bend-open package 10G touching or rubbing against an adjacent other bend-open package 10G has its protrusion 24*a* protruding from the surface of the sheet member 20, which serves as a protective wall, and can avoid direct contact with the periphery 40*b* of the sealant 40 in the other bend-open package 10G.

This prevents the sealant 40 covering the cut 23 from having a scratch on its surface and from peeling or curling at its edge. Additionally, the sealant 40 more reliably seals the cut 23 until the sealant 40 can rupture to open when the bend-open package 10G is bent. This embodiment thus has functions and effects additional to those in the eleventh embodiment.

The aspects of the present invention correspond to the embodiments in the manner described below.

An opening according to the aspects of this invention correspond to the cuts 23 and 33 in the embodiments.

Likewise, forming a plurality of openings corresponds to the cut forming step (a).

A flat member corresponds to the sheet member 20 and the sheet base 200.

A sealant member corresponds to the sealant base 400.

A sealant press-cutting unit corresponds to the press-cutting roll 404.

However, the present invention is not limited to the embodiments described above. The embodiments may be modified within the technical idea set forth in the appended claims, and the invention may be implemented in many embodiments.

Figure 24:
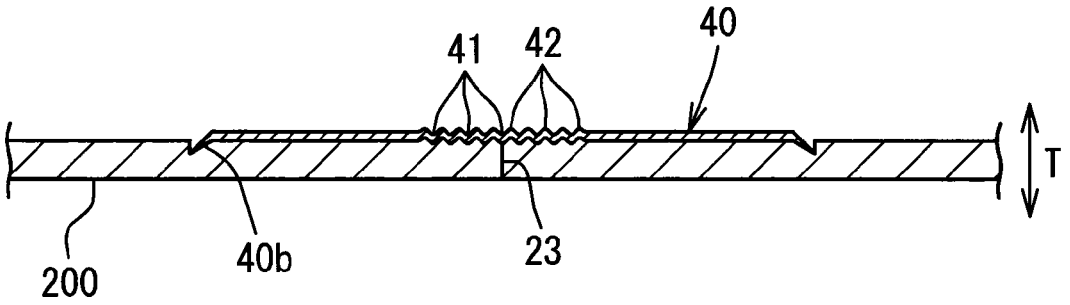
FIG. 24 is an enlarged cross-sectional view of a sheet base with depressions and projections formed in the middle of a sealant according to a nineteenth embodiment.

In the first to tenth embodiments described above, the depressions 41 and the projections 42 are formed on the entire surface of the sealant 40. In a nineteenth embodiment, for example, a sheet base 200 with a sealant 40 covering a cut 23, and depressions 41 and projections 42 are formed in a middle portion of the sealant 40 as shown in FIG. 24.

This sealant 40 has a part with a reduced thickness including the depressions 41 and the projections 42, and thus the part of the sealant 40 corresponding to the cut 23 can more easily rupture to open when the bend-open package 10A is bent.

In the sixth and seventh embodiments described above, the sheet member 20B to which the sealant 40 is press-bonded is partially adhered to the surface of the bend-open packages 10B and 10C. In some embodiments, the sheet member 20B may be adhered to the entire surface of the bend-open packages 10B and 10C.

A bendable fold line may be drawn on the bend portion 21 of a sheet member 20 to indicate the line along which the sheet member 20 can be folded into two.

In the embodiments, the entire periphery 40*b* of the sealant 40 is embedded in and press-bonded to the surface of the sheet member 20 in the thickness direction T by a predetermined depth D1. In some embodiments, at least a pair of facing edges included in the periphery 40*b* may be embedded in and press-bonded to the surface of the sheet member 20 in the thickness direction T by the predetermined depth D1.

In the eleventh to eighteenth embodiments described above, the protrusion 24*a* has a height E2 that is about 0.5 or more times the thickness E1 of the sealant 40. In some embodiments, the protrusion 24*a* may have a height E2 that is about once or more times the thickness E1 of the sealant 40. In addition, a bendable fold line may be drawn on the bend portion 21 of a sheet member 20 to indicate the line along which the sheet member 20 can be folded into two.

In the seventeenth and eighteenth embodiments, the sheet member 20B to which the sealant 40 is press-bonded is partially adhered to the surface of the bend-open packages 10F and 10C. In some embodiments, the sheet member 20B may be adhered to the entire surface of the bend-open packages 10F and 10C.

REFERENCE SIGNS LIST

C content
10A, 10B, 10C, 10D, 10E, 10F, 10G bend-open package
11 package body
12 body
13 lid
14 container
20 sheet member
21 bend portion
22 opening area
23, 33 cut
24, 24*a* protrusion
30A, 30B, 30C film member
33 cut
34 opening
40 sealant
40*b* periphery
40*b*1 short-side edge
40*b*2 long-side edge
40*c* protrusion
41 depression
42 projection
200 sheet base
202 cutter
300 film base
400 sealant base
402 press-cutting/press-bonding machine
403 sheet mount
404 sealant press-cutting unit
4044 press-cutting unit
405 sealant pressing part
406, 416, 426, 436 press-cutting section
407 heater
408 roughening section
414 tubular package
421 filling device
422 filling tube
431 feeding roll
441 longitudinally sealing roll
451 transversely sealing roll
461 rotary blade
462 support roll
(a) cut forming step
(b) sealant press-cutting/press-bonding step
(c) base recovery step
(d) base winding step
(e) combining step
(f) longitudinally sealing step
(g) transversely sealing step
(h) filling step
(i) dividing step

The invention claimed is:

1. A bend-open package, comprising:

a package body configured to store content, the package body being at least partially a flat member including a bend portion that is bendable for being folded into two;

a sealant press-bonded to a surface of the flat member to cover an opening in the bend portion, the sealant being configured to rupture and open in accordance with bending of the bend portion, the sealant having a periphery embedded in and press-bonded to the surface of the flat member; and a protrusion located on the surface of the flat member along an edge included in the periphery, the protrusion protruding outwardly from the surface of the flat member and having a height smaller than a thickness of the sealant and smaller than a height of the sealant.

2. The bend-open package according to claim 1, wherein the protrusion extends along an entire periphery of the sealant.

3. The bend-open package according to claim 1, wherein the protrusion has a height that is gradually greater from a periphery of the flat member toward the periphery of the sealant.

4. The bend-open package according to claim 1, wherein the protrusion protruding outwardly from the surface of the flat member has a height of at least substantially 50% of the thickness of the sealant.

5. The bend-open package according to claim 1, wherein the surface of the sealant includes a plurality of microscopic depressions and a plurality of projections.

6. The bend-open package according to claim 1, wherein the periphery of the sealant includes at least a pair of facing edges embedded in and press-bonded to the surface of the flat member in a thickness direction.

7. The bend-open package according to claim 1, wherein the sealant has an entire periphery embedded in and press-bonded to the surface of the flat member in a thickness direction.

8. The bend-open package according to claim 1, wherein an edge included in the periphery of the sealant or an entire periphery of the sealant is embedded in and press-bonded to the surface of the flat member to have an embedded portion having a depth gradually increasing from a middle of the sealant toward an outer periphery of the sealant.

9. A method for manufacturing a bend-open package including a package body configured to store content, the package body being at least partially a flat member including a bend portion that is bendable for being folded into two, and a sealant press-bonded to a surface of the flat member to cover an opening in the bend portion, the sealant being configured to rupture and open in accordance with bending of the bend portion, the method comprising in sequence:

forming a plurality of openings in a surface of a flat member strip at predetermined intervals in a longitudinal direction of the strip;

press-cutting, with a sealant press-cutting unit, a sealant member strip into sealants each sized and shaped to cover one of the openings, and press-bonding the sealant that has been press-cut from the sealant member strip to the surface of the flat member to cover the opening; and press-bonding a periphery of the sealant embedded in the surface of the flat member with the sealant press-cutting unit, and forming a protrusion on the surface of the flat member along an edge of the sealant, the protrusion having a height smaller than a thickness of the sealant and smaller than a height of the sealant.

10. The method for manufacturing a bend-open package according to claim 9, wherein the protrusion extends along an entire periphery of the sealant.

11. The method for manufacturing a bend-open package according to claim 9, wherein the protrusion has a height that is gradually greater from a periphery of the flat member toward the periphery of the sealant.

12. The method for manufacturing a bend-open package according to claim 9, wherein the protrusion protruding outwardly from the surface of the flat member has a height of at least substantially 50% of the thickness of the sealant.

13. The method for manufacturing a bend-open package according to claim 9, wherein the sealant press-cutting unit includes a sealant pressing part configured to press the sealant toward the surface of the flat member in a thickness direction with the sealant overlaid on the flat member to cover the opening.

14. The method for manufacturing a bend-open package according to claim 13, wherein the sealant pressing part includes a roughening section configured to form a plurality of microscopic depressions and a plurality of projections on the surface of the sealant.

15. The method for manufacturing a bend-open package according to claim 14, wherein the roughening section is included in an area of the sealant pressing part corresponding to the opening in the flat member.

16. The method for manufacturing a bend-open package according to claim 13, wherein the sealant pressing part includes, on a pressing end periphery thereof, a press-cutting section configured to press-cut the sealant member into sealants each sized and shaped to cover the opening, and the press-cutting section is configured to embed at least a pair of facing edges included in the periphery of the sealant into the surface of the flat member in the thickness direction.

17. The method for manufacturing a bend-open package according to claim 16, wherein the press-cutting section has a cutting edge protruding in a direction in which the edges of the sealant are embedded in the surface of the flat member, and the cutting edge has a predetermined embedding angle causing an embedding depth of the edges of the sealant to gradually increase from a middle of the sealant toward an outer periphery of the sealant.

18. A bend-open package, comprising:

a package body configured to store content, the package body being at least partially a flat member including a bend portion that is bendable for being folded into two;

a sealant press-bonded to a surface of the flat member to cover an opening in the bend portion, the sealant being configured to rupture and open in accordance with bending of the bend portion, the sealant having a periphery with at least a pair of facing edges embedded in and press-bonded to the surface of the flat member in a thickness direction of the flat member; and a protrusion located on the surface of the flat member along the edges of the sealant, the protrusion protruding outwardly from the edges of the sealant embedded in the flat member.

19. The bend-open package according to claim 18, wherein the protrusion on the flat member has a height that is 0.5 or more times a thickness of the sealant.

20. The bend-open package according to claim 18, wherein the protrusion on the flat member has a width that is once or more times the thickness of the sealant.

21. The bend-open package according to claim 18, wherein the protrusion on the flat member is raised from a surface of the sealant press-bonded to the flat member.

22. The bend-open package according to claim 18, wherein the sealant has a protrusion protruding outwardly from the surface of the sealant, and the protrusion on the sealant is located inside the edges of the sealant embedded in the flat member and extends along the protrusion on the flat member.

23. The bend-open package according to claim 22, wherein the protrusion on the sealant is higher than the protrusion on the flat member.

24. The bend-open package according to claim 18, wherein the edges of the sealant embedded in the flat member in the thickness direction have an embedding depth that is 0.5 or more times the thickness of the sealant.

25. The bend-open package according to claim 18, wherein the protrusion on the flat member covers the edges of the sealant embedded in the flat member.

26. A method for manufacturing a bend-open package including a package body configured to store content, the package body being at least partially a flat member including a bend portion that is bendable for being folded into two, and a sealant press-bonded to a surface of the flat member to cover an opening in the bend portion, the sealant being configured to rupture and open in accordance with bending of the bend portion, the method comprising in sequence:

forming a plurality of openings in a surface of a flat member strip at predetermined intervals in a longitudinal direction of the strip;

press-cutting, with a sealant press-cutting unit, a sealant member strip into sealants each sized and shaped to cover one of the openings, and press-bonding the sealant that has been press-cut from the sealant member strip to the surface of the flat member to cover the opening; and press-bonding a periphery of the sealant embedded in the surface of the flat member in a thickness direction, and forming a protrusion on the surface of the flat member along an edge of the sealant embedded in the flat member, the protrusion protruding outwardly from the edge of the sealant.

27. The method for manufacturing a bend-open package according to claim 26, wherein the sealant press-cutting unit includes a press-cutting roll rotatable in a direction allowing the flat member and the sealant member to be fed in a feeding direction.

28. The method for manufacturing a bend-open package according to claim 26, wherein the protrusion on the flat member has a height that is 0.5 or more times a thickness of the sealant.

29. The method for manufacturing a bend-open package according to claim 26, wherein the edge of the sealant embedded in the flat member in the thickness direction has an embedding depth that is 0.5 or more times the thickness of the sealant.

* * * * *